US011178964B2

(12) United States Patent
Buck et al.

(10) Patent No.: US 11,178,964 B2
(45) **Date of Patent: *Nov. 23, 2021**

(54) MOUNTING SYSTEM WITH HORIZONTALLY-SLIDEABLE BRACKET AND SUPPORT BRACKET

(71) Applicant: Altria Client Services LLC, Richmond, VA (US)

(72) Inventors: James Buck, Richmond, VA (US); Greg Gannon, Richmond, VA (US); Dennis Polvere, Richmond, VA (US); Adam P. Kiteley, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 46 days.

This patent is subject to a terminal disclaimer.

(21) Appl. No.: 16/391,846

(22) Filed: Apr. 23, 2019

(65) Prior Publication Data

US 2019/0246815 A1 Aug. 15, 2019

Related U.S. Application Data

(62) Division of application No. 15/367,852, filed on Dec. 2, 2016, now Pat. No. 10,306,981.

(51) Int. Cl.
*A47B 57/42* (2006.01)
*A47F 5/00* (2006.01)
(Continued)

(52) U.S. Cl.
CPC ..... *A47B 57/42* (2013.01); *A47B 57/34* (2013.01); *A47B 96/1441* (2013.01);
(Continued)

(58) Field of Classification Search
CPC ..... A47B 57/08; A47B 57/10; A47B 57/42; A47B 57/34; A47B 57/16; A47B 57/40;
(Continued)

(56) References Cited

U.S. PATENT DOCUMENTS 775,496 A * 11/1904 Parsons ..... A47B 57/26 108/106
2,056,078 A * 9/1936 Slater ..... A47B 57/34 248/243
(Continued)

FOREIGN PATENT DOCUMENTS

DE 202016102834 U1 6/2016
EP 2090197 A1 8/2009
(Continued)

OTHER PUBLICATIONS

Notice of Allowance dated Aug. 26, 2020, issued in co-pending U.S. Appl. No. 16/725,111.
(Continued)

*Primary Examiner* — Hiwot E Tefera
(74) *Attorney, Agent, or Firm* — Harness, Dickey & Pierce, P.L.C.

(57) ABSTRACT

The mounting system includes a first crossbar, at least one horizontally-slideable bracket on the first crossbar, and a first support bracket and a second support bracket respectively on a first end and a second end of the first crossbar. The first support bracket and the second support bracket attach the first crossbar to a first vertical upright and a second vertical upright of a consumer product display, respectively. The support brackets each include a major body, and a first engaging structure and a second engaging structure on a first end and a second end of the major body, respectively. The engaging structures each are configured to respectively connect to a front set of teeth and a back set of teeth, where the front set of teeth and the back set of teeth run along a longitudinal length of the first vertical upright and the second vertical upright, respectively.

22 Claims, 49 Drawing Sheets

(51) Int. Cl.

| | |
|---|---|
| ***A47F 5/08*** | (2006.01) |
| ***A47B 57/34*** | (2006.01) |
| ***A47B 96/14*** | (2006.01) |
| *A47F 1/12* | (2006.01) |
| *A47F 5/10* | (2006.01) |

(52) U.S. Cl.

CPC ..... *A47F 5/0025* (2013.01); *A47F 5/0846* (2013.01); *A47F 1/126* (2013.01); *A47F 5/103* (2013.01)

(58) Field of Classification Search

CPC ..... A47B 57/265; A47B 57/30; A47B 57/402; A47B 57/406; A47B 57/545; A47B 57/562; A47B 96/061; A47B 57/045; A47B 94/1441; A47B 96/067; A47B 47/022; A47B 57/404; A47B 96/1416; A47B 96/1441; A47B 57/26; A47B 57/48; A47B 57/482; A47B 57/485; A47B 57/54; A47B 57/567; A47B 57/32; A47F 5/103; A47F 5/0838; A47F 5/0043; A47F 5/0093; A47F 5/0846; A47F 5/0025; A47F 5/101; A47F 5/0853; A47F 5/08; A47F 1/126

USPC ..... 211/187, 134, 153, 59.1, 59.2, 90.01, 211/90.02, 90.04, 94.01, 94.02, 103, 193, 211/208, 105.1, 189, 117, 59.3, 162, 211/126.2, 192, 88.01, 88.02; 248/218.4, 248/214, 250, 220.31, 243, 215; 108/108, 108/107, 106, 109, 110, 147.17, 144.11, 108/146, 147.11, 147.16, 147.18

See application file for complete search history.

(56) References Cited

U.S. PATENT DOCUMENTS 2,739,777 A 3/1956 Schoenhardt
3,004,673 A 10/1961 Emery
3,273,720 A 9/1966 Seiz
3,285,424 A 11/1966 Emery
3,352,584 A 11/1967 Toefil
3,510,010 A 5/1970 Gasner
3,570,798 A 3/1971 Squibb
3,788,717 A 1/1974 Hosmer
3,810,430 A * 5/1974 Siegal ..... A47B 57/10 108/147.16
3,886,698 A 6/1975 Raith et al.
3,908,830 A 9/1975 Skrzelowski
4,018,167 A 4/1977 Spangler
4,126,230 A * 11/1978 Tyson ..... A47B 63/00 211/189
4,203,373 A * 5/1980 Conti ..... A47B 57/06 108/152
4,349,113 A 9/1982 Schreiner
4,369,887 A 1/1983 Emery
4,401,222 A 8/1983 Kulikowski et al.
4,499,128 A 2/1985 Strausheim
4,800,821 A 1/1989 Nook et al.
4,828,120 A 5/1989 Beil et al.
4,828,122 A * 5/1989 Day ..... A47H 1/102 211/105.1
5,035,626 A 7/1991 Persin
5,048,698 A 9/1991 Konrad
5,074,422 A 12/1991 Holtz
5,088,607 A 2/1992 Risafi et al.
5,101,989 A 4/1992 Jones
5,292,015 A 3/1994 Bumbera
5,427,255 A 6/1995 Nook
5,454,638 A 10/1995 Bird et al.
5,472,103 A 12/1995 Merl
5,509,541 A 4/1996 Merl
5,538,213 A 7/1996 Brown
5,641,081 A 6/1997 Merl
5,769,247 A 6/1998 Merl
5,921,411 A 7/1999 Merl
5,957,422 A 9/1999 Shea
6,053,460 A 4/2000 Wilkinson, Jr. et al.
6,070,747 A 6/2000 Shea
6,070,841 A 6/2000 Robinson
6,168,032 B1 1/2001 Merl
6,199,706 B1 3/2001 Shea
6,202,866 B1 3/2001 Shea
6,220,464 B1 4/2001 Battaglia et al.
6,223,916 B1 5/2001 Enos
6,227,385 B1 5/2001 Nickerson
6,234,328 B1 5/2001 Mason
6,357,609 B1 3/2002 Van Noord et al.
6,378,828 B1 4/2002 Valiulis et al.
6,409,028 B2 6/2002 Nickerson
6,497,395 B1 12/2002 Croker
6,499,608 B1 * 12/2002 Sterling ..... A47B 96/027 211/70.1
6,505,800 B1 1/2003 Abdullah
6,659,295 B1 12/2003 De Land et al.
6,672,226 B2 1/2004 Bohnacker
6,722,619 B2 4/2004 Valiulis et al.
7,028,852 B2 4/2006 Johnson et al.
7,175,034 B2 2/2007 Nook et al.
7,188,740 B2 3/2007 Marchetta et al.
7,201,281 B1 4/2007 Welker
7,296,697 B2 11/2007 Costa et al.
7,314,144 B2 1/2008 Stitchick et al.
7,419,062 B2 9/2008 Mason
7,478,731 B1 1/2009 Mason
7,497,344 B2 3/2009 Chen
7,654,497 B1 2/2010 Karan
7,681,744 B2 3/2010 Johnson
7,775,379 B2 8/2010 Hodge
7,950,538 B2 * 5/2011 Zang ..... A47B 57/16 211/187
7,992,726 B2 8/2011 Goehring
8,061,539 B2 11/2011 Punzel et al.
8,087,522 B2 1/2012 Stafford et al.
8,113,360 B2 2/2012 Olson
8,210,367 B2 7/2012 Nagel et al.
8,276,766 B2 10/2012 Rataiczak, III et al.
8,317,038 B2 11/2012 Luberto et al.
8,413,825 B2 4/2013 Spizman et al.
8,720,702 B2 5/2014 Nagel
8,746,468 B2 6/2014 Poulokefalos
8,770,529 B2 7/2014 Berglund et al.
8,893,901 B2 11/2014 Nagel
8,955,271 B2 2/2015 Keller et al.
8,967,393 B2 3/2015 Bryson et al.
8,985,352 B2 3/2015 Bergdoll et al.
8,998,009 B2 4/2015 Kim et al.
9,016,214 B2 4/2015 Zang et al.
9,016,484 B2 4/2015 Kologe
9,101,230 B2 8/2015 Sosso et al.
9,131,771 B2 9/2015 Lindblom
9,138,076 B2 9/2015 Hardy
9,179,788 B2 11/2015 Hardy
9,254,049 B2 2/2016 Nagel
9,339,108 B2 5/2016 Zang et al.
9,351,567 B2 5/2016 Go
9,468,312 B2 10/2016 Denby
9,486,090 B2 11/2016 Juric
9,518,419 B2 12/2016 Johnson et al.
9,526,357 B2 12/2016 Howard et al.
9,629,479 B2 4/2017 Sosso et al.
9,782,018 B2 10/2017 Hester-Redmond
10,098,479 B1 10/2018 Muellerleile
2001/0009639 A1 7/2001 Gunn
2002/0108916 A1 8/2002 Nickerson
2002/0170866 A1 * 11/2002 Johnson ..... A47F 1/126 211/59.3
2002/0190011 A1 12/2002 Caporale
2004/0159755 A1 8/2004 Valiulis et al.
2005/0167383 A1 8/2005 Taccolini et al.
2006/0186066 A1 8/2006 Johnson et al.
2008/0257842 A1 10/2008 Mason

(56) References Cited

U.S. PATENT DOCUMENTS

| | | | |
|---|---|---|---|
| 2008/0296245 | A1 | 12/2008 | Punzel et al. |
| 2009/0184072 | A1 | 7/2009 | Fischer et al. |
| 2012/0119043 | A1 | 5/2012 | Rataiczak, III |
| 2012/0193311 | A1 | 8/2012 | Benasillo |
| 2012/0204458 | A1 | 8/2012 | Goehring |
| 2014/0252932 | A1 | 9/2014 | Higashi et al. |
| 2015/0173528 | A1 | 6/2015 | Hester-Redmond |
| 2016/0022035 | A1 | 1/2016 | Hardy |
| 2016/0374466 | A1 | 12/2016 | Miller, Jr. et al. |
| 2017/0009961 | A1 | 1/2017 | Wertz et al. |
| 2017/0099961 | A1 | 4/2017 | Church et al. |
| 2017/0119174 | A1 | 5/2017 | Hardy |
| 2017/0172315 | A1 | 6/2017 | Hay |

FOREIGN PATENT DOCUMENTS

| | | | |
|---|---|---|---|
| FR | 2590143 | A1 | 5/1987 |
| WO | WO-2007073747 | A1 | 7/2007 |
| WO | WO-2011050406 | A1 | 5/2011 |

OTHER PUBLICATIONS

Office Action for corresponding U.S. Appl. No. 15/367,919 dated Nov. 1, 2018.

U.S. Office Action dated May 28, 2020, issued in corresponding U.S. Appl. No. 16/725,111.

Notice of Allowance dated Sep. 17, 2020, issued in co-pending U.S. Appl. No. 16/725,111.

Notice of Allowance dated July 2. 2021, issued in corresponding U.S. Appl. No. 17/140,501.

* cited by examiner

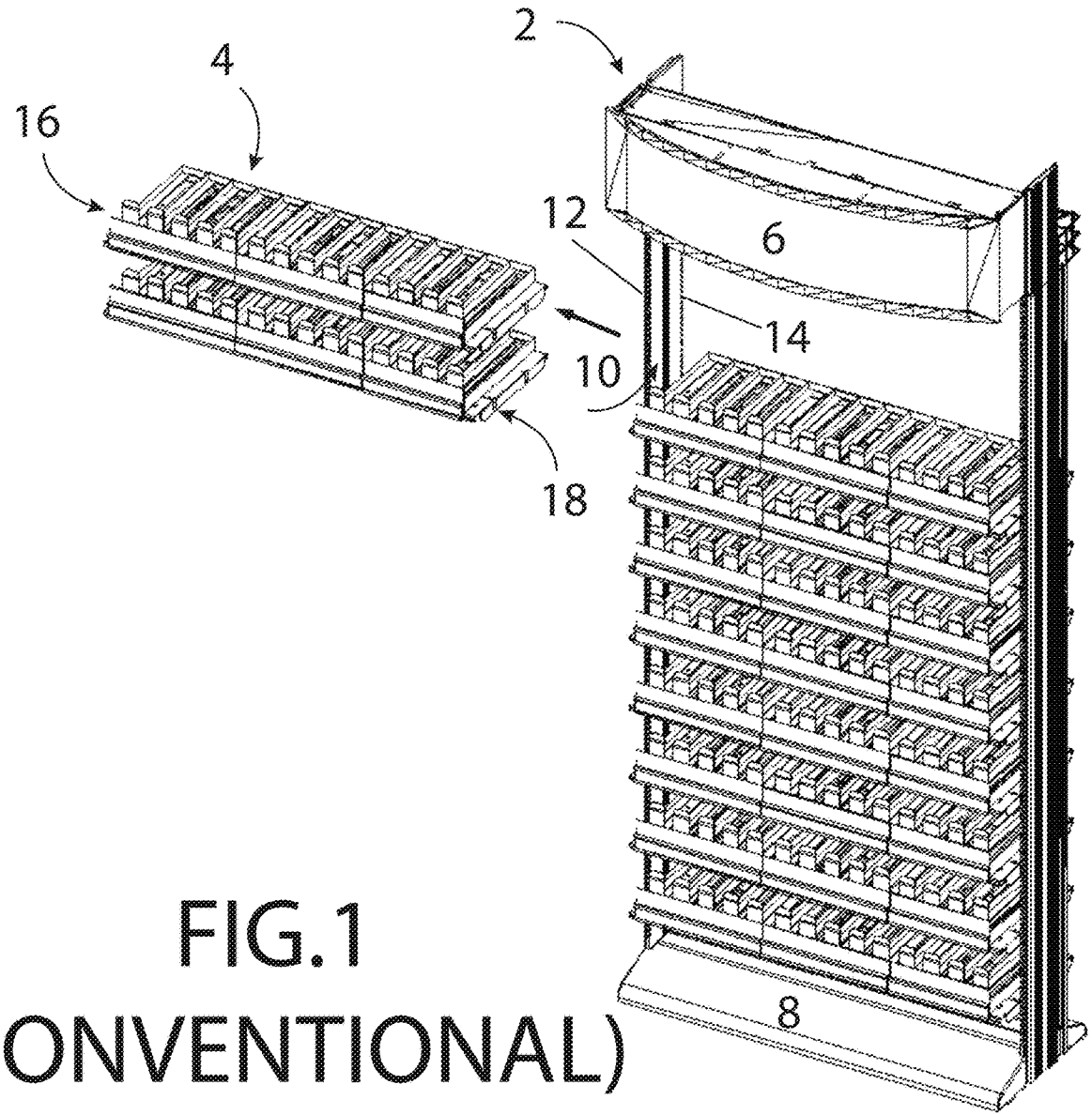
FIG.1
(CONVENTIONAL)

(VIEW A - A)

MOUNTING SYSTEM WITH HORIZONTALLY-SLIDEABLE BRACKET AND SUPPORT BRACKET

CROSS-REFERENCE TO RELATED APPLICATIONS

This application is a divisional of U.S. application Ser. No. 15/367,852, filed Dec. 2, 2016, the entire contents of which is incorporated herein by reference.

BACKGROUND OF THE INVENTION

Field of the Invention

Example embodiments relate generally to a merchandising platform for displaying and vending consumer products, such as adult tobacco derived products. Example embodiments also include a method of using the merchandising platform.

Related Art

Consumer product fixtures, such as merchandizing fixtures for e-vaping products, often are designed to only display standard-sized shelves in fixed and regimented locations on a front of the fixture. The fixed and limited shelving locations for the standard-sized shelves subsequently limits an ability to display and vend consumer products that may be a different width, depth and/or vertical height, as compared to standard-sized consumer products. That is to say, the fixtures often lack flexibility in conveniently accommodating variable-sized shelves and non-standard-sized consumer products.

Expensive and/or time-consuming retrofitting of product fixtures is generally required to install non-standard-sized shelves capable of displaying non-standard-sized products. Furthermore, the lack of flexibility of product fixtures often subsequently creates wasted display-space, which may reduce an overall amount of displayed products, and may reduce aggregate consumer product sales numbers. Furthermore, a sheer number of different standard consumer-product fixture types (which totals approximately 13 different fixture types that are offered within most U.S. stores) creates additional challenges, as each standard fixture type presents unique challenges that add to a complexity in providing a means to quickly vertically and horizontally adjust shelving locations, and utilize variable shelving sizes, in order to display non-standard-sized products while maximizing a number of displayed items able to be maintained within a limited vending space.

FIG. 1 illustrates a conventional consumer product display 2 for displaying and vending consumer products. The display 2 may include sectional shelving 4, where the shelving 4 may include individual shelves 18 that support trays 16 that may contain consumer products. A display panel (header) 6 may be on a front of the display 2 in order to advertise information and products. A base 8 of the display 2 may allow the display 2 to be freestanding. A backbone structure of the display 2 may include vertical uprights 10, where the upright may include a series of front teeth 12 and a series of back teeth 14 that may be positioned on each upright 10.

SUMMARY OF THE INVENTION

At least one example embodiment relates to a mounting system.

In an embodiment, the mounting system includes at least one first crossbar; at least one first horizontally-slideable bracket on the first crossbar; and a first support bracket and a second support bracket on ends of the first crossbar, the first and second support brackets configured to attach the first crossbar to respective first and second vertical uprights of a consumer product display, the support brackets each including, a major body, a first engaging structure and a second engaging structure on ends of the major body, the first and second engaging structures configured to respectively connect to a front set of teeth and a back set of teeth positioned along a longitudinal length of each of the first and second vertical uprights.

In an embodiment, the support brackets each have a longitudinal length that is about perpendicular to a longitudinal length of the first crossbar, the support brackets each further including, at least one center bracket configured to engage and grip an inner surface of a track running along a center-position of each of the vertical uprights.

In an embodiment, the second engaging structure and the center bracket are slideable along an outer surface of the support brackets, a distal end of the center bracket configured to fit into a side groove of the track of each of the vertical uprights.

In an embodiment, the ends of the first crossbar each define at least one horizontal cavity with a depth that runs through at least a portion of the longitudinal length of the first crossbar, the mounting system further including, a first insertable bracket and a second insertable bracket each with a major surface that is respectively insertable into the ends of the first crossbar, a third engaging structure and a fourth engaging structure respectively positioned on ends of the first and second insertable brackets, the third and fourth engaging structures configured to respectively connect the first and second insertable brackets to the first and second support brackets.

In an embodiment, the mounting system further includes, at least one second crossbar; a first vertical connector connecting the first insertable bracket to at least one third insertable bracket; a second vertical connector connecting the second insertable bracket to at least one fourth insertable bracket, the at least one third insertable bracket and the at least one fourth insertable bracket being insertable into ends of the at least one second crossbar to affix the at least one second crossbar to the first crossbar; and at least one third support bracket and at least one fourth support bracket on ends of the at least one second crossbar, the third and fourth support brackets configured to attach the at least one second crossbar to the respective first and second vertical uprights.

In an embodiment, the mounting system further includes, a first vertical corner plate connecting the first insertable bracket to the at least one third insertable bracket; and a second vertical corner plate connecting the second insertable bracket to the at least one fourth insertable bracket, wherein each of the major surfaces of the insertable brackets includes ribs configured to mate with ridges positioned on an inner surface of the respective ends of the crossbars to lock the insertable brackets into the respective ends of the crossbars.

In an embodiment, the at least one first crossbar includes a raised ridge running along a rear surface of the longitudinal length of the first crossbar, the first crossbar further including an upper ridge and a lower ridge running along a front surface of the longitudinal length of the first crossbar, the at least one first horizontally-slideable bracket having a C-shaped cross-section, and further including, a first plurality of vertical slots on a front surface of the first horizontally-slideable bracket, a first plurality of horizontal slots on an upper surface of the first horizontally-slideable bracket, the first plurality of horizontal slots traversing through a portion of a front/upper corner edge of the first horizontally-slideable bracket.

In an embodiment, each of the support brackets includes a recessed area on a surface of the major body of the support brackets, each of the support brackets further including, a floating plate positioned within the recessed area, the floating plate including the second engaging structure and the center brackets; a locking plate holding the floating plate within the recessed area; a locking tab connected to the locking plate; a locking stub protruding from the locking tab and traversing through the locking plate, the locking stub configured to selectively lock the floating plate into at least one of a locked position and an unlocked position, the unlocked position of the floating plate allowing the second engaging structure and the center brackets to become respectively unengaged from the back set of teeth, and the inner surface of the track, of the vertical upright, if the support bracket is installed on the vertical upright.

In an embodiment, the mounting system further includes, modularized shelving configured to connect to the at least one first crossbar, the shelving including, at least one shelf including one or more protractable blades, the protractable blades including a vertical bracket, the protractable blades configured to extend and retract the vertical bracket from a first side of the at least one shelf, the vertical bracket includes one or more teeth including a top-most tooth, a rear bracket extending from the first side of the at least one shelf, wherein the rear bracket includes an upper surface conformed to a lower portion of the first crossbar, and the top-most tooth is configured to insert into one of the first plurality of horizontal slots on the upper surface of the first horizontally-slideable bracket such that a distal most end of the top-most tooth contacts and becomes supported by the upper ridge on the front surface of the first crossbar.

In an embodiment, the modularized shelving further includes, at least one tray configured to be supported by the at least one shelf, the at least one shelf including horizontally adjustable tracks with notches capable of accepting mounting stubs for trays of varying widths.

In an embodiment, the first crossbar includes a front surface with a first ridge positioned above a second ridge, the first and second ridges running along at least a portion of a longitudinal length of the front surface, the first crossbar further includes a back surface with a third ridge positioned above a fourth ridge, the third ridge and the fourth ridge running along at least a portion of a longitudinal length of the back surface, the ends of the first crossbar defining the at least one horizontal cavity to include a major horizontal cavity between an upper and a lower horizontal cavity, the major horizontal cavity having a greater width than the upper and the lower horizontal cavities, an interior surface of the back surface defining a fifth ridge and a sixth ridge projecting into the major horizontal cavity and running along at least a portion of the longitudinal length of the back surface.

In an embodiment, lengths of the first crossbar are one of about 21.25 inches, 33.00 inches, or 44.50 inches.

At least another example embodiment relates to a support bracket for a mounting system.

In an embodiment, the support bracket includes, a major body with a first surface; a first engaging structure on a first end of the major body; a second engaging structure on a second end of the major body, the first and second engaging structures being configured to respectively connect to a front set of teeth and a back set of teeth positioned along a longitudinal length of a vertical upright of a consumer product display; and at least one center bracket configured to engage and grip an inner surface of a track running along a center-position of the vertical upright, wherein the second engaging structure and the center bracket are slideable along an outer surface of the major body.

In an embodiment, the support bracket further includes, a floating plate positioned within a recessed area defined by the first surface of the major body, the floating plate including the second engaging structure and the center brackets projecting from an inner surface of the floating plate; a locking plate holding the floating plate within the recessed area, the locking plate contacting an outer surface of the floating plate; a locking tab connected to the locking plate; a locking stub protruding from the locking tab and traversing through the locking plate, the locking stub configured to selectively lock the floating plate into at least one of a locked position and an unlocked position, the unlocked position of the floating plate allowing the second engaging structure and the center bracket to become respectively unengaged from the back set of teeth, and the inner surface of the track, of the vertical upright, if the support bracket is installed on the vertical upright.

In an embodiment, the first engaging structure includes a second surface attached to the first surface of the major body, the first and second surfaces being about perpendicular to each other, the first and second surfaces defining a plurality of slots configured to engage the front set of teeth of the vertical upright, each of the plurality of slots traversing both the first and second surfaces, the second engaging structure includes a plurality of teeth, a distal end of the center bracket is configured to fit into a side groove of the track of the vertical uprights.

At least another example embodiment relates to a method of installing a mounting system.

In an embodiment, the method includes, sliding at least one first horizontally-slideable bracket onto a first crossbar; inserting a first insertable bracket into a first cavity of a first end of first crossbar; inserting a second insertable bracket into a second cavity of a second end of the first crossbar; connecting a first support bracket onto a first vertical upright of a consumer product display; connecting a second support bracket onto a second vertical upright of the consumer product display, the first and second vertical uprights opposing each other on the consumer product display; attaching the first insertable bracket to the first support bracket using a first engaging structure; attaching the second insertable bracket to the second support bracket using a second engaging structure; and hanging shelving onto the first crossbar using the at least one first horizontally-slideable bracket.

In an embodiment, the first and second support brackets each include, a major body with a first surface, a third engaging structure on an end of the major body, a floating plate positioned within a recessed area defined by the first surface of the major body, the floating plate including a fourth engaging structure and a fifth engaging structure on an inner surface of the floating plate, a locking plate holding the floating plate within the recessed area, the locking plate contacting an outer surface of the floating plate, a locking tab connected to the locking plate, a locking stub protruding from the locking tab and traversing through the locking plate, the locking stub configured to selectively lock the floating plate into at least one of a locked position and an unlocked position.

In an embodiment, the connecting of the first and second support brackets onto the respective first and second vertical uprights of a consumer product display includes, unlocking the floating plate by pulling the locking tab away from the major body and shifting the floating plate within the recessed area major body to separate the fourth and fifth engaging structure from the third engaging structure, connecting the third engaging structure to a front set of teeth positioned along a longitudinal length of the respective first or second vertical upright, pivoting the major body to respectively align the fourth engaging structure and the fifth engaging structure with a center track and a back set of teeth positioned along the longitudinal length of the respective first or second vertical upright, locking the floating plate by shifting the floating plate within the recessed area of the major body to press the fourth and fifth engaging structures toward the third engaging structure so that the fourth and fifth engaging structures become respectively connected to an inner surface of the center track and the back set of teeth of the vertical upright.

In an embodiment, the shelving includes, at least one shelf including one or more protractable blades, the protractable blades including a vertical bracket, the vertical bracket including one or more teeth including a top-most tooth, a rear bracket extending from a first side of the at least one shelf, the rear bracket including an upper surface conformed to a lower portion of the first crossbar, at least one tray that is supported by the at least one shelf, the at least one shelf including more than one horizontally-adjustable track, the at least one first horizontally-slideable bracket has a C-shaped cross-section, and further includes, a first plurality of vertical slots on a front surface of the first horizontally-slideable bracket, a first plurality of horizontal slots on an upper surface of the first horizontally-slideable bracket, the first plurality of horizontal slots traversing through a portion of a front/upper corner edge of the first horizontally-slideable bracket.

In an embodiment, the hanging of the shelving onto the first crossbar includes, adjusting a gap between the more than one horizontally-adjustable track, on the at least one shelf, in order to accommodate a width of a tray, connecting the tray to the top of the at least one shelf, modifying a depth of the at least one shelf by one of extending and retracting the protractable blades, fitting the top-most tooth of the at least one shelf into one of the first plurality of horizontal slots of the first horizontally-slideable bracket so that a distal end of the top-most tooth fits through the top of the first horizontally-slideable bracket and contacts an upper surface of a ridge on a front surface of the first crossbar, connecting the rear bracket of the at least one shelf to the lower portion of the first crossbar.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

FIG. 1 illustrates a conventional consumer product display for displaying and vending consumer products;

DETAILED DESCRIPTION

Figure 2:
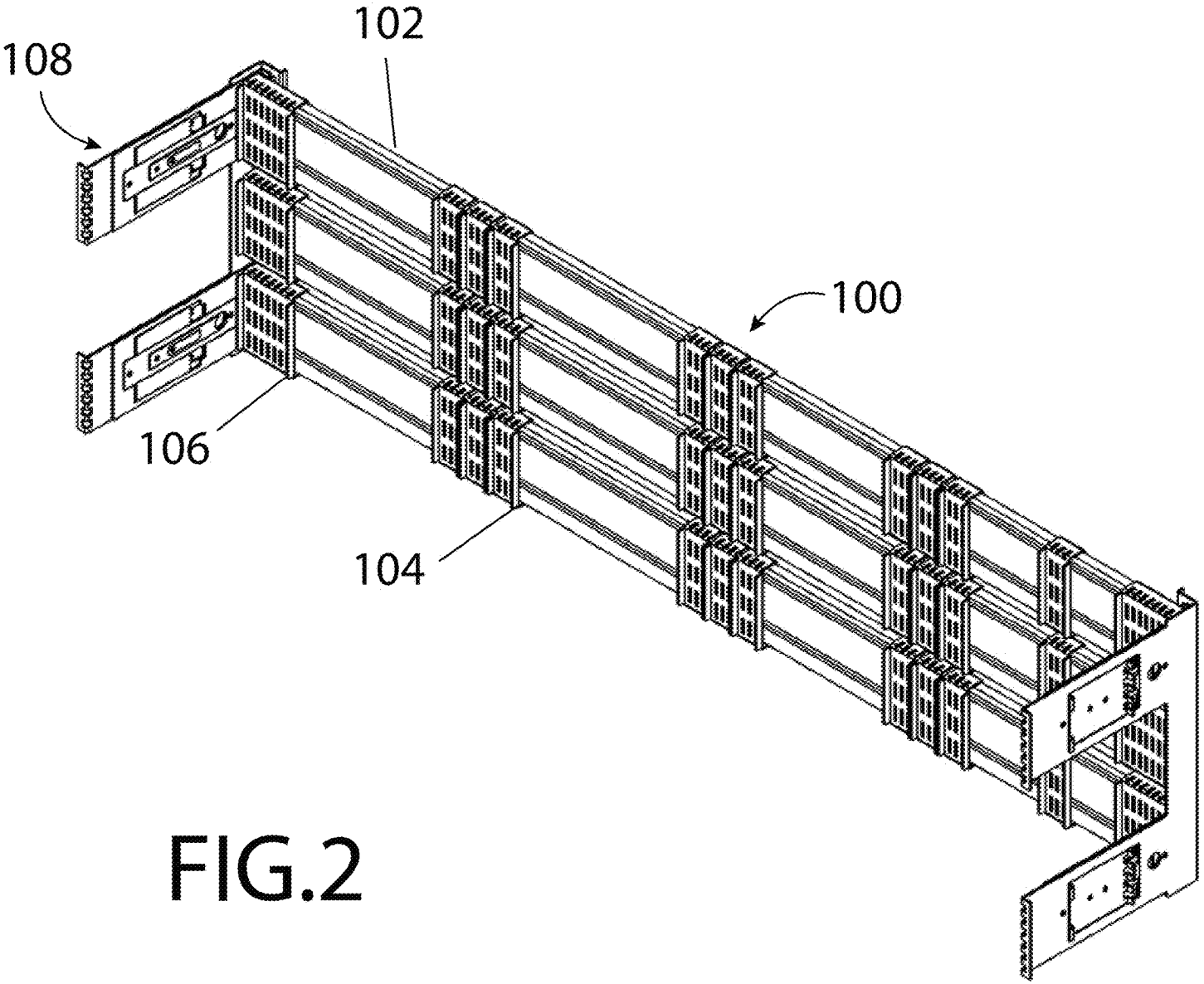
FIG. 2 illustrates a perspective view of a mounting system, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

FIG. 2 illustrates a perspective view of a mounting system 100, in accordance with an example embodiment. The mounting system 100 may include one or more horizontal crossbars 102 that may support horizontally-slideable brackets 104/106. The brackets 104/106 may vary in width, where narrower brackets 104 may, for instance, be used toward the center of the crossbar, and wider brackets 106 may be used toward the ends of the crossbar 102. A purpose of the wider brackets 106, on the ends of the crossbars 102, may include providing additional anchor-points for a graphic frame 300 (see FIG. 29), or other display equipment.

Side support brackets 108 may be positioned on ends of the one or more crossbars 102, where the support brackets 108 may be used to connect the crossbars 102 to vertical uprights 10 of a consumer product display 2.

Figure 3:
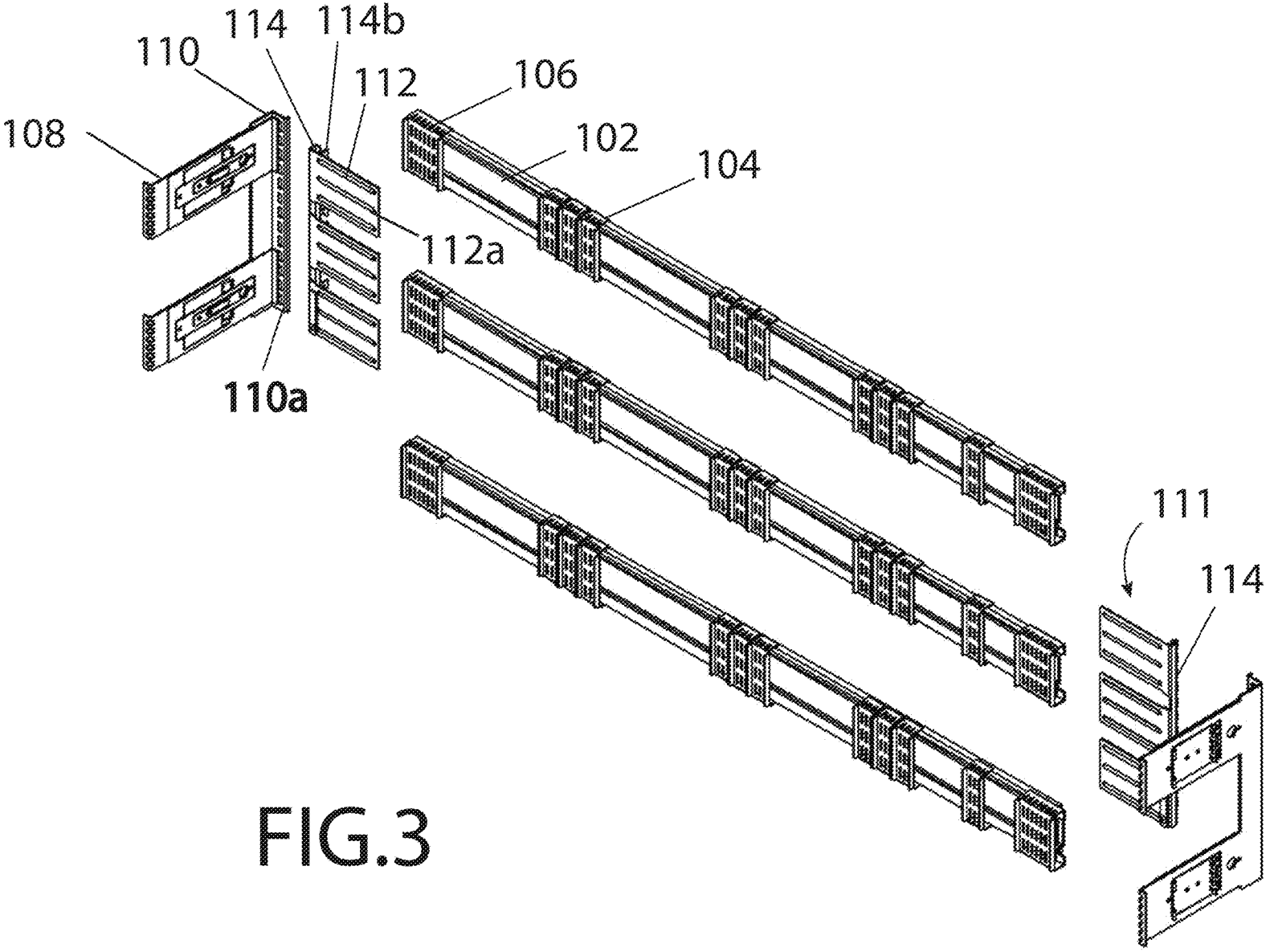
FIG. 3 illustrates an exploded view of the mounting system of FIG. 2, in accordance with an example embodiment.

FIG. 3 illustrates an exploded view of the mounting system 100 of FIG. 2, in accordance with an example embodiment. In particular, end insertable-brackets 112 may also be positioned on ends of the crossbars 102, where the insertable brackets 112 may be connected via a vertical connector 114. The insertable brackets 112 may also include ribs 112*a* on a front and/or rear surface of the bracket 112 (also see FIG. 5B). An engaging structure, such as a series of teeth 114*b*, may be included on a rear surface of the connector 114. The teeth 114*b* may be used to engage vertical slots 110*a* on a vertical corner plate 110, where the corner plate 110 may be used to connect more than one support bracket 108 to each other. The combination of the support brackets 108 and insertable brackets 112 may be considered an end bracket assembly 111.

While the configuration of FIG. 3 shows a mounting system 100 that is modularized, with multiple crossbars 102 connected together, and an end bracket assembly 111 with multiple support brackets 108 to support the crossbars 102, it should be understood that the system 100 may instead include a single crossbar 102 that may be supported by only a single support bracket 108 on either side of the crossbar 102. Furthermore, other system 100 configurations may include combinations where two crossbars 102, or more than four crossbars 102, are included within one modularized system 100. A number of support brackets 108 for each end bracket assembly 111 may also be adjusted, depending on the number of crossbars 102 that the end assemblies 111 are being used to support.

Figure 4B:
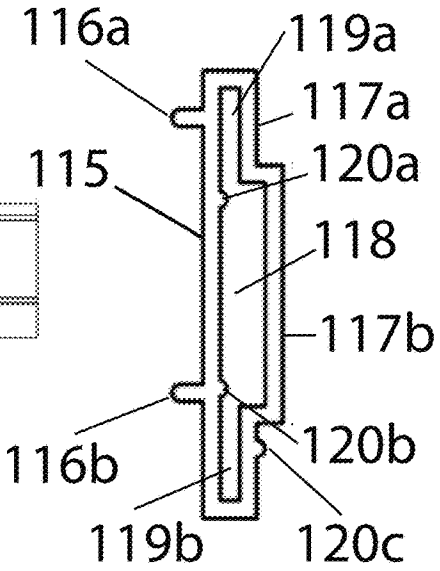
FIG. 4B illustrates a cross-sectional view of the horizontal crossbar of FIG. 4A, in accordance with an example embodiment.
Figure 4A:
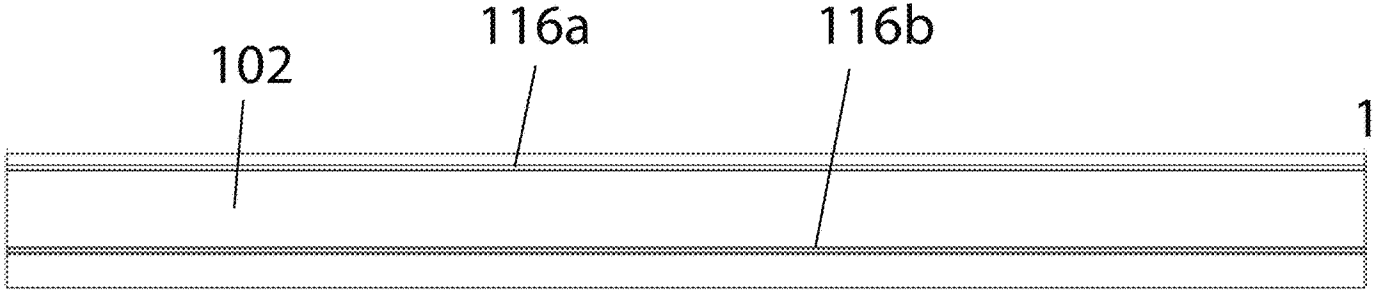
FIG. 4A illustrates a front view of a horizontal crossbar of a mounting system, in accordance with an example embodiment.

FIG. 4A illustrates a front view of a horizontal crossbar 102 of a mounting system 100, in accordance with an example embodiment. The front surface 115 (see FIG. 4B) of the crossbar 102 may include ridges, where there may be an upper ridge 116*a* near an upper section of the crossbar 102, and a lower ridge 116*b* during a lower portion of the crossbar 102.

Due to the flexibility of the mounting system 100, lengths of the crossbars 102 may vary, in order to accommodate installation of the mounting system 100 on a wide variety of consumer product displays 2. For instance, the crossbar lengths may be, just as an example, about 21.25 inches, 33.00 inches, or 44.50 inches long, in order to accommodate a wide variation in consumer product display 2 sizes. Each of the crossbar 102 lengths may be easily interchanged with a same end bracket assembly 111 in order to maximize the flexibility of the overall mounting system 100.

FIG. 4B illustrates a cross-sectional view of the horizontal crossbar 102 of FIG. 4A, in accordance with an example embodiment. As shown in the cross-section, the back surface 117*a* of the crossbar 102 may include a wide, raised ridge 117*b*. The back surface 117*a* may also define a narrow lower ridge 120*c*, where the raised ridge 117*b* may be relatively wider than the lower ridge 120*c*.

The crossbar 102 may be hollow. Or alternatively, at least the distal ends of the crossbar may be hollow. In particular, the end of the crossbar may define a cavity, where the ends may define a major cavity 118. The upper and lower ends of the crossbar 102 may also define an upper cavity 119*a* and a lower cavity 119*b* that may bracket the major cavity 118. The inner front-surface 115 of the crossbar 102 may also define an interior upper ridge 120*a* and an interior lower ridge 120*b*.

Figure 5A:
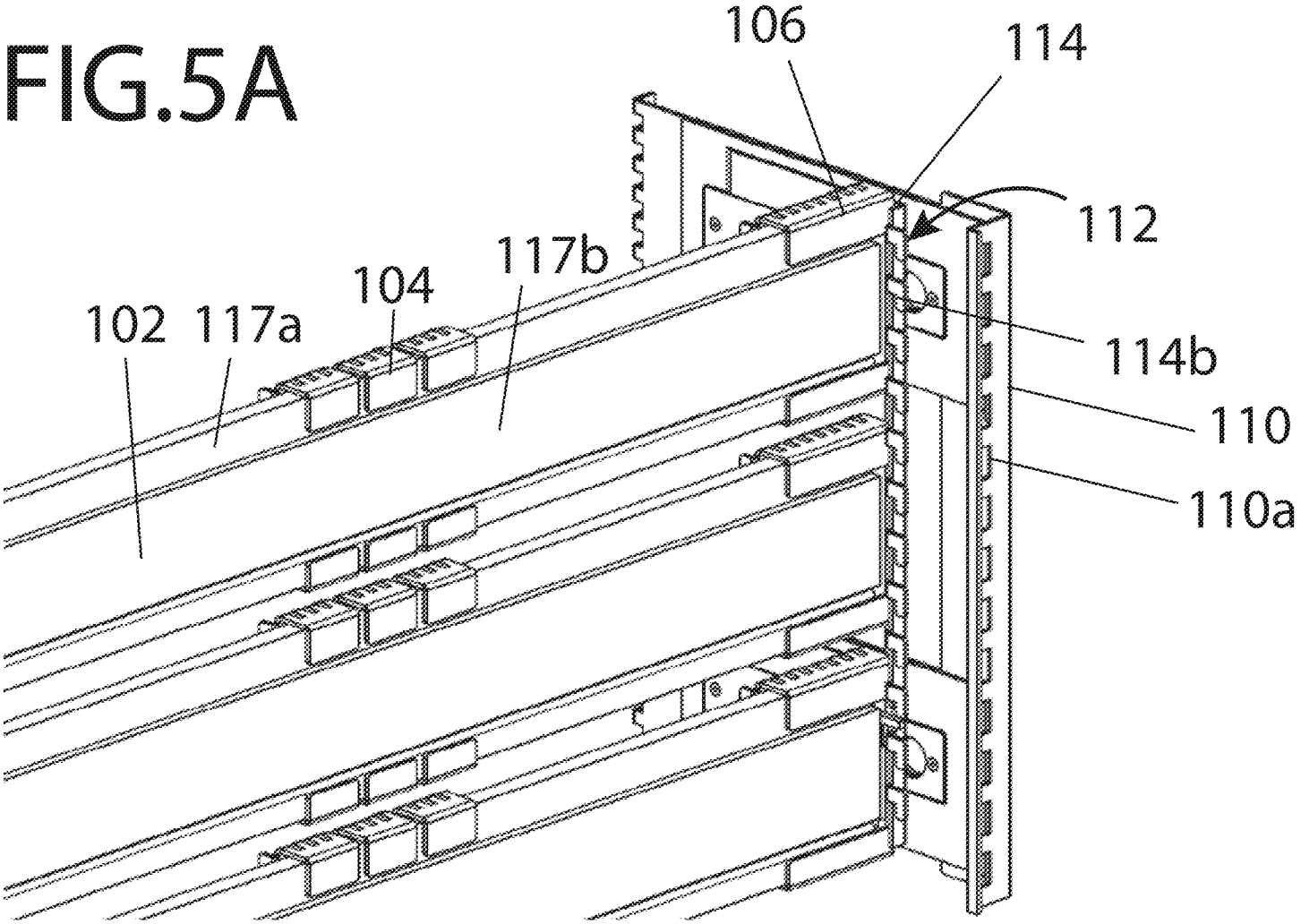
FIG. 5A illustrates a rear view of the mounting system of FIG. 2, in accordance with an example embodiment.

FIG. 5A illustrates a rear view of the mounting system 100 of FIG. 2, in accordance with an example embodiment. Specifically, FIG. 5A depicts the teeth 114*b* of the vertical connector 114 prior to the teeth 114*b* being inserted into vertical slots 110*a* of the corner plate 110. Notice that in this configuration, the end bracket assembly 111 (shown in FIG. 5B) has been inserted into ends of the crossbars 102.

Figure 5B:
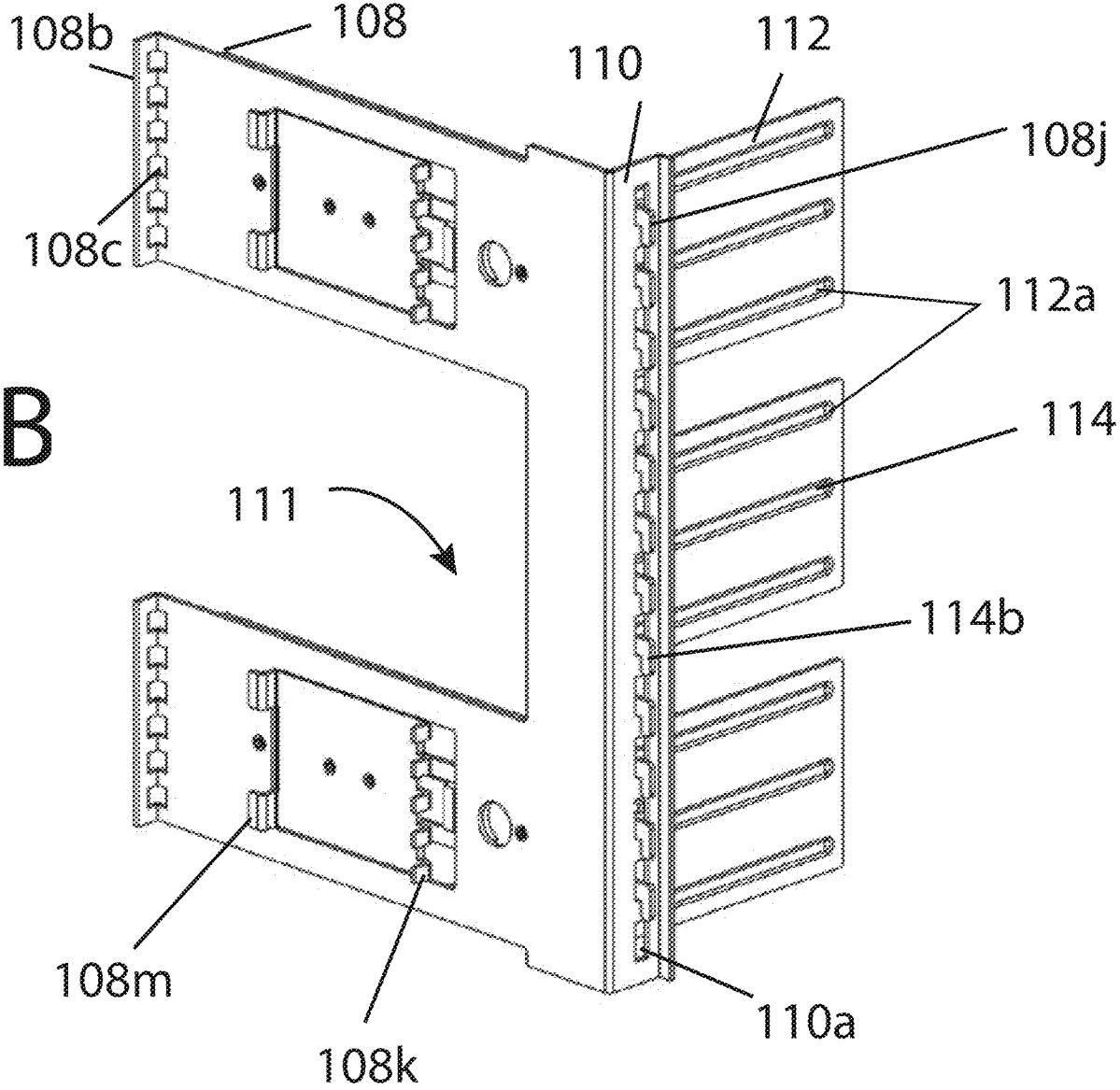
FIG. 5B illustrates a view of the side support bracket and associated insertable bracket of the mounting system of FIG. 2, in accordance with an example embodiment.

FIG. 5B illustrates a view of an end bracket assembly 111, that includes the side support brackets 108 and associated insertable brackets 112 of the mounting system 100 of FIG. 2, in accordance with an example embodiment. From this vantage point, engaging structure is shown on a rear side of the support brackets 108. For instance, the brackets 108 may include a set of rear teeth 108*k* and a pair of center brackets 108*m*. The support brackets 108 may also include a front surface 108*b* that may define horizontal front slots 108*c* (seen in better detail in FIG. 11).

Figure 5C:
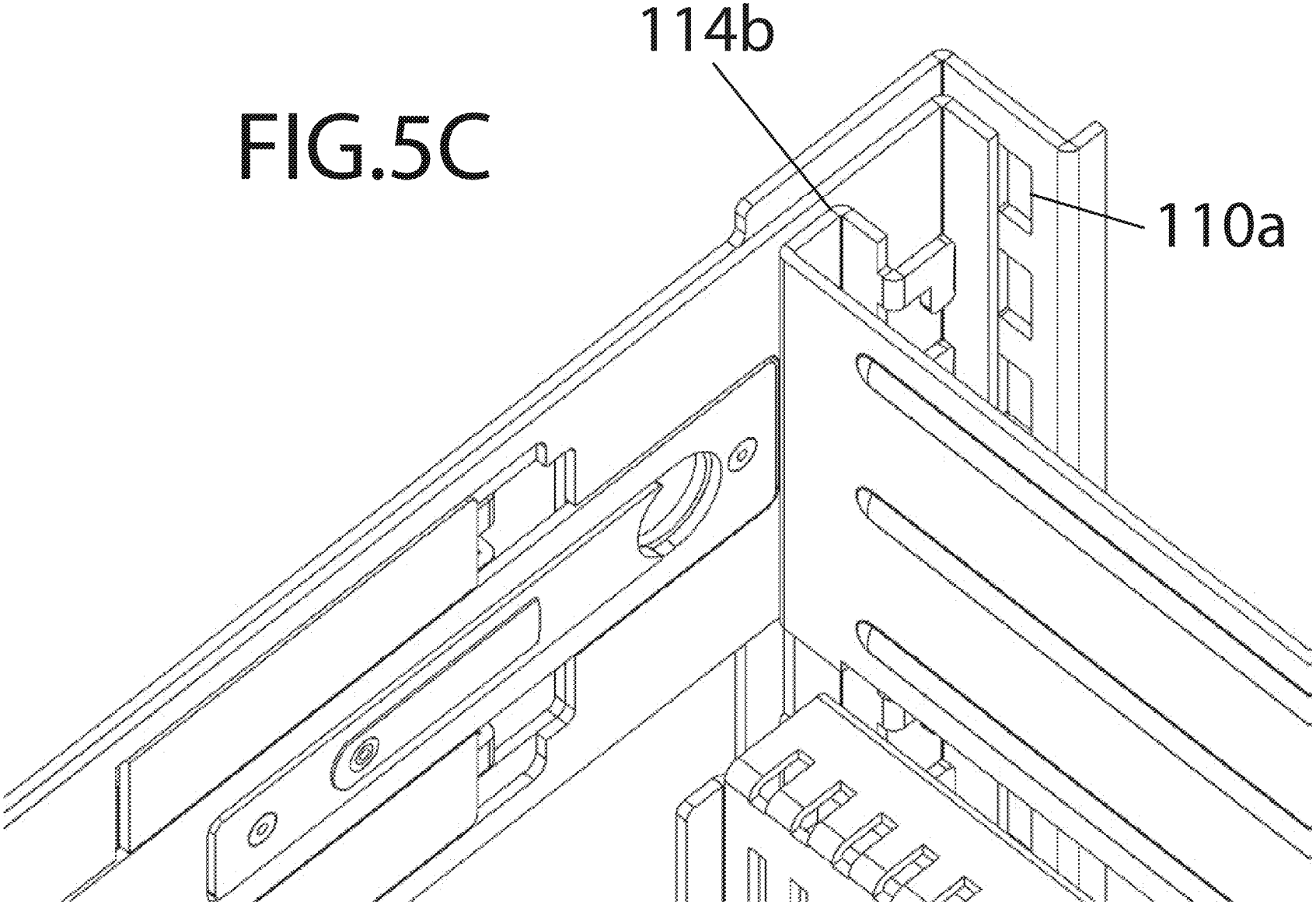
FIG. 5C illustrates a magnified view of the teeth of the vertical connector being installed in the vertical slots of the mounting system of FIG. 2, in accordance with an example embodiment.

FIG. 5C illustrates a magnified view of the teeth 114*b* of the vertical connector 114 being installed in the vertical slots 110*a* of the vertical corner plate 110 mounting system 100 of FIG. 2, in accordance with an example embodiment.

Figure 6C:
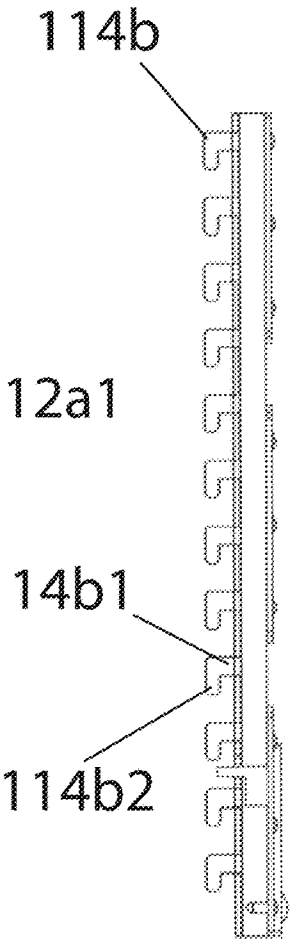
FIG. 6C illustrates a side-view of the vertical connector of the mounting system of FIG. 2, in accordance with an example embodiment.
Figure 6B:
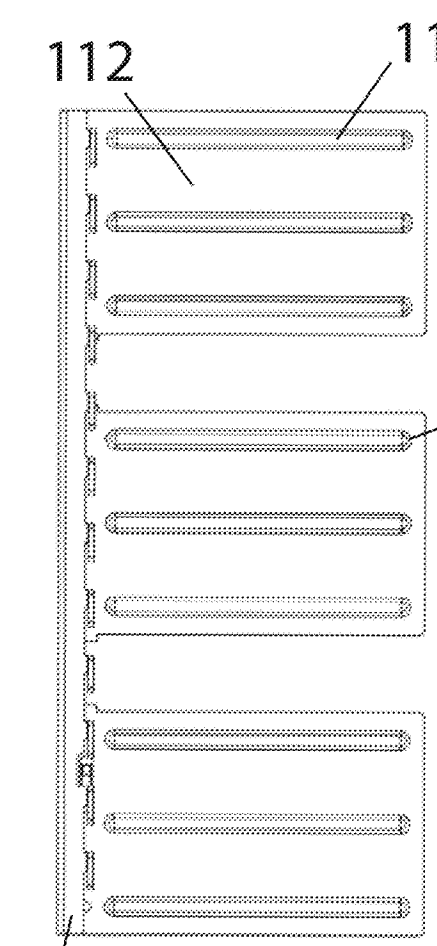
FIG. 6B illustrates a side-view of the insertable bracket of the mounting system of FIG. 2, in accordance with an example embodiment.
Figure 6A:
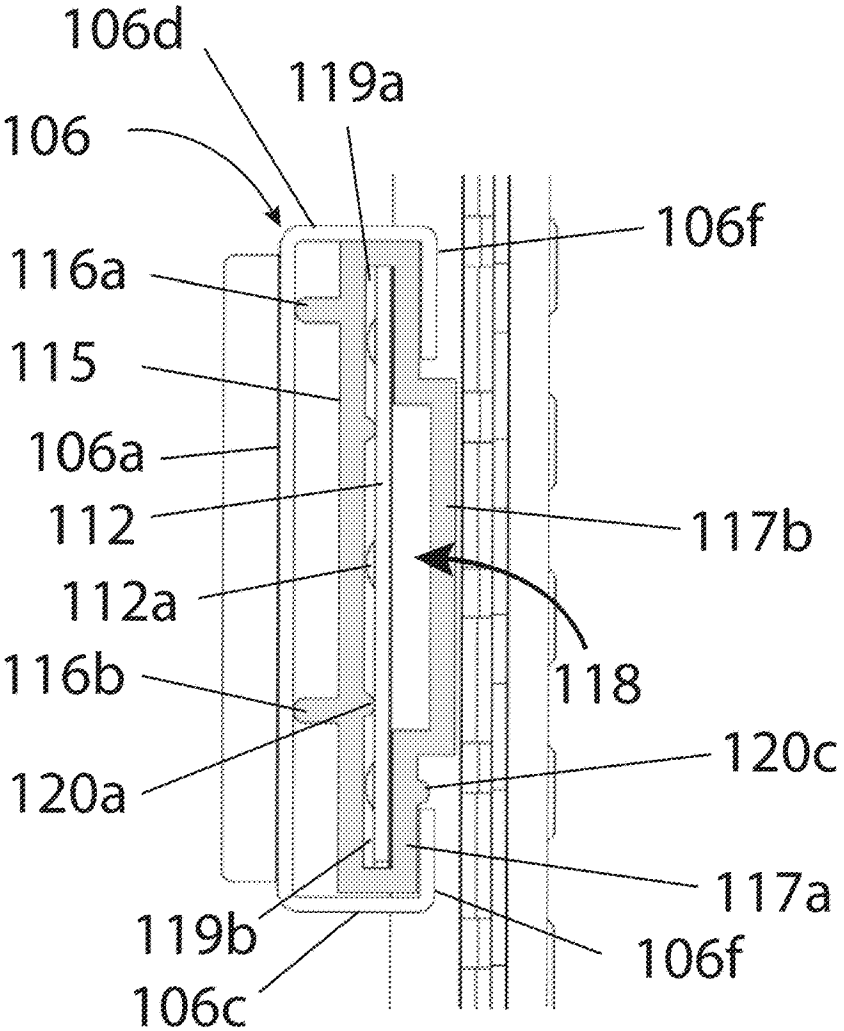
FIG. 6A illustrates a crops-sectional view of the insertable bracket within an end of the horizontal crossbar of the mounting system of FIG. 2, in accordance with an example embodiment.

FIG. 6A illustrates a cross-sectional view of the insertable bracket 112 within an end of the horizontal crossbar 102 of the mounting system 100 of FIG. 2, in accordance with an example embodiment. In this view, it can be seen that the contours of the insertable brackets 112 and the cavities 118/119*a*/119*b* of the crossbar 102 may be conformed to each other, in order to help the ends of the crossbar 102 retain the insertable brackets 112. For instance, ribs 112*a* of the insertable brackets 112 may be spaced apart, and in-between, the ridges 120*a/b* on an internal surface of the front surface 115 of the crossbar 102, so that the insertable brackets 112 may be retained in the ends of the crossbar 102 via friction. While not shown in this image, in an alternative embodiment additional ribs 112*a* may be include on a rear surface of the insertable brackets 112, where the ribs 112*a* may conform to an interior area of the raised ridge 117*b* within the cavity 118 of the crossbar 102, for a further snug fit.

This cross-sectional view also depicts a horizontally-slideable bracket 106 on the crossbar 102. In particular, it can be seen that rear flanges 106*f* of the bracket 106 may hold the slideable bracket 106 on the crossbar 102, where the lower ridge 120*c* and raised ridge 117*b* does not interfere with the flanges 106*f* as the slideable bracket 106 may slide along a longitudinal length of the crossbar 102. The depth of the bottom plate 106*e* and the top plate 106*d* of the slideable bracket 106 may also be deep enough to allow a front surface 106*a* of the bracket 106 to clear the ridges 116*a/b* on the front surface 115 of the crossbar 102. It is noted that, due to the existence of the front ridges 116*a/b* of the crossbar 102, the slideable bracket 106 will slide more easily along the length of the crossbar with less frictional resistance.

FIG. 6B illustrates a side-view of the insertable brackets 112 of the mounting system 100 of FIG. 2, in accordance with an example embodiment. This view, in conjunction with FIG. 6A, depicts the rounded shape of the ribs 112*a* that may exist on at least one surface of the insertable brackets 112. The ribs 112*a* not only have a rounded top-surface (as shown in the cross-section of FIG. 6A), but the distal ends 112*a*1 of the ribs 112*a* may also be rounded. The rounded profile of the ribs 112*a* helps assist the insertable brackets 112 in entering and being withdrawn from the crossbar 102.

FIG. 6C illustrates a side-view of the vertical connector 114 of the mounting system of FIG. 2, in accordance with an example embodiment. In this view, it can be seen that the teeth 114*b* may have a vertical extension 114*b*2 on a distal end of a horizontal projection 114*b*1 of each of the teeth 114*b*.

Figure 7A:
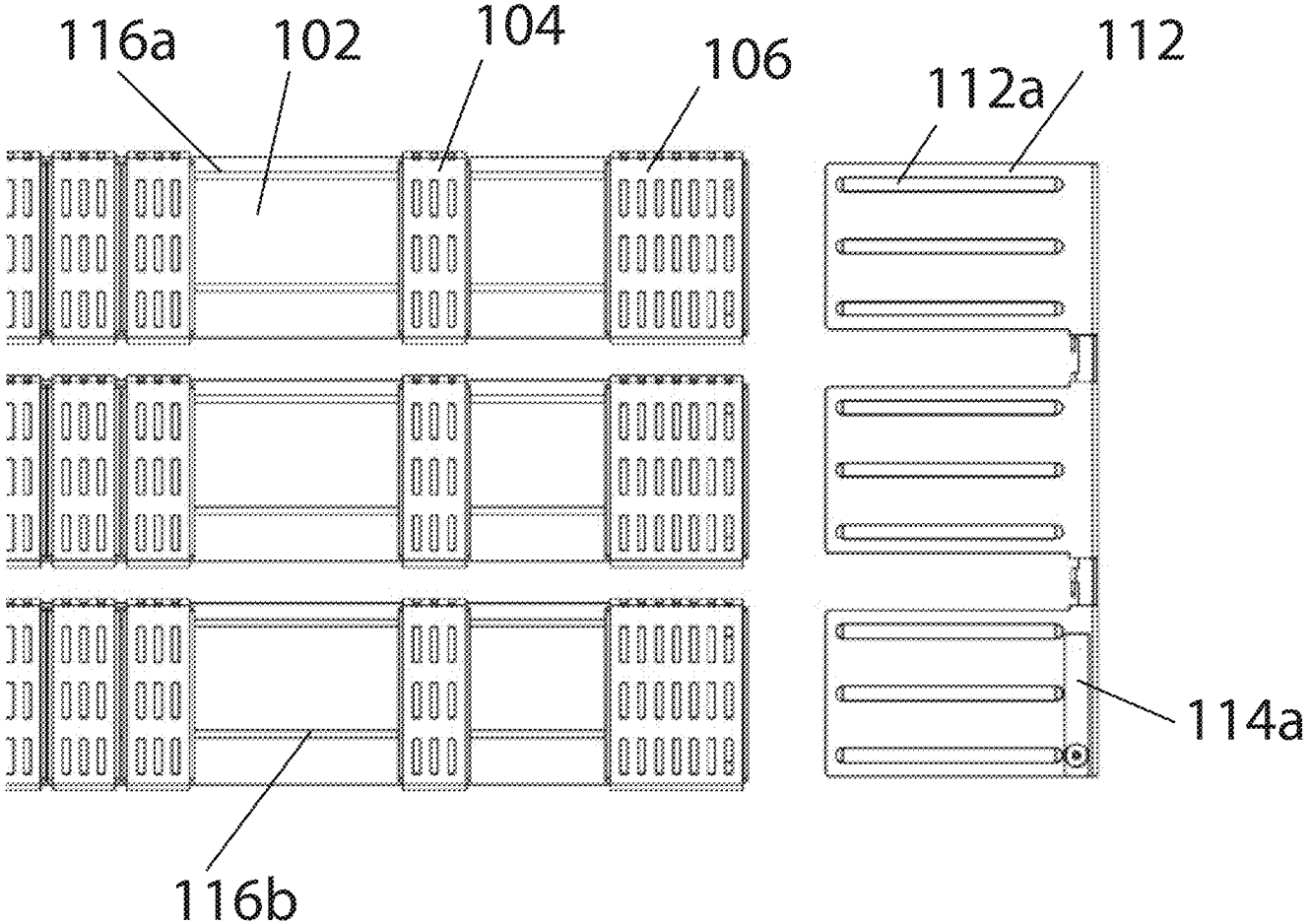
FIG. 7A illustrates a front-view of a group of horizontal crossbars, with horizontally-slideable brackets on the crossbars, and an associated group of insertable brackets of a mounting system, in accordance with an example embodiment.

FIG. 7A illustrates a front-view of a group of horizontal crossbars 102, with horizontally-slideable brackets 104/106 on the crossbars 102, and an associated group of insertable brackets 112 of a mounting system 100, in accordance with an example embodiment. In this view, a side locking clip 114*a* on a front surface of one of the insertable brackets 112 is shown. The function of this locking clip 114*a* is better shown in FIG. 19A/B. Namely, the locking clip 114*a* may be used to more stably lock the insertable brackets 112 into a fixed horizontal position within the end of the crossbar 102, especially in cases where extra width of the crossbar 102 is required, necessitating the insertable brackets 112 to remain somewhat withdrawn from the ends of the crossbar 102 following installation of the mounting system on a consumer product display 2.

Figure 7B:
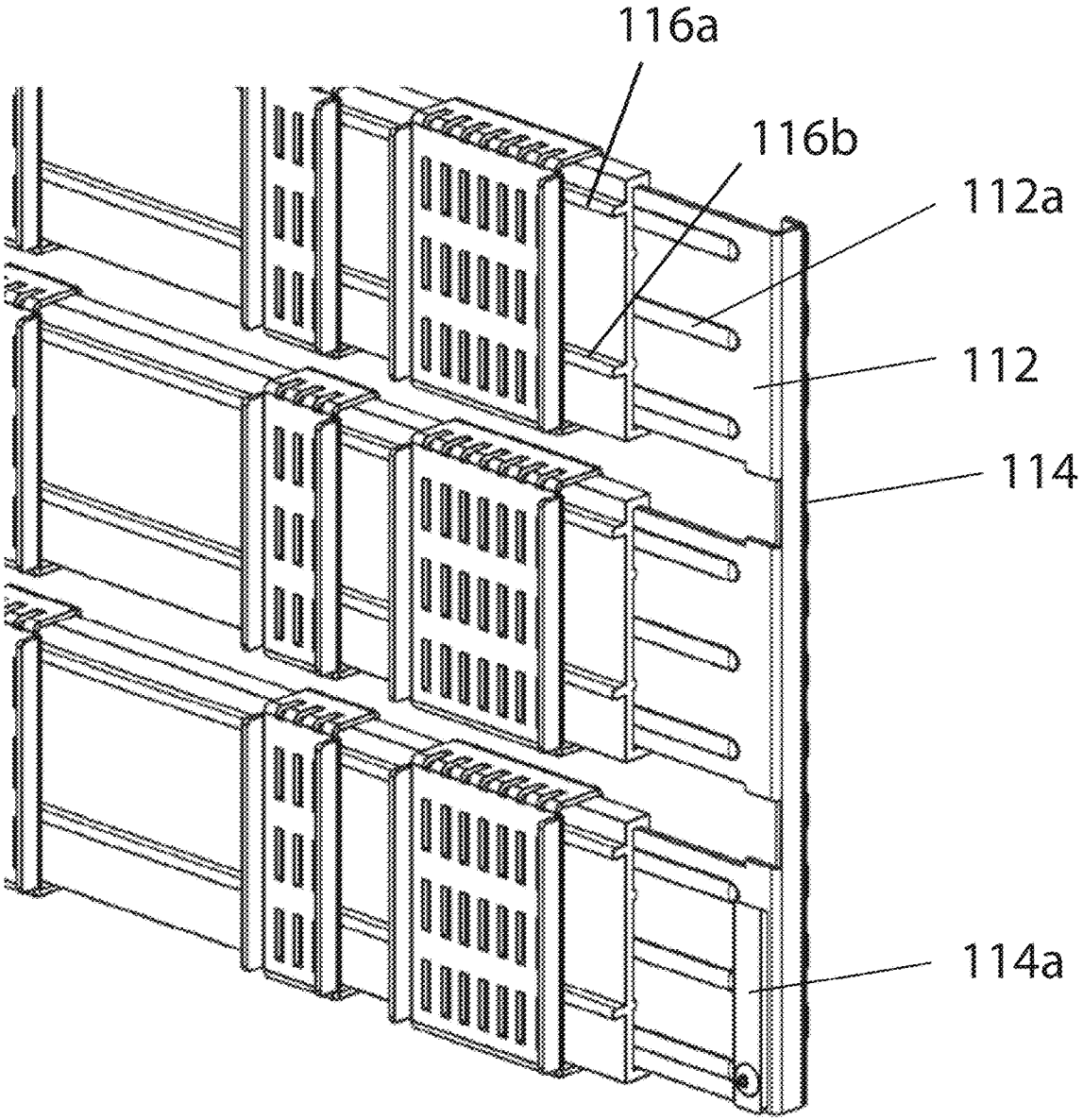
FIG. 7B illustrates a perspective-view of group of insertable brackets being inserted into ends of the group of horizontal crossbars of FIG. 7A, in accordance with an example embodiment.

FIG. 7B illustrates a perspective-view of group of insertable brackets 112 being inserted into ends of the group of horizontal crossbars 102 of FIG. 7A, in accordance with an example embodiment. It should be understood that, due to a length of the insertable brackets 112, the existence of the insertable brackets 112 may provide a range of length-wise tolerances for the ultimate width of the crossbar 102, once the mounting system 100 is installed in a consumer product display 2. Said another way, the insertable brackets 112 may allow the effective length of the crossbar 102 to vary somewhat, in order to account for a range of desired crossbar 102 lengths that may be needed during field-installation of the mounting system 100 in order to accommodate a range of sizes of consumer product displays 2.

Figure 8B:
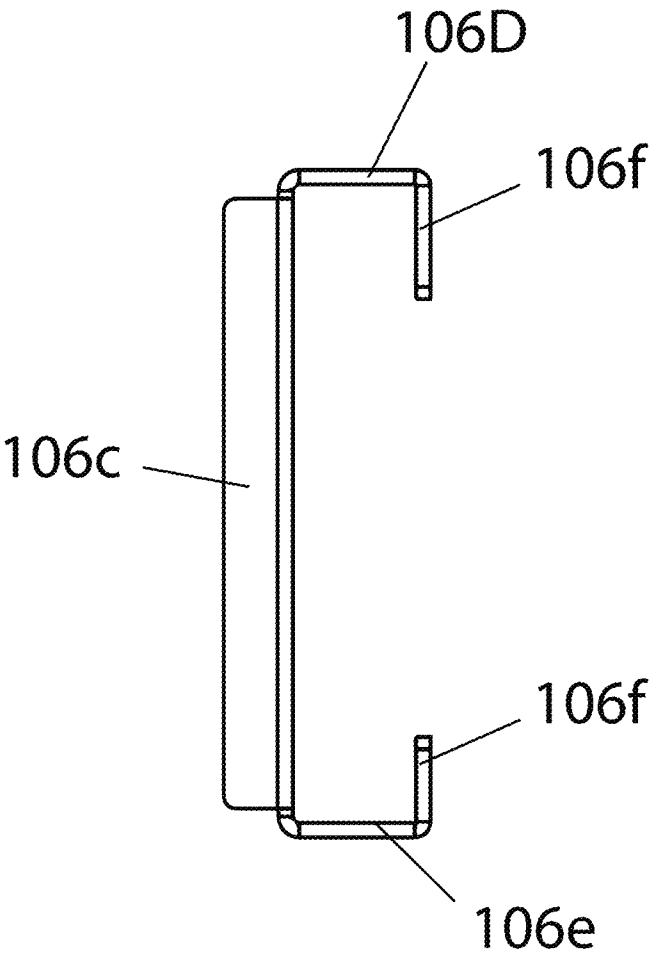
FIG. 8B illustrates a side-view of the horizontally-slideable bracket of FIG. 8A, in accordance with an example embodiment.
Figure 8A:
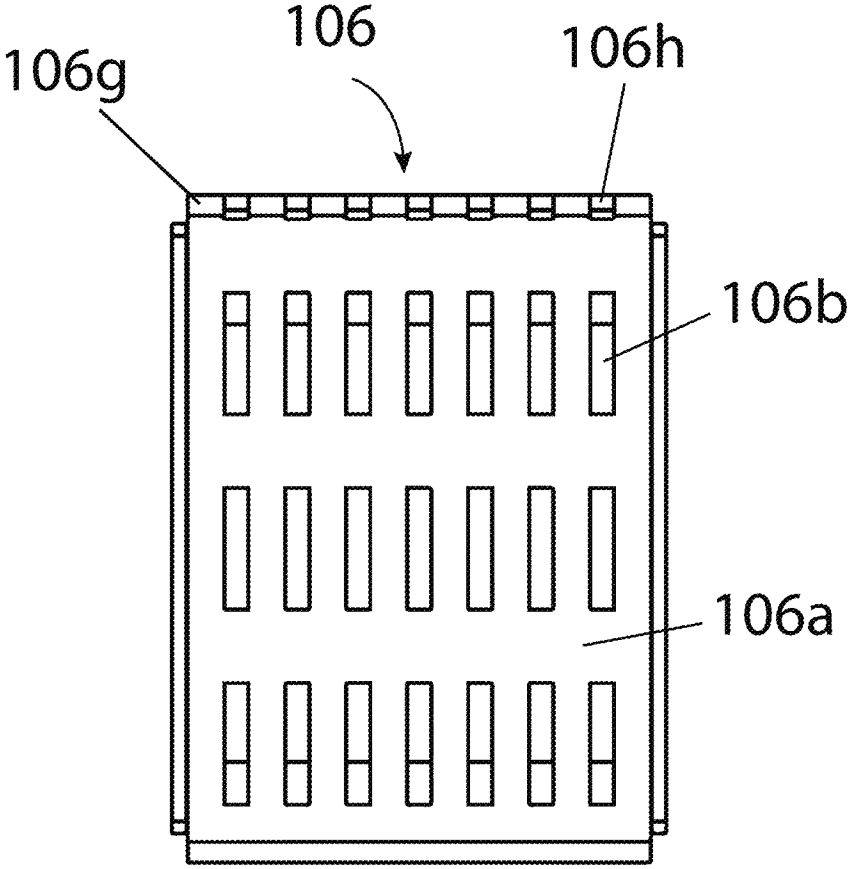
FIG. 8A illustrates a front-view of a horizontally-slideable bracket, in accordance with an example embodiment.

FIG. 8A illustrates a front-view of a horizontally-slideable bracket 106, in accordance with an example embodiment. In this view, it can be shown that a number of upper horizontal slots 106*h* (shown best in FIG. 8C) may invade on rounded front/upper corner 106*g* of the bracket 106. The front surface 106*a* of the bracket 106 may also define a number of vertical slots 106*b* at different elevations on the front of the bracket 106.

FIG. 8B illustrates a side-view of the horizontally-slideable bracket 106 of FIG. 8A, in accordance with an example embodiment. In this view, side flanges 106*c* can be shown emanating from a front surface 106*a* of the bracket (also see FIG. 8C).

Figure 8C:
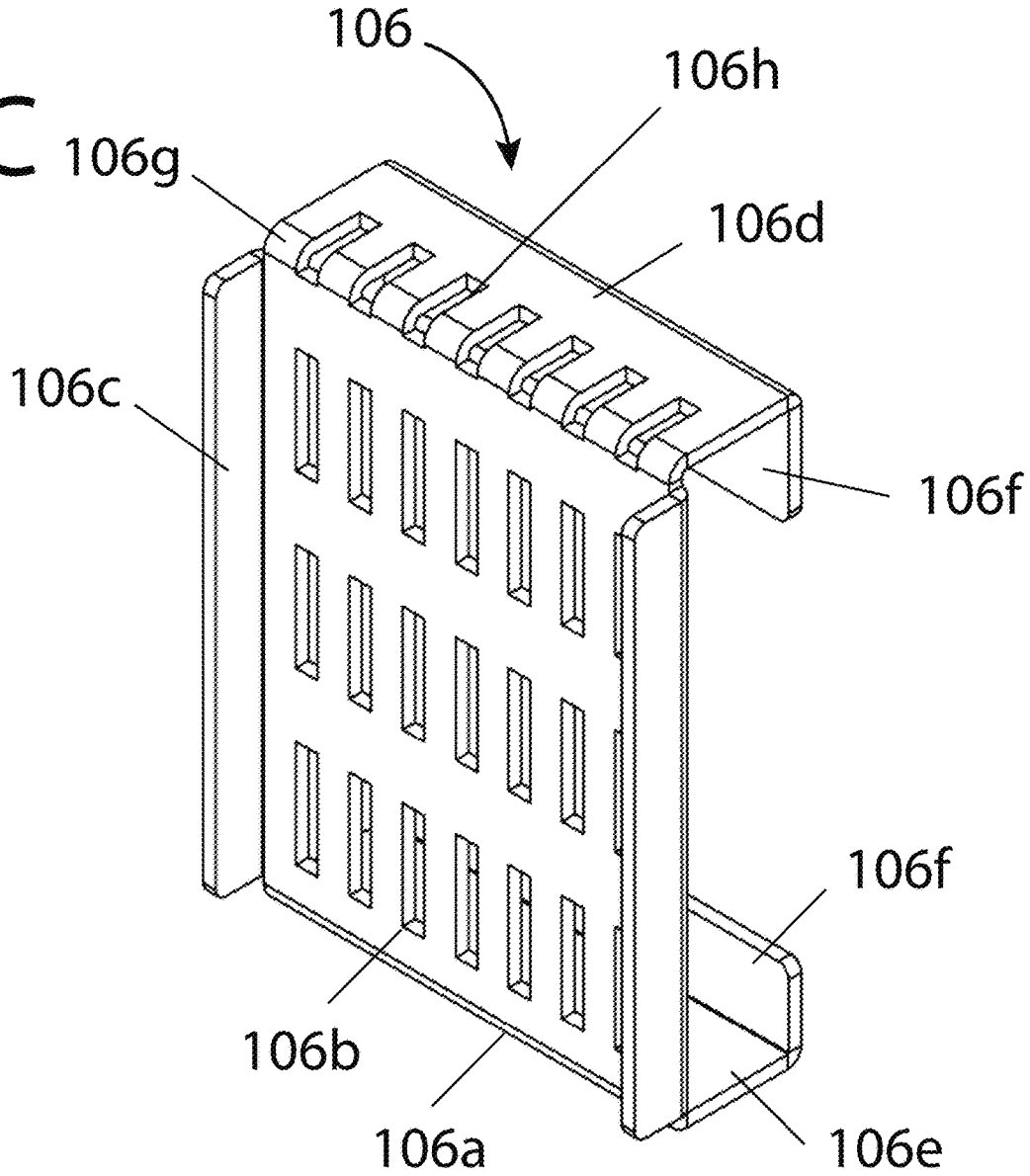
FIG. 8C is a perspective-view of the horizontally-slideable bracket of FIG. 8A, in accordance with an example embodiment.

FIG. 8C is a perspective-view of the horizontally-slideable bracket 106 of FIG. 8A, in accordance with an example embodiment. In this view, it can more easily be seen that the upper horizontal slots 106*h* may invade on the rounded front/upper corners 106*g* of the bracket 106.

Figure 9C:
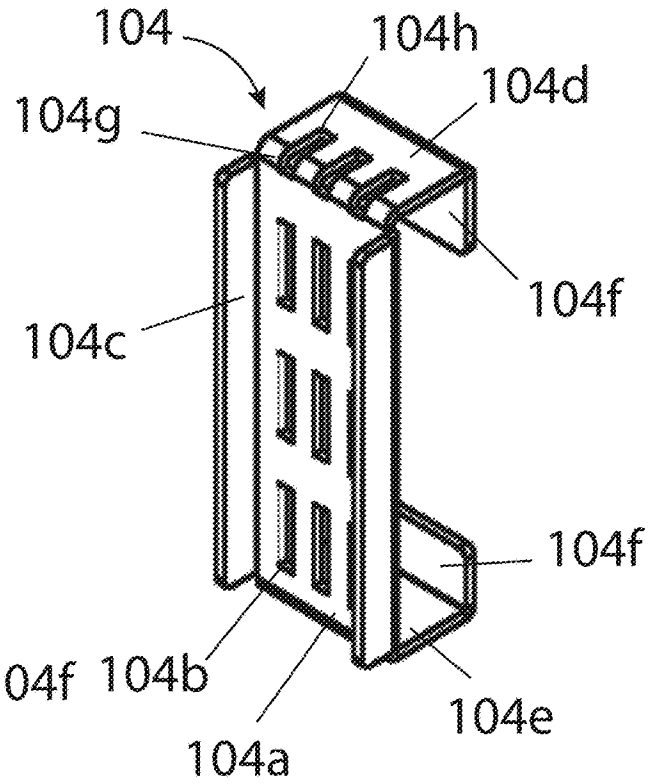
FIG. 9C is a perspective-view of the horizontally-slideable bracket of FIG. 9A, in accordance with an example embodiment.
Figure 9B:
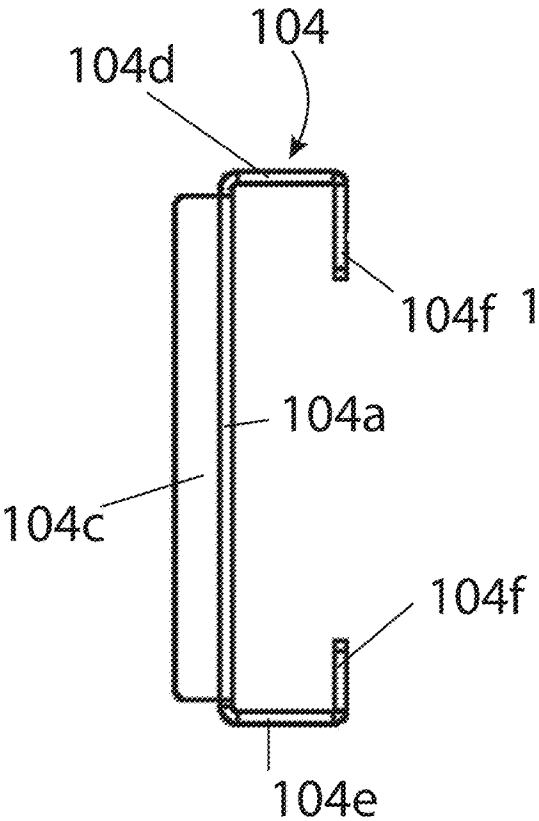
FIG. 9B illustrates a side-view of the horizontally-slideable bracket of FIG. 9A, in accordance with an example embodiment.
Figure 9A:
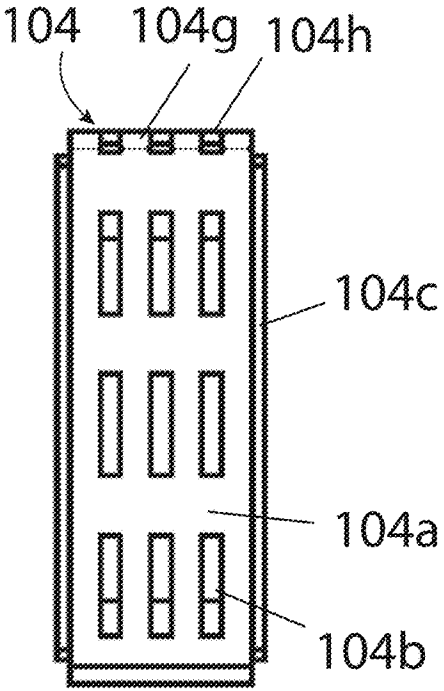
FIG. 9A illustrates a front-view of another horizontally-slideable bracket, in accordance with an example embodiment.

FIG. 9A illustrates a front-view of another horizontally-slideable bracket 104, in accordance with an example embodiment. This bracket 104 configuration may be similar to the bracket 106 of FIG. 8C, although this bracket 104 may be a different (smaller) width as compared to bracket 106. As shown in FIG. 9A, upper horizontal slots 104*h* may be positioned closer to a front surface 104*a* of the bracket 104, where the horizontal slots 104*h* may invade on the rounded top corner edge 104*g* of the bracket (shown in better detail in FIG. 9C).

FIG. 9B illustrates a side-view of the horizontally-slideable bracket 104 of FIG. 9A, in accordance with an example embodiment. Side flanges 104*c* may be positioned on front sides of the bracket 104 (seen in better detail in FIG. 9C), and rear flanges 104*f* may be connected to the top plate 104*d* and the bottom plate 104*e* of the bracket 104.

FIG. 9C is a perspective-view of the horizontally-slideable bracket 104 of FIG. 9A, in accordance with an example embodiment. As shown in this view, the upper horizontal slots 104*h* may be positioned closer to a front surface 104*a* of the bracket 104, where the slots 104*h* may invade on the rounded upper corners 104*g* of the brackets 104. Front vertical lots 104*b* may be included at different elevations on the front 104*a* of the bracket 104.

Figure 10B:
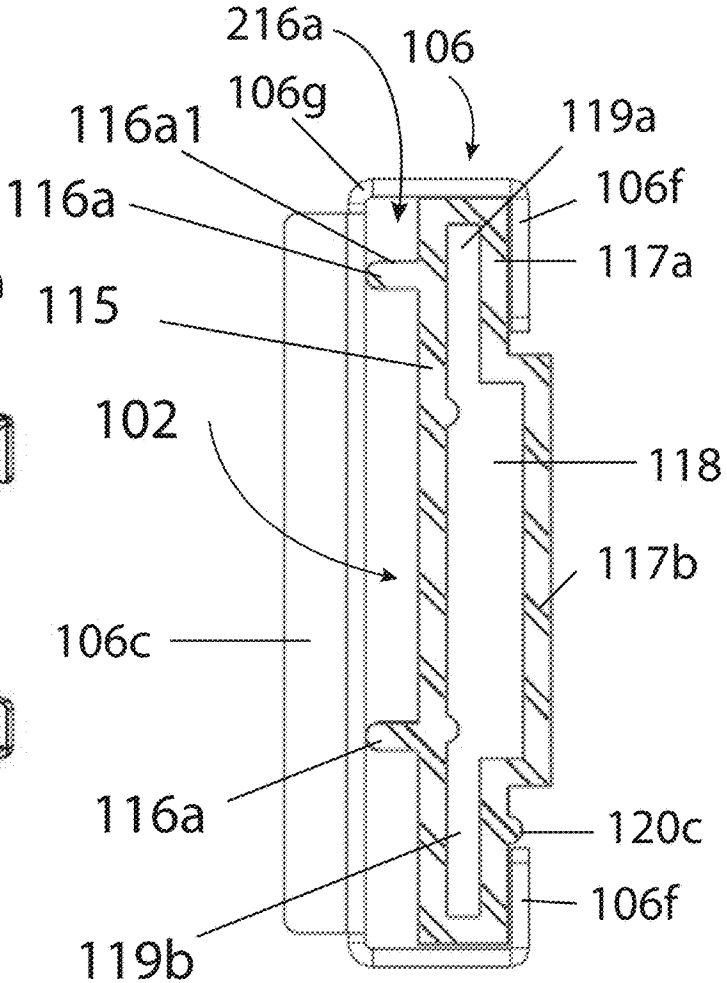
FIG. 10B illustrates a cross-sectional view of a horizontally-slideable bracket on a crossbar, in accordance with an example embodiment.
Figure 10A:
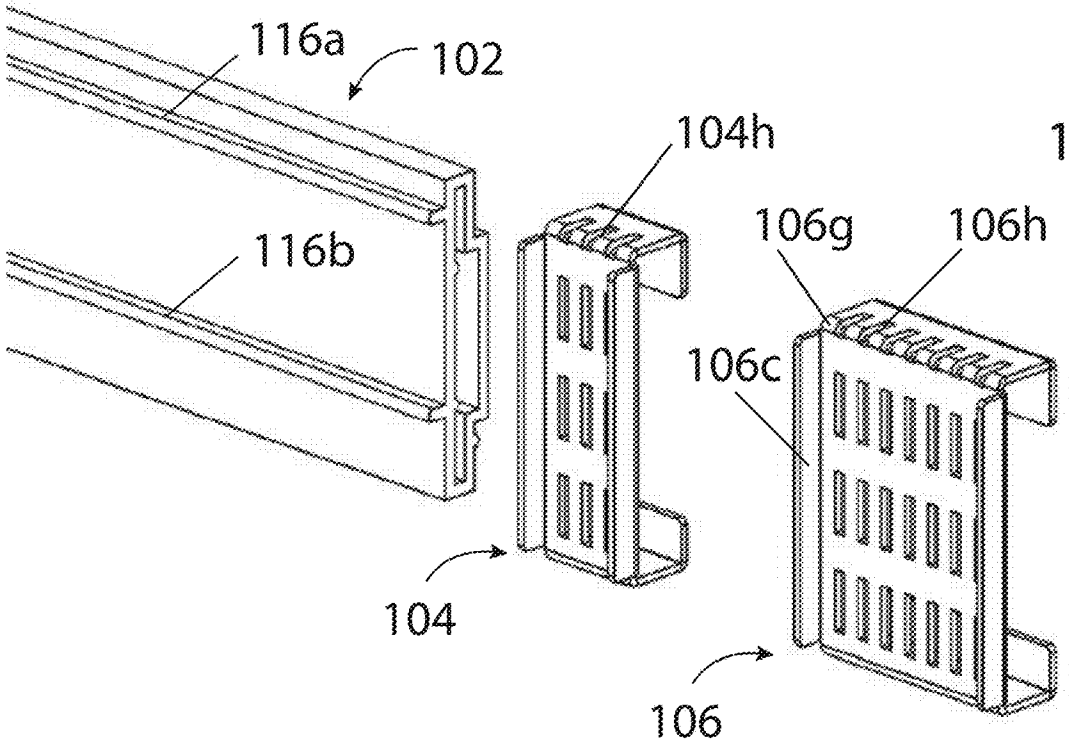
FIG. 10A illustrates a view of horizontally-slideable brackets being fitting onto a crossbar, in accordance with an example embodiment.

FIG. 10A illustrates a view of horizontally-slideable brackets 104/106 being fitting onto a crossbar 102, in accordance with an example embodiment. It should be understood that the side flanges 104*c*/106*c* of the brackets 104/106 may help guide and retain shelving brackets 212 (see at least FIG. 21A) on a front-face of the respective brackets 104/106.

Once the brackets 104/106 are on the crossbar, the upper horizontal slots 104*h*/106*h* may be positioned above the upper ridge 116*a*. As explained in more detail (below), a top-most tooth 214 of the shelving brackets 212 be fitted through the horizontal brackets 104*h*/106*h* so that a distal end (vertical projection 216, shown in FIG. 21A) of the shelving brackets 212 may contact, and be partially supported by, the upper shelf 116*a*. This may help reduce an overall strain on the slideable brackets 104/106 themselves, as the strength of the crossbar 102 may directly support some of the load of the shelves 210.

FIG. 10B illustrates a cross-sectional view of a horizontally-slideable bracket 106 on a crossbar 102, in accordance with an example embodiment. In this view, a resting place 216*a* of the vertical projection 216 (see FIG. 21A) of the shelving 210 can be seen. That is to say, a distal end of the vertical projection 216 of the bracket 212 of the shelving 210 may be held in this area 216*a*, where the distal end of the vertical projection may contact (and be partially supported by) the upper surface 116*a*1 of the upper ridge 116*a*.

Figure 11:
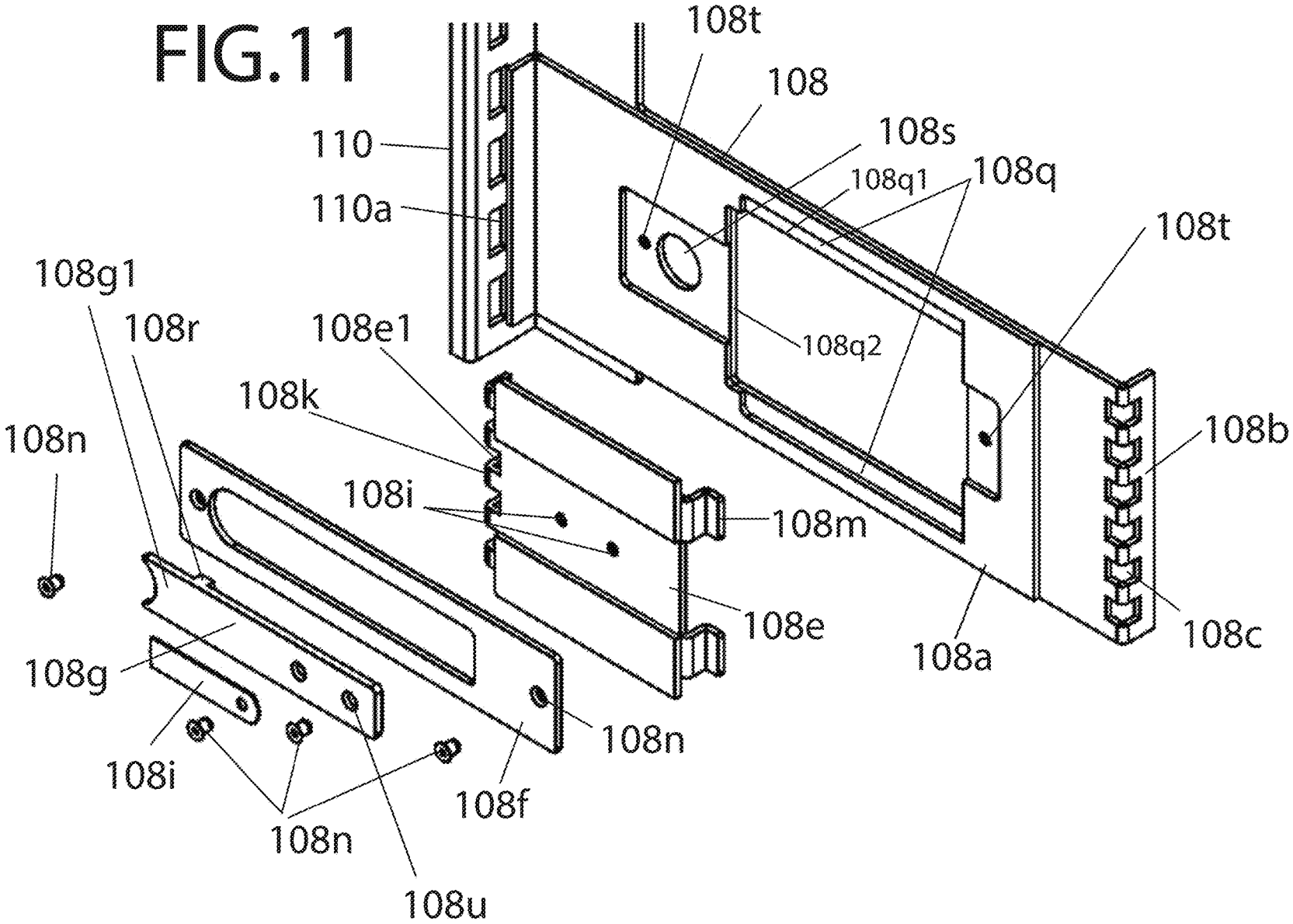
FIG. 11 illustrates an exploded-view of a support bracket, in accordance with an example embodiment.

FIG. 11 illustrates an exploded-view of a support bracket 108, in accordance with an example embodiment. The support bracket 108 may include an inner surface 108*a* that defines a recessed area 180*q*. The recessed area 108*q* may allow floating plate 108*e* to slide within a cut-out area 108*q*1 of the support bracket 108. The floating plate 108*e* may include the center brackets 108*m* and the center teeth 108*k* (also shown in FIG. 5B). A locking plate 108*f* may be positioned above the floating plate 108*e* in order to keep the floating plate 108*e* within the recessed area 108*q*. An inner locking tab 108*g* may fit within a cut-out area of the locking plate 108*f*. An outer locking plate 108*h* may be connected to the inner locking plate 108*g*. Screws 108*n* capable of mating with bolt holes 108*i*/108*u*/108*t* may hold the subcomponents of the support bracket 108 together. The locking tabs 108*g*/*h* may be made from a malleable material, and in operation (as described in more detail with regard to FIGS. 15A-C), a distal end 108*g*1 of the inner locking tab 108*g* may be pulled away from the cut-out area 108*f*1 of locking plate 108*f* (which is made easier due to the finger-hole 108*s*), in order to engage and disengage locking stub 108*r*, in order to allow the floating plate 108*e* to shift from a locked to an unlocked position in order to install the support bracket 108 on a vertical upright 10 of a consumer product display 2. The inner locking tab 108 travel with the floating plate 108*e*, and when the support bracket is in a "locked" position (as shown in FIG. 15D), the locking stub 108*r* contacts both a proximal-end 108*e*1 of the floating plate 108*e* and an edge 108*q*2 of the cut-out area 108*q*1, in order to cause the floating plate 108*e* to resist being shifted into an "unlocked" position (see the "unlocked" position of the support bracket 108, in FIG. 15C). When the distal end 108*g*1 of the inner locking tab 108*g* is pulled away from the surface 108*a* of the support bracket 108 (as shown in "unlocked" configuration of FIG. 15C), the floating plate 108*e* is therefore capable of movement within the recessed area 108*q*.

Figure 12:
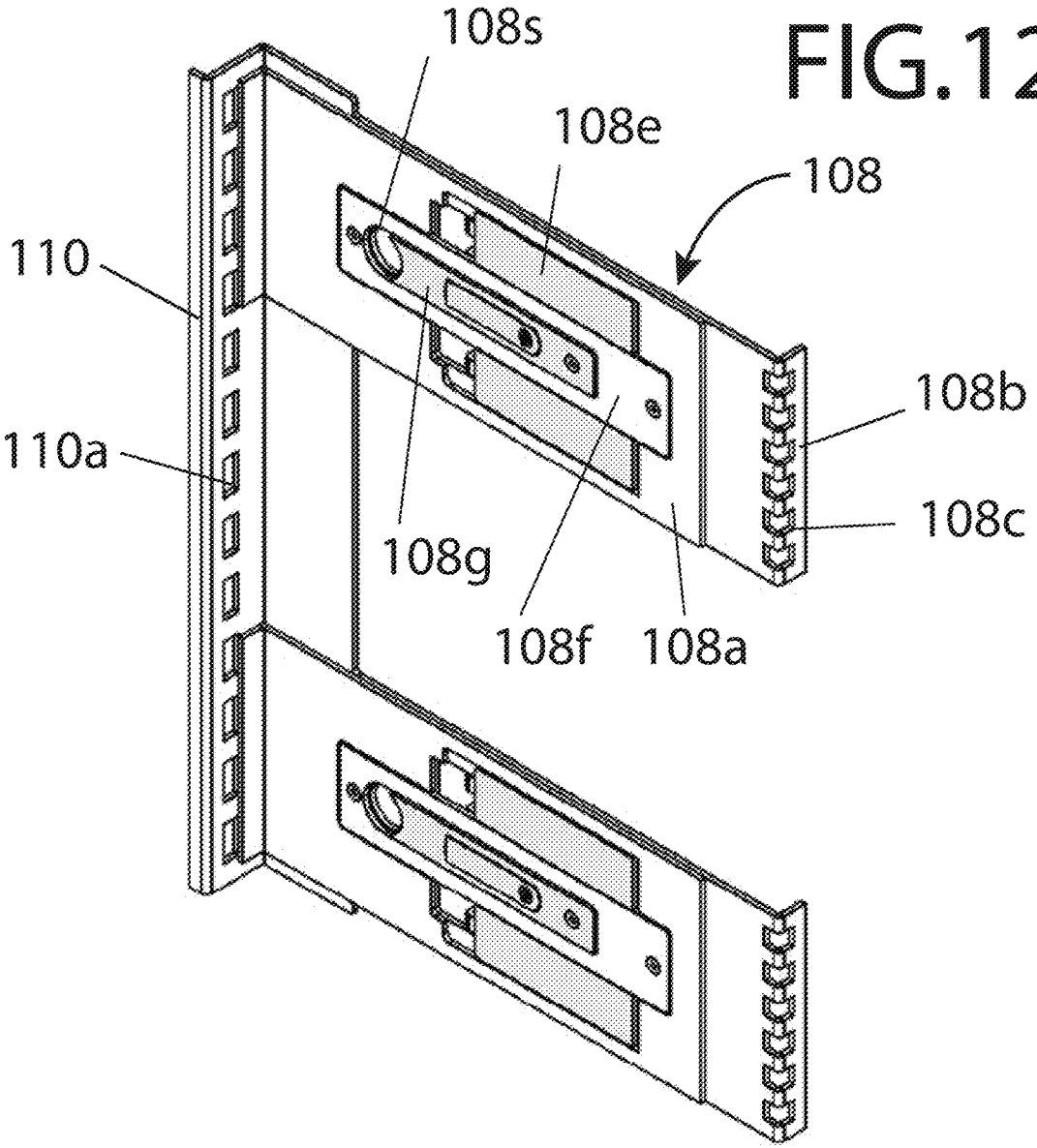
FIG. 12 illustrates a perspective-view of two assembled support brackets connected by a vertical corner plate, in accordance with an example embodiment.

FIG. 12 illustrates a perspective-view of two assembled support brackets 108 connected by a vertical corner plate 110, in accordance with an example embodiment. In this view, the floating plate 108*e* of the support brackets 108 are shifted toward the front surface 108*b* of the brackets 108, such that the support brackets 108 are in a "locked" position (corresponding to the "locked" position also shown in the cross-sectional view of FIG. 15D).

Figure 13:
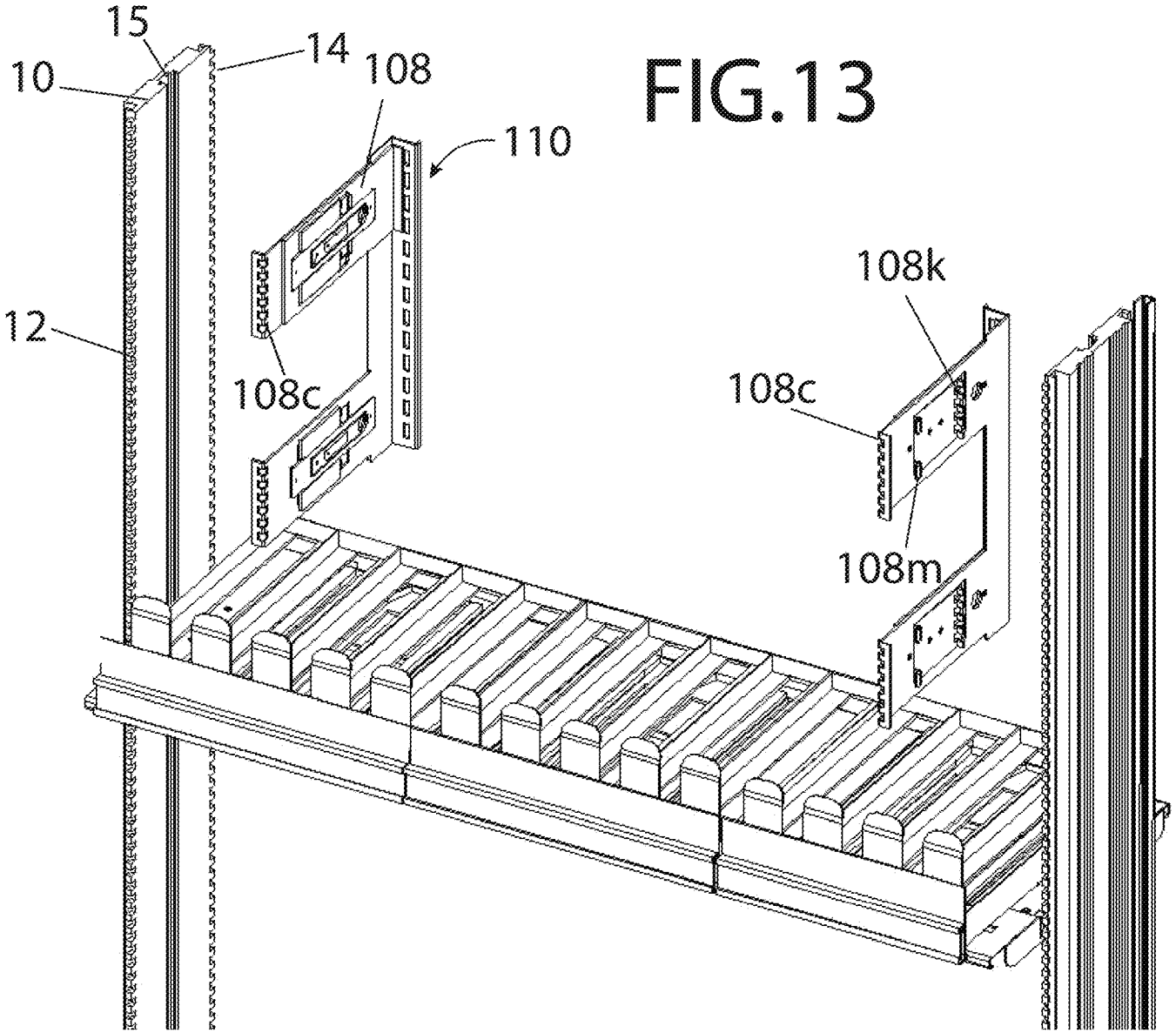
FIG. 13 illustrates a view of support brackets being fitted onto vertical uprights of a consumer product display, in accordance with an example embodiment.

FIG. 13 illustrates a view of support brackets 108 being fitted onto vertical uprights 10 of a consumer product display 2, in accordance with an example embodiment. Note that the support brackets 108 may be connected to the uprights 10 prior to the crossbars 102 then being connected to the support brackets 108 (see the crossbars 102 being connected to the support brackets 108 in at least FIG. 18), as the support brackets 108 may be used to rigidly connect the ends of the crossbars 102 to the vertical uprights 10. In order for the support brackets 108 to be affixed to the vertical uprights 10, the horizontal front slots 108*c* may engage the front teeth 12 of the upright 10 (see FIG. 14), whereas the center teeth 108*k* of the support bracket 108 may engage the rear teeth 14 of the vertical upright 10. The center brackets 108*m* of the support brackets 108 may further engage and grip an inner surface of the track 15 of the upright 10 (as shown in at least FIG. 15D) in order to lock the support bracket 108 on the upright 10.

Figure 14:
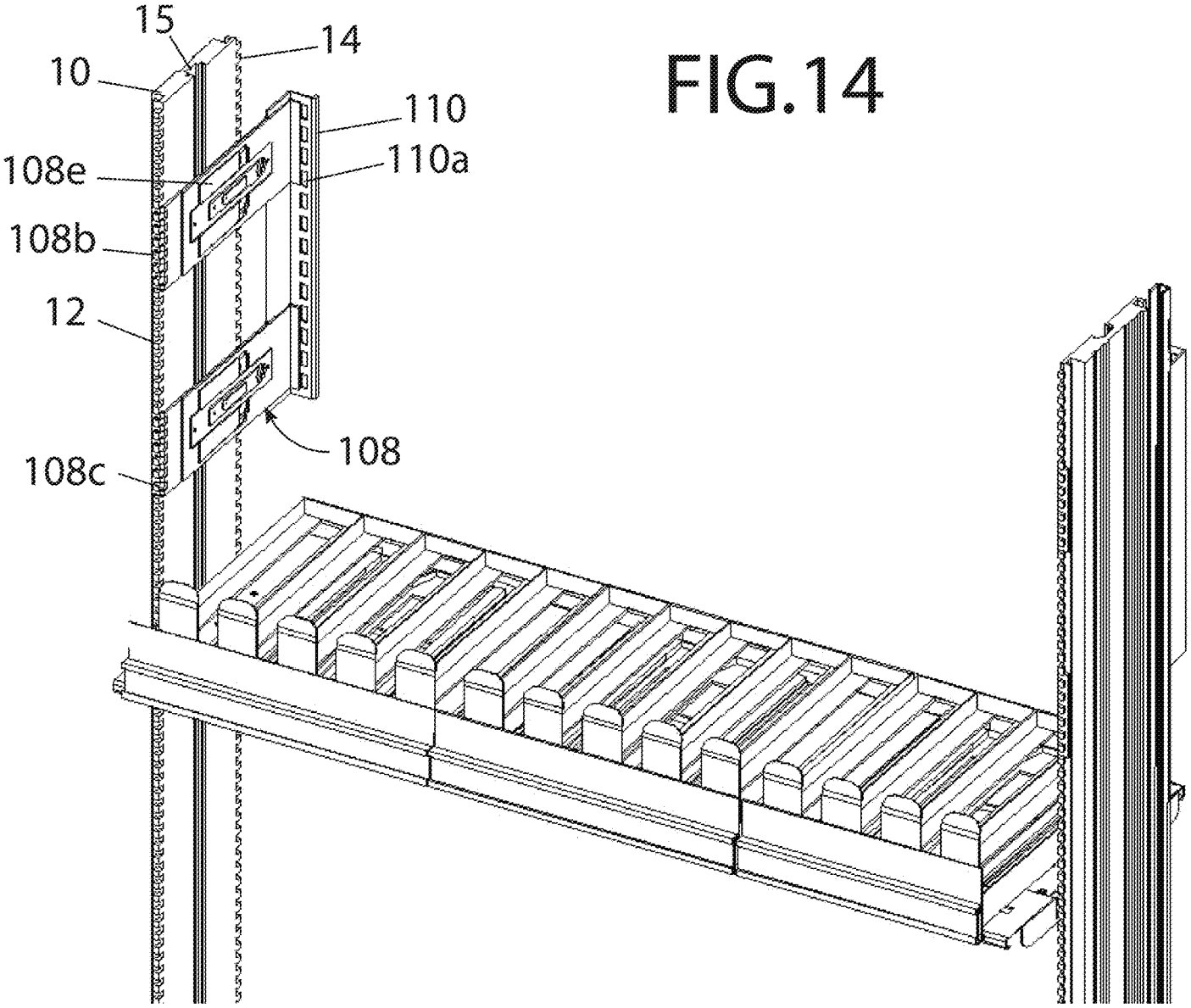
FIG. 14 illustrates another view of support brackets being fitted onto vertical uprights of a consumer product display, in accordance with an example embodiment.

FIG. 14 illustrates another view of a support bracket 108 being fitted onto a vertical upright 10 of a consumer product display 2, in accordance with an example embodiment. In this view, the floating plate 108*e* of the support bracket 108 has been shifted forward, toward the front surface 108*b* of the support bracket 108, such that the support bracket 108 is shown here in the "locked" position (corresponding to the "locked" position of the support bracket 108, shown in at least FIG. 15D).

Figure 15A:
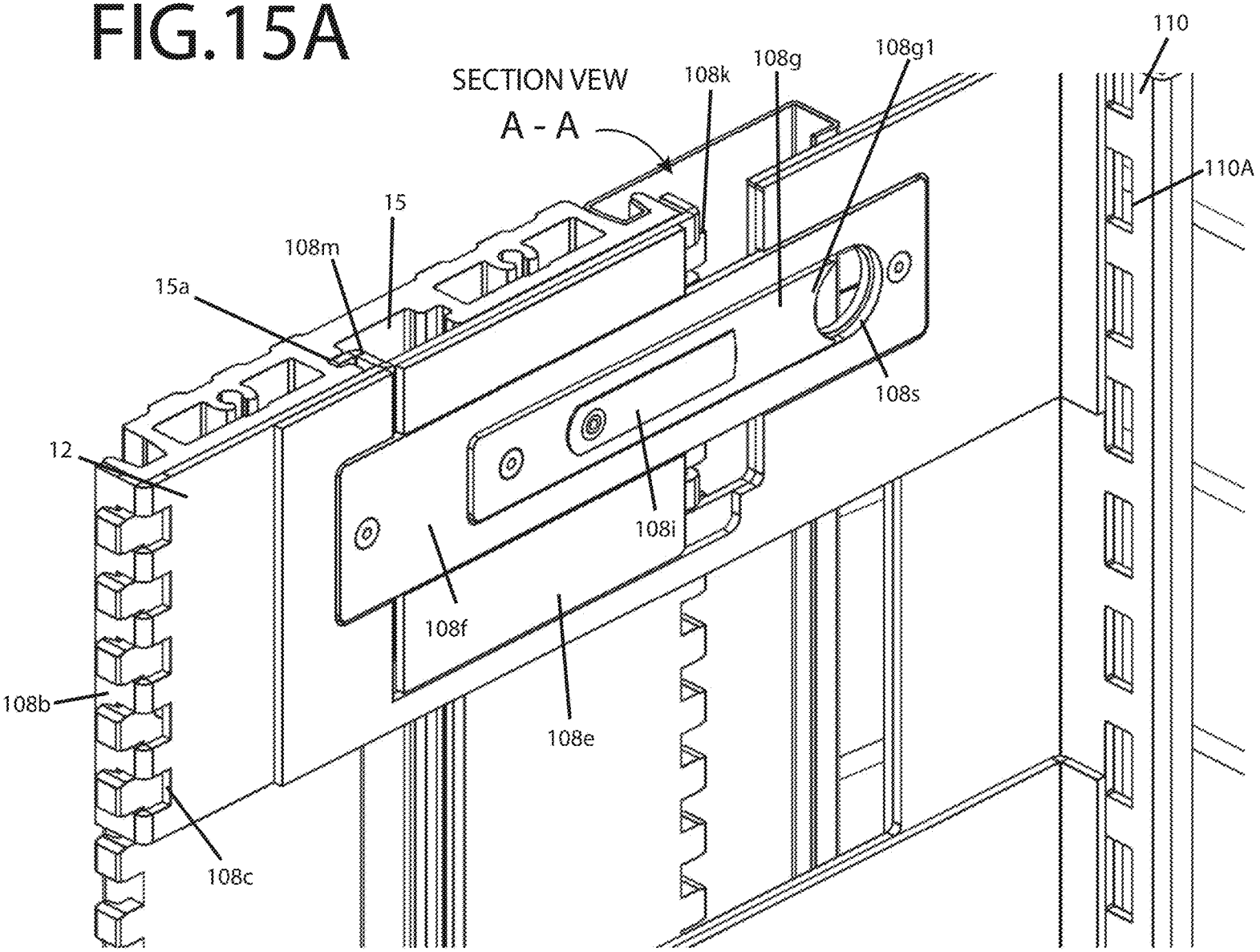
FIG. 15A illustrates a close-up view of a support bracket being fitted onto a vertical upright of a consumer product display, in accordance with an example embodiment.

FIG. 15A illustrates a close-up view of a support bracket 108 being fitted onto a vertical upright 10 of a consumer product display 2, in accordance with an example embodiment. In this view, the floating plate 108*e* of the support bracket 108 is shifted forward, toward the front surface 108*b* of the support bracket 108, such that the support bracket 108 is in a "locked" position on the upright 10 (also corresponding to the "locked" position shown in FIGS. 14 and 15D). In this "locked" position, the center bracket 108*m* of the support bracket 108 is fitting into a side-groove 15*a* of the track 15 of the vertical upright 10 (seen in better detail in FIG. 15D). In this "locked" configuration, notice that the horizontal front slots 108*c* of the support bracket 108 are also engaged with the front teeth 12 of the upright 10, the rear teeth 108*k* of the support bracket 108 is engaged with the rear teeth 14 of the upright 10, and the front surface of the distal end 108*g*1 of the inner locking tab 108*g* is flush with the front surface of the locking plate 108*f*.

Figure 15B:
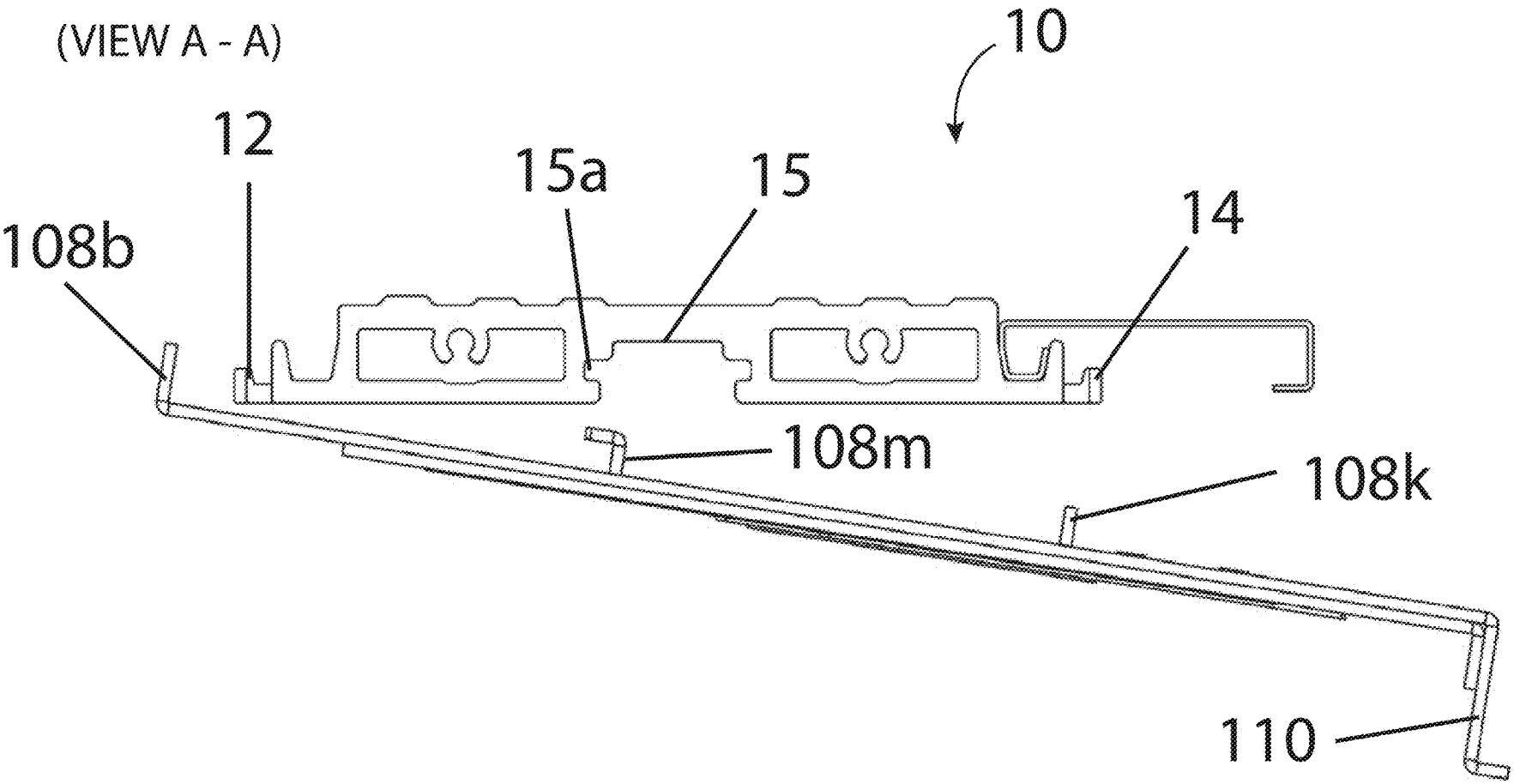
FIG. 15B illustrates a cross-sectional view of a support bracket being fitted onto a vertical upright of a consumer product display, in accordance with an example embodiment.

FIG. 15B illustrates a cross-sectional view of a support bracket 108 being fitted onto a vertical upright 10 of a consumer product display 2, in accordance with an example embodiment. In order to connect the bracket 108 to the upright 10, the front surface 108*b* of the bracket 108 may be aligned with the front teeth 12 of the upright. To fit the center brackets 108*m* and the center teeth 108*k* of the support bracket 108 onto the respective track 15 and rear teeth 14 of the upright 10, the floating plate 108*e* (see FIG. 15A) should be shifted toward the vertical corner plate 110 of the end bracket assembly 111 (as shown in the "unlocked" position of the support bracket 108, shown in at least FIG. 15C).

Figure 15C:
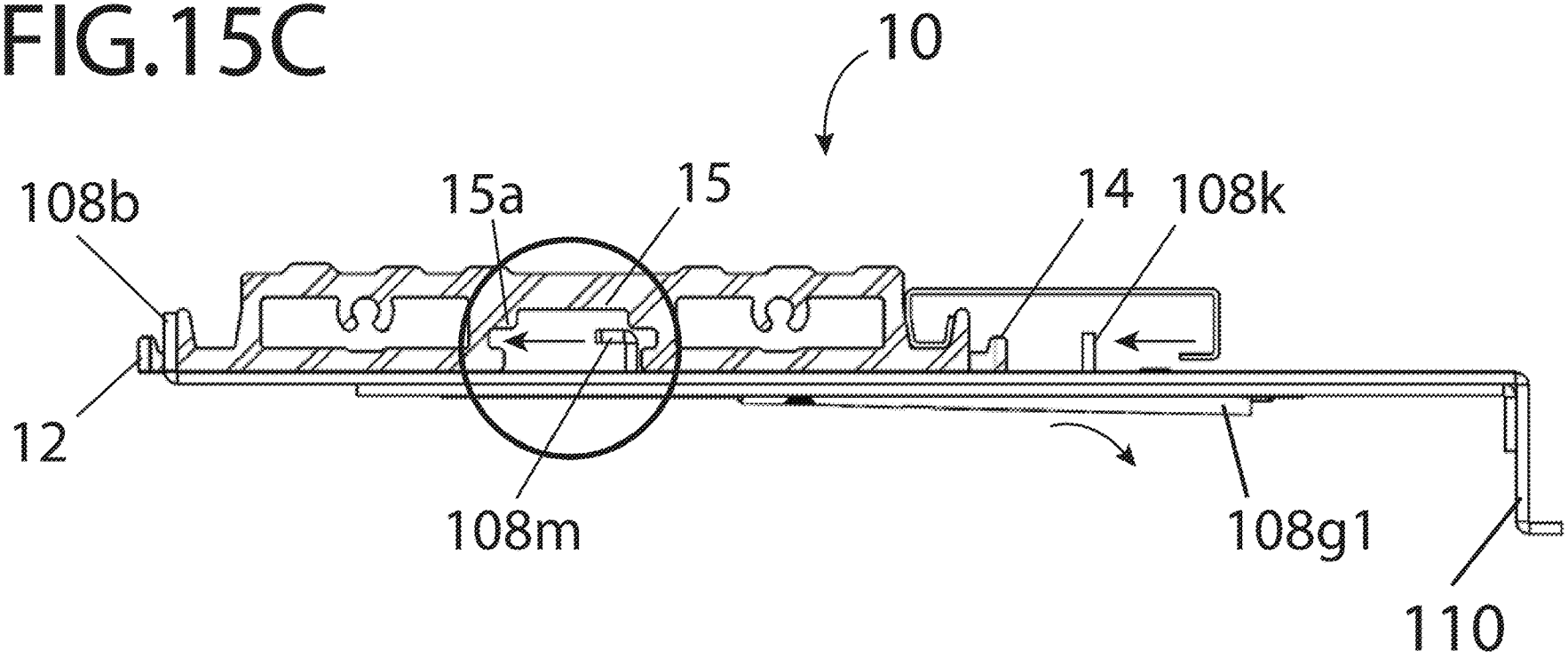
FIG. 15C illustrates a cross-sectional view of a support bracket being fitted onto a vertical upright of a consumer product display, in accordance with an example embodiment.
Figure 15D:
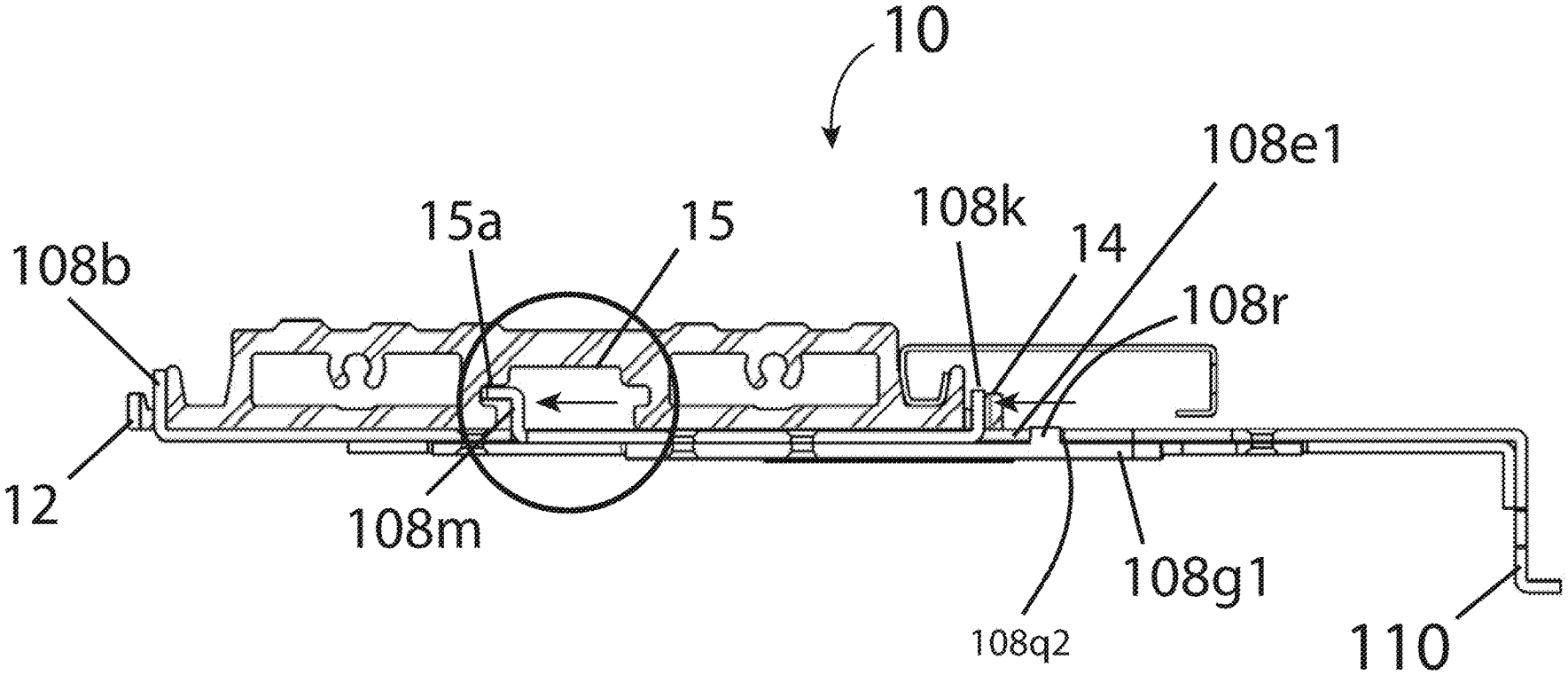
FIG. 15D illustrates a cross-sectional view of a support bracket being fitted onto a vertical upright of a consumer product display, in accordance with an example embodiment.

FIG. 15C illustrates a cross-sectional view of the support bracket 108 being fitted onto the vertical upright 10 of a consumer product display 2, in accordance with an example embodiment. In this view, the support bracket 108 is in the "unlocked" position, where the floating plate 108*e* (see FIG. 15A) is shifted toward the corner plate 110 of the end bracket assembly 111. In this "unlocked" configuration, the center brackets 108*m* of the support bracket 108 are disengaged from the side-groove 15*a* of the track 15 of the upright 10. The center teeth 108*k* of the support bracket 108 is also disengaged from the rear teeth 14 of the upright 10. Notice that in this "unlocked" position of the support bracket 108, a front surface of the distal end 108*g*1 of the inner locking tab 108*g* is also pulled away from a front surface of the locking plate 108*f* (see FIG. 15A), in order to disengage the locking stub 108*r* from contacting the edge 108*q*2 of the cut-out area 108*q*1.

FIG. 15D illustrates a cross-sectional view of the support bracket 108 being fitted onto the vertical upright 10 of the consumer product display 2, in accordance with an example embodiment. Specifically, in this view, the front surface of the distal end 108*g*1 of the inner locking tab 108*g* is flush with the front surface of the locking plate 108*f*, such that the locking stub 108*r* is pressed between the proximal-end 108*e*1 of the floating plate 108*e* and the edge 108*q*2 of the cut-out area 108*q*1, while the floating plate 108*e* is shifted toward the front surface 108*b* of the support bracket 108. In this "locked" configuration of the support bracket 108, the center brackets 108 may be engaged inside the side-groove 15*a* of the track 15 of the vertical upright 10, just as the center teeth 108*k* of the support bracket 108 may be engaged with the rear teeth 14 of the upright.

Figure 16:
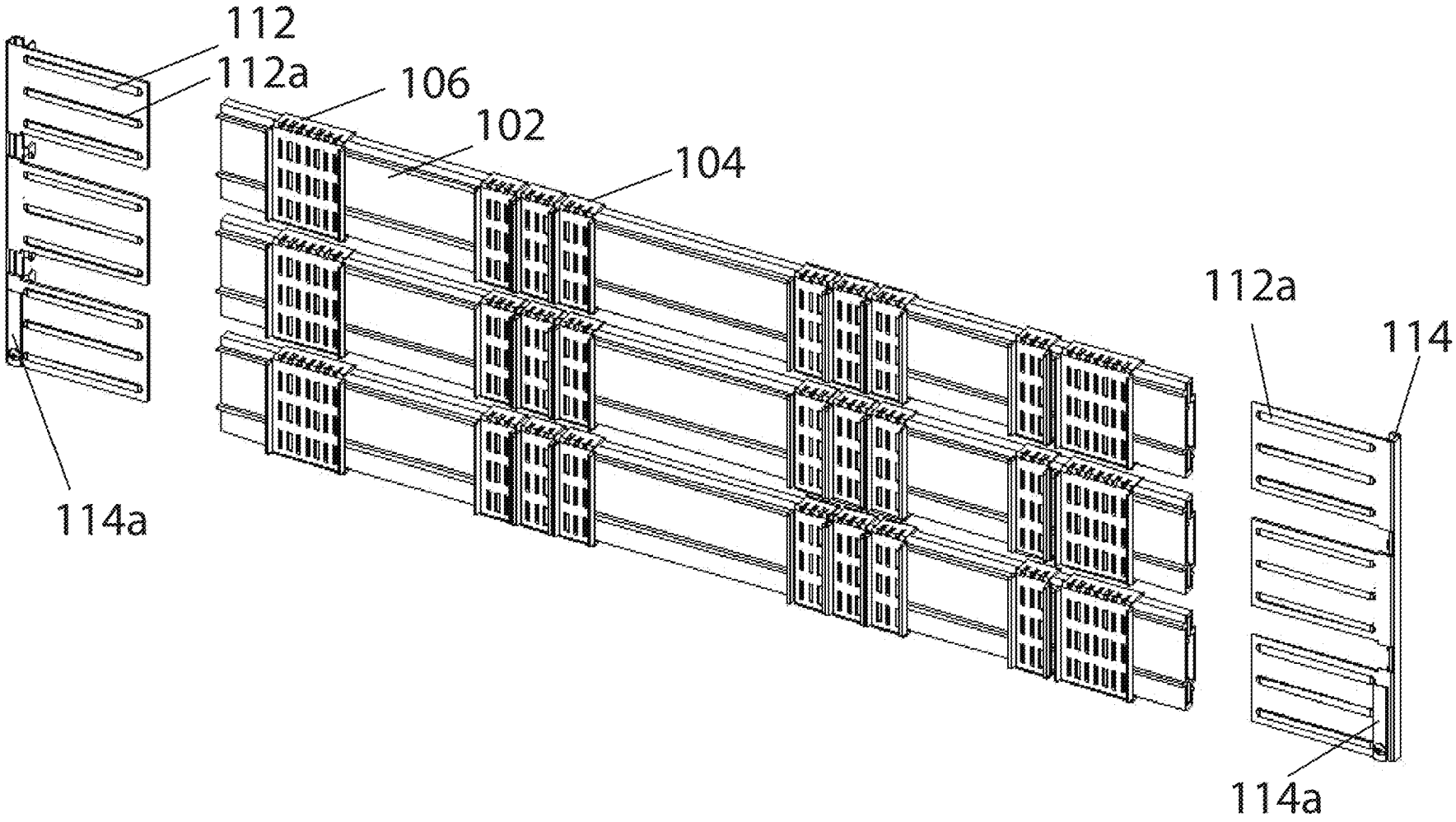
FIG. 16 illustrates a perspective-view of a group of insertable brackets being inserted into ends of a group of crossbars, where horizontally-slideable brackets are on the crossbars, in accordance with an example embodiment.

FIG. 16 illustrates a perspective-view of a group of insertable brackets 112 being inserted into ends of a group of crossbars 102, where horizontally-slideable brackets 104/106 are on the crossbars, in accordance with an example embodiment. Notice that a side locking clip 114*a* may be included on a front of one or more of the insertable brackets 112 (see the function of the locking clip 114*a* in FIGS. 19A/B, described below).

Figure 17:
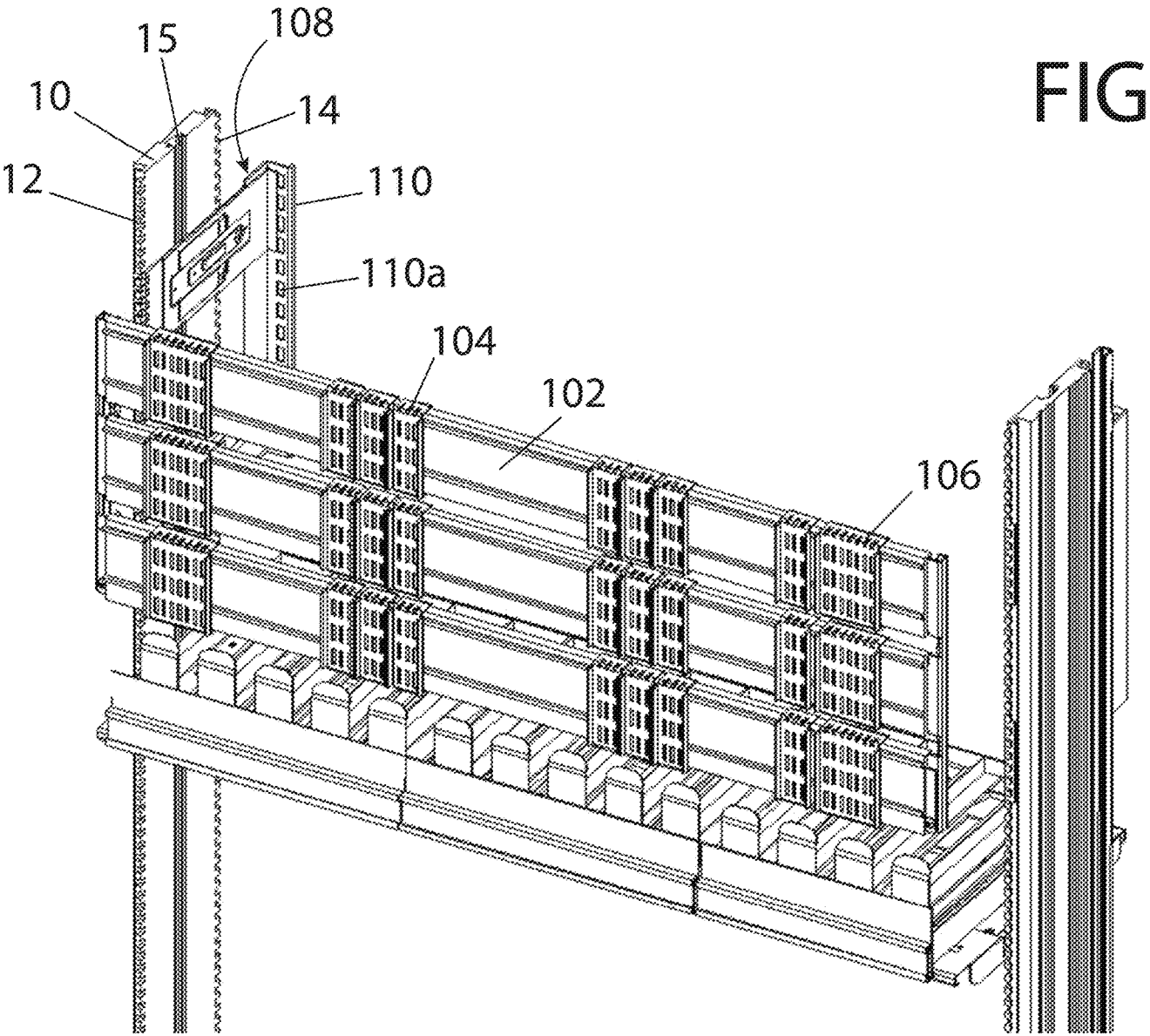
FIG. 17 illustrates a perspective-view of a group of crossbars being installed onto the vertical uprights of a consumer product display using support brackets, in accordance with an example embodiment.

FIG. 17 illustrates a perspective-view of a group of crossbars 102 being installed onto the vertical uprights 15 of a consumer product display 2 using support brackets 108, in accordance with an example embodiment. Prior to the modularized section of crossbars 102 being installed on the upright 15, the support bracket 108 may be in a "locked" position on the upright 10 (as shown in FIG. 15D), in order to provide a stable anchor-point for the weight of the crossbars 102 to rest on once installed on the upright 10.

Figure 18:
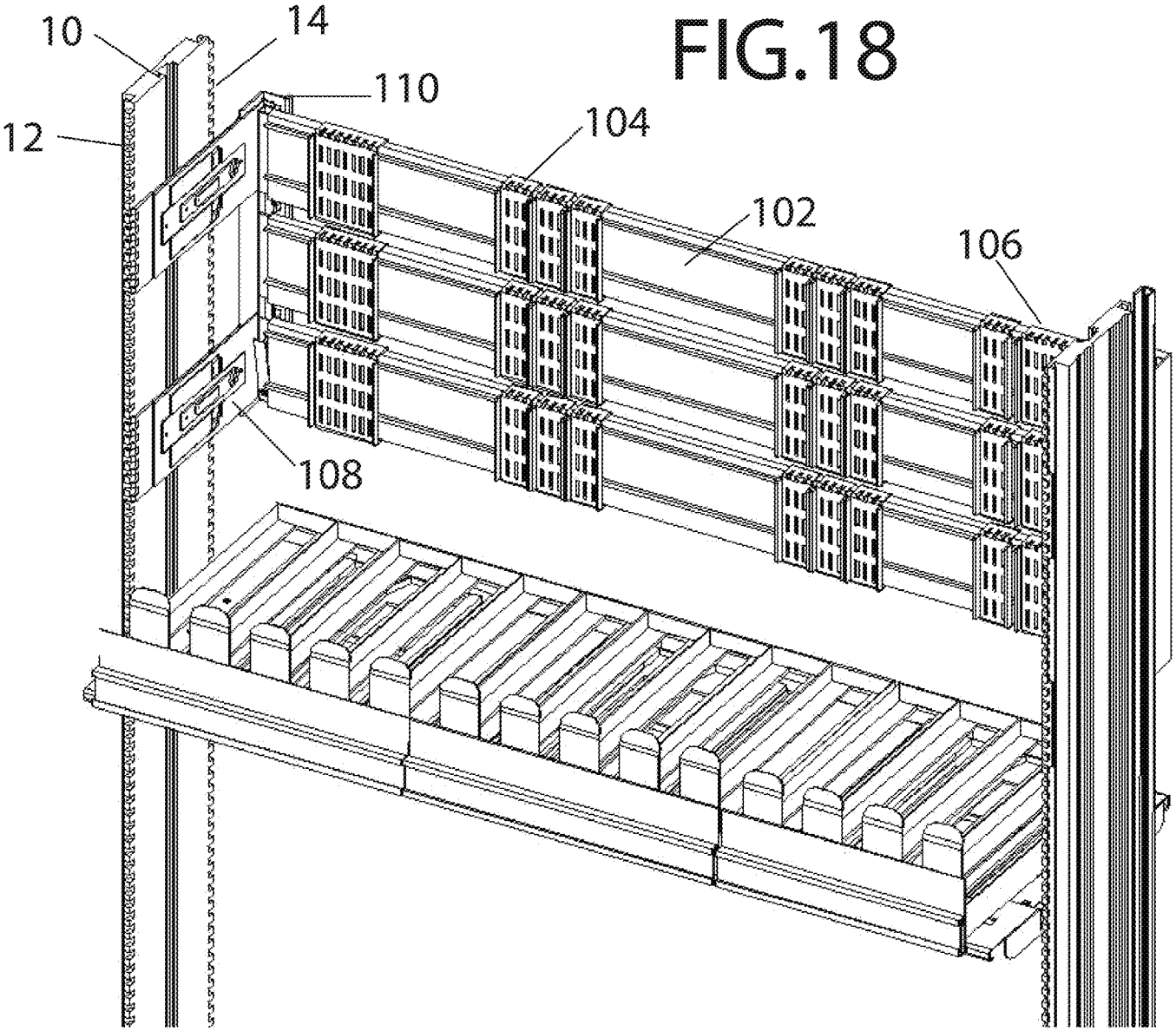
FIG. 18 illustrates a perspective-view of a group of crossbars being installed onto the vertical uprights of a consumer product display using support brackets, in accordance with an example embodiment.

FIG. 18 illustrates a perspective-view of a group of crossbars 102 being installed onto the vertical uprights 10 of a consumer product display 2 using support brackets 108, in accordance with an example embodiment. In this view, one end of the crossbars 102 has been connected to the upright 10 via the support brackets 108, where the engaging structure (teeth 114*b*) on the connector 114 of the insertable brackets 112 may be inserted into slots 110*a* of the corner plate 110 (seen in better detail in FIG. 19B). Subsequently, the other end of the crossbars 102 may be connected to the other (opposing) upright 10 using the support brackets 108.

Figure 19A:
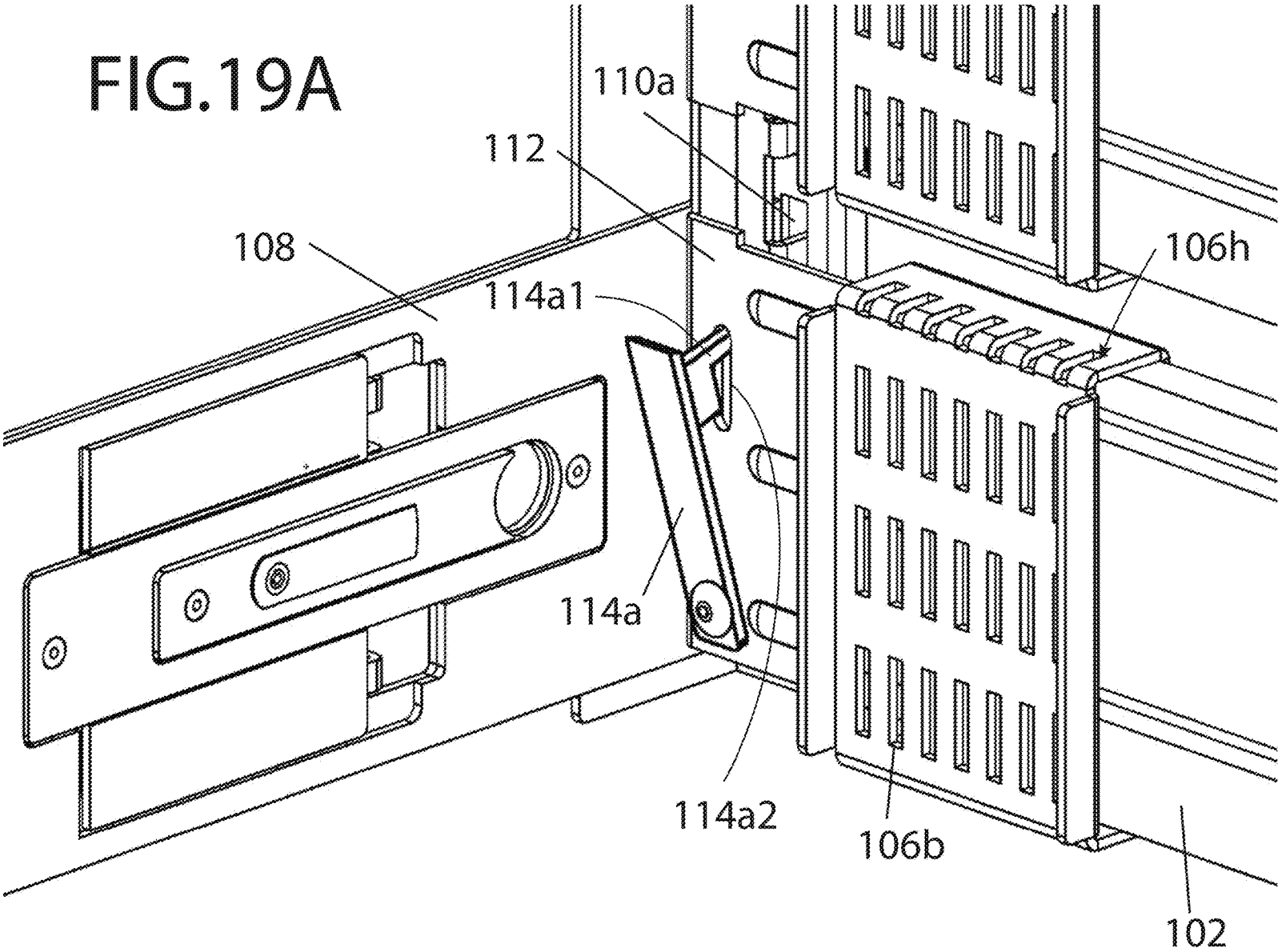
FIG. 19A illustrates a close-up view of a locking clip being used to secure crossbars onto a consumer product display using support brackets, in accordance with an example embodiment.

FIG. 19A illustrates a close-up view of a locking clip 114*a* being used to secure crossbars 102 onto a consumer product display 2 using support brackets 108, in accordance with an example embodiment. The locking clip 114*a* may include an extension piece 114*a*1 that may fit into a slot 114*a*2 on a front of the insertable bracket 112 (when the locking clip 114 pivots and allows the extension piece 114*a*1 to be pressed into slot 114*a*2), where the extension piece 114*a*1 may protrude through the slot 114*a*2 and into a slot 110*a* of the corner plate 110 (shown in FIG. 19B) to lock the insertable bracket 112 in a horizontal-position once the crossbar 102 is hung on the support brackets 108.

Figure 19B:
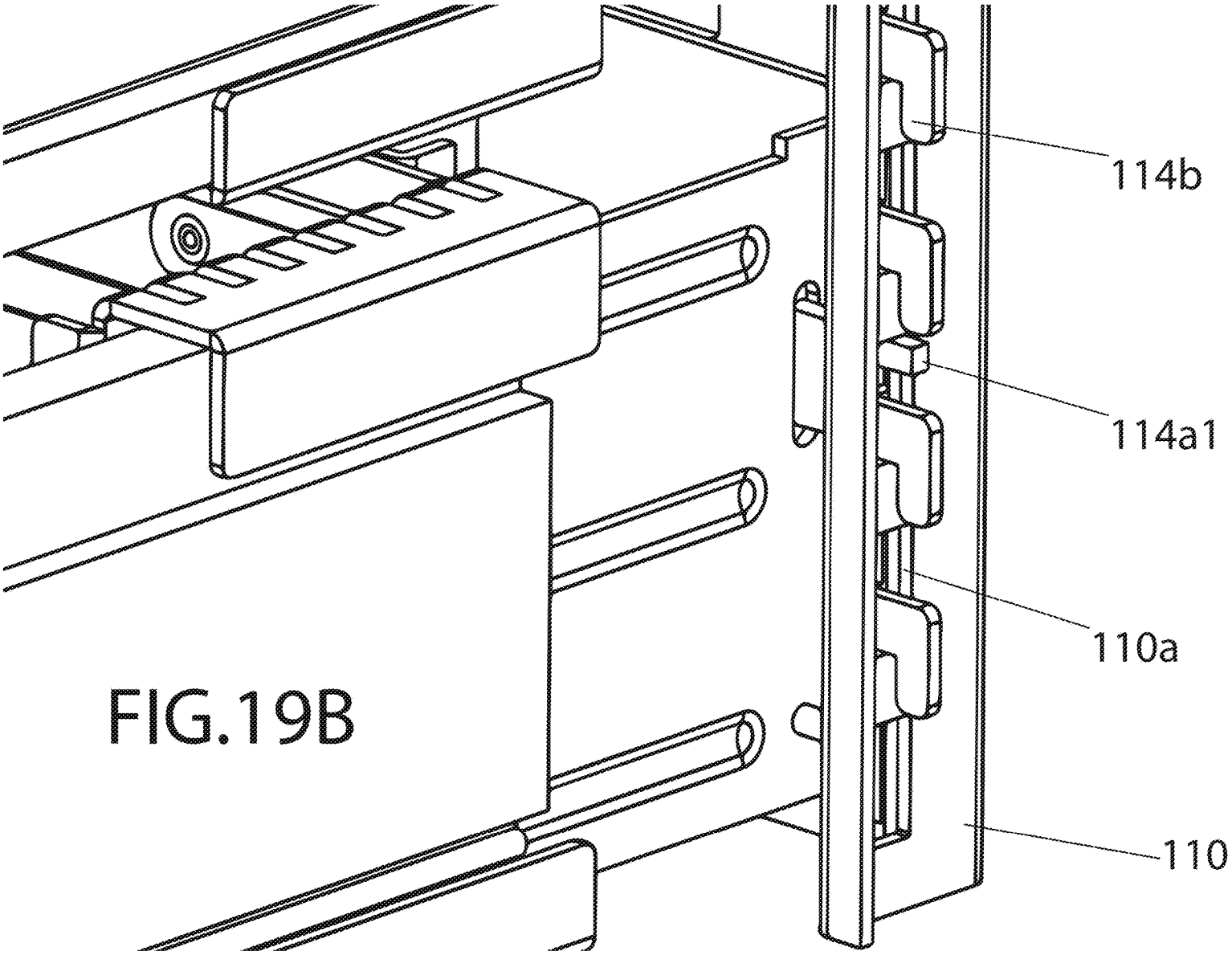
FIG. 19B illustrates a close-up rear-view of a locking clip being used to secure crossbars onto a consumer product display using support brackets, in accordance with an example embodiment.

FIG. 19B illustrates a close-up rear-view of a locking clip 114 being used to secure crossbars 102 onto a consumer product display 2 using support brackets 108, in accordance with an example embodiment. In this view, the extension piece 114*a*1 of the locking clip 114 has been pressed through the slot 114*a*2 (shown in FIG. 19A) so that the extension piece 114*a*1 fits into slot 110*a* of the corner plate 110. Because the teeth 114*b* of the insertable bracket 112 are already in the slots 110*a*, the extension piece 114*a*1 experiences a tight-fit when the extension piece 114*a*1 is pressed through the slot 110*a*. By using the locking clip 114*a* to hold the insertable brackets 112 in place, the insertable brackets 112 may then be horizontally-stabilized when the mounting system 100 is installed. This horizontal-stabilization is particularly preferred, considering that the insertable brackets 112 may act as a width-tolerance for the overall effective length of the crossbars 102, where the insertable bracket 112 may ultimately be installed in a partially-extended form (i.e., where the insertable bracket 112 is not fully pressed into the end of the crossbars 102) in order to fashion the crossbars 102 onto variable-sized displays 2 that may have non-standard widths.

Figure 20:
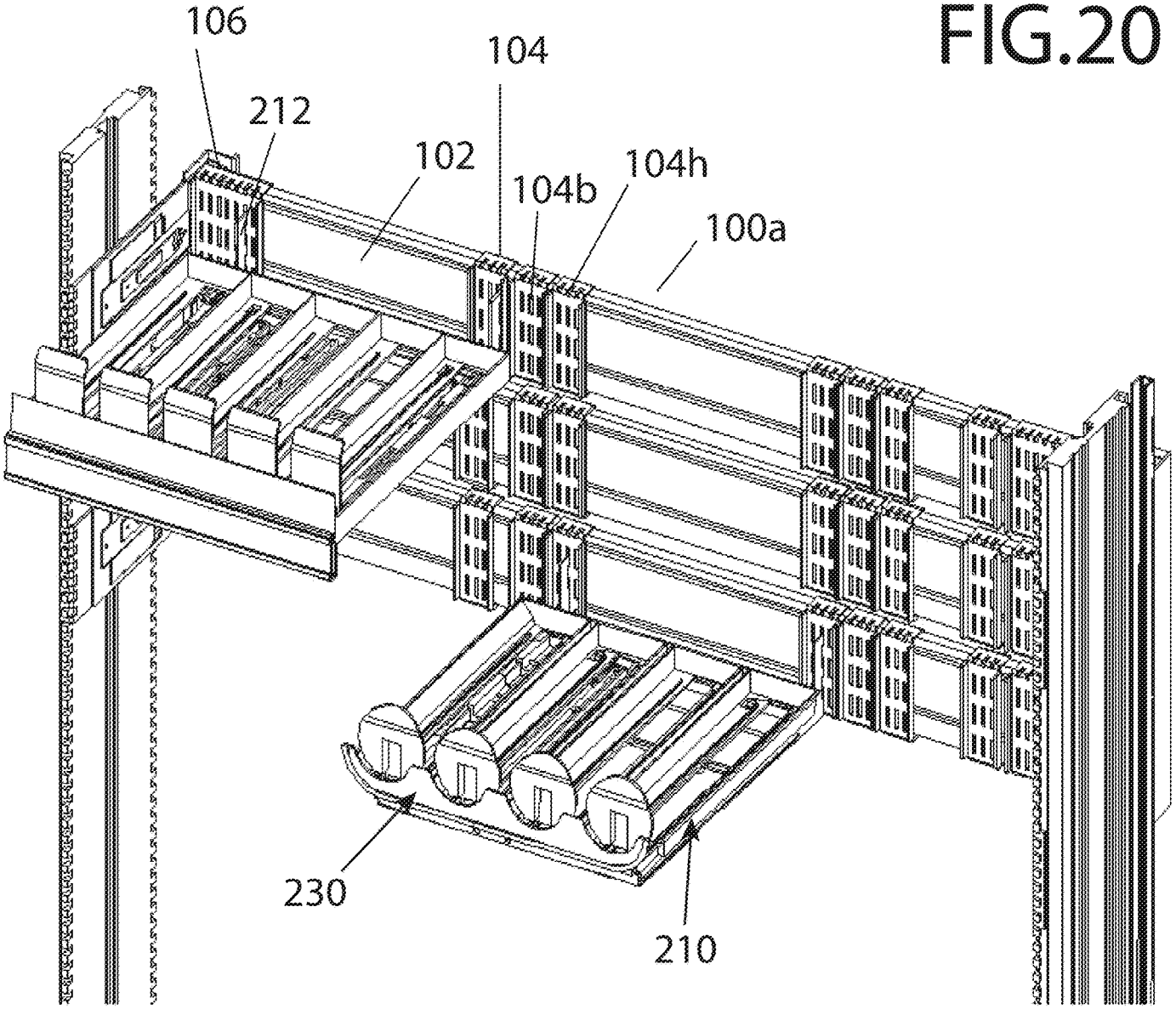
FIG. 20 illustrates shelving being installed on a mounting system, in accordance with an example embodiment.

FIG. 20 illustrates shelving 210 being installed on a mounting system 100, in accordance with an example embodiment. The shelving 210 may include trays 230 that may hold and vend consumer products. The shelves 210 may be hung on the crossbars 102 via an engaging (i.e., teeth 214 on a rear vertical bracket 212 of the shelves 210, as shown in FIG. 21A) that may connect to one or more of the horizontally-slideable brackets 104/106 (where this connection between the shelving 210 and brackets 104/106 is shown in better detail in FIG. 26).

Figure 21A:
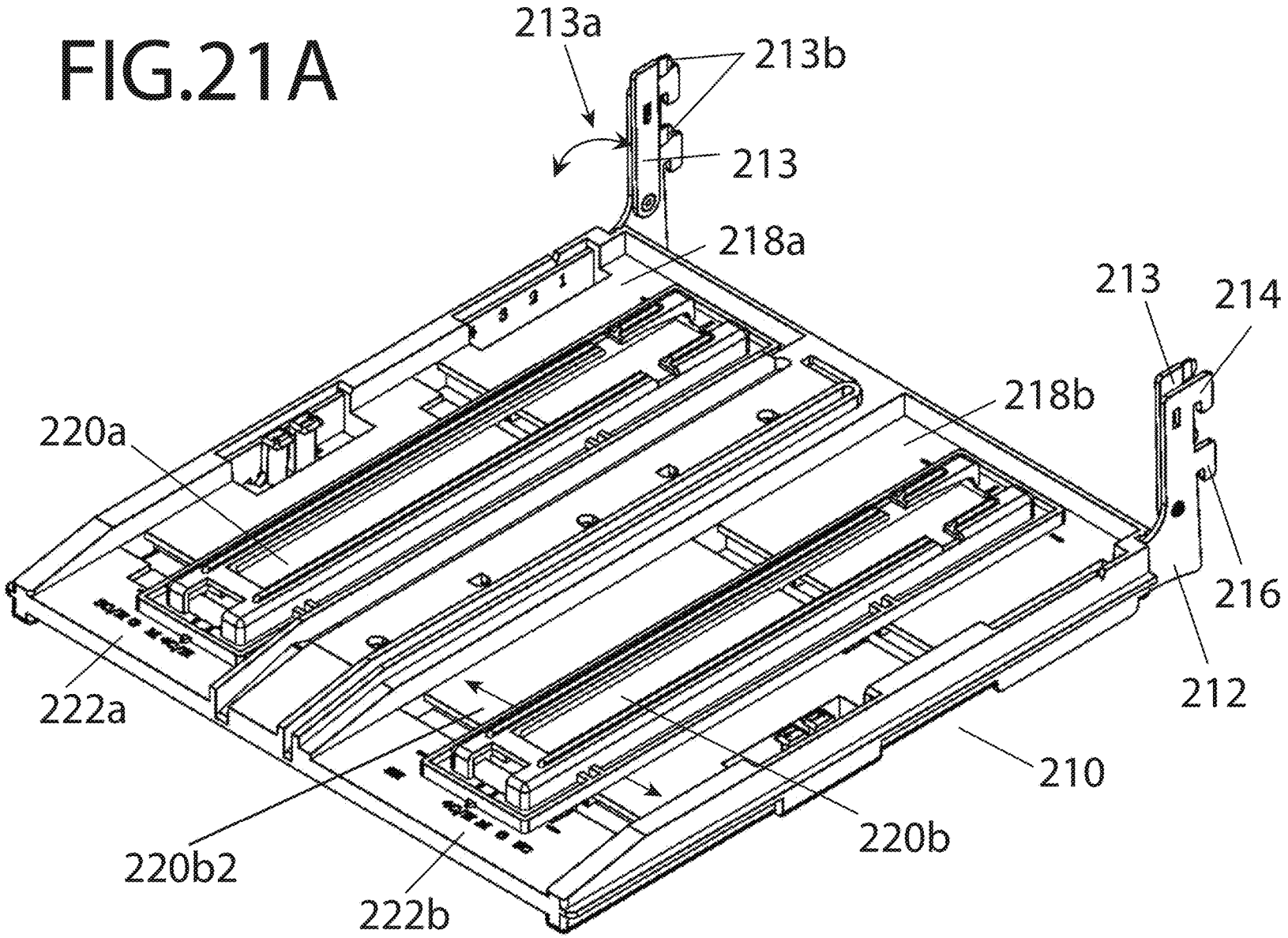
FIG. 21A illustrates a shelf of a mounting system, in accordance with an example embodiment.
Figure 23A:
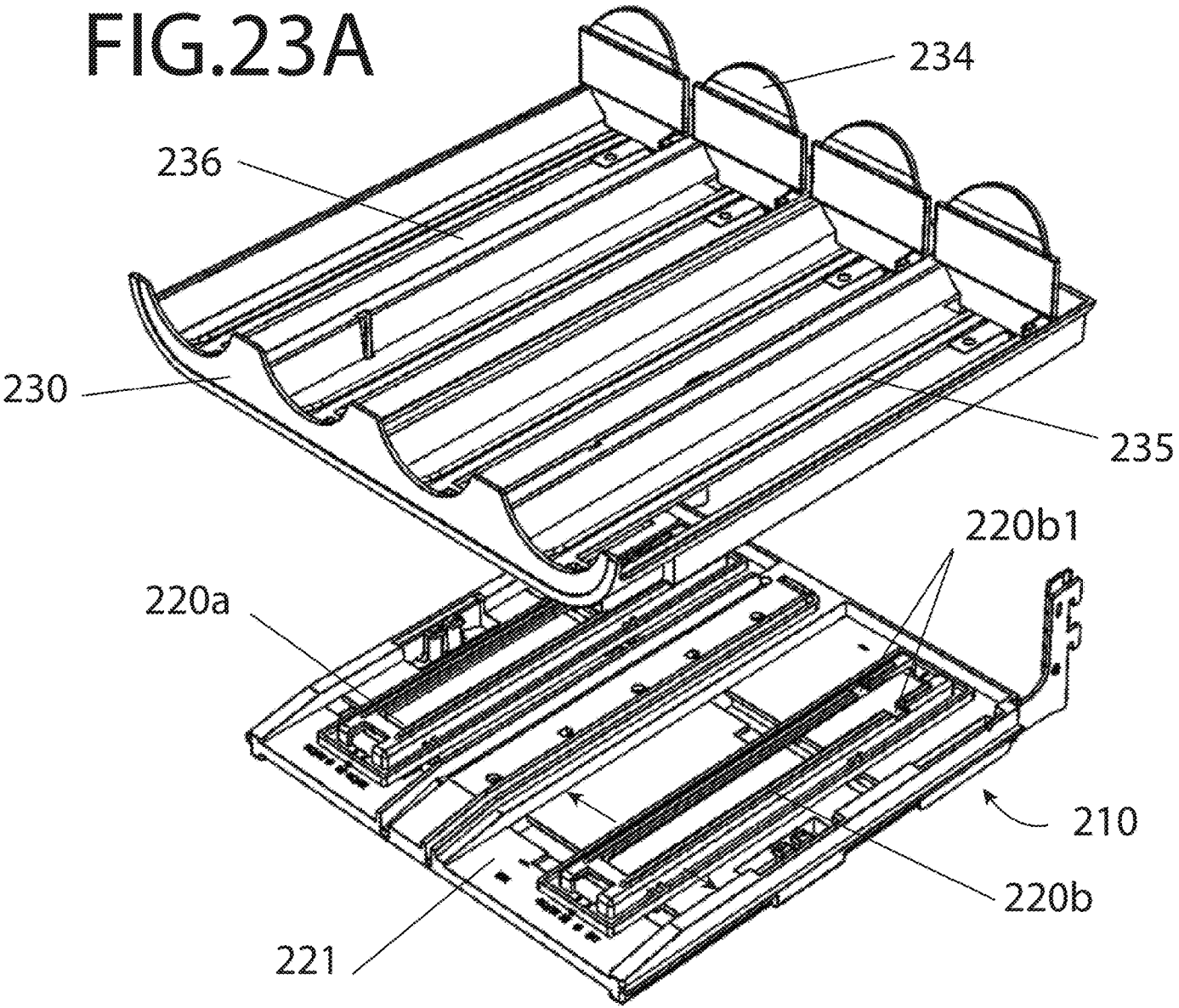
FIG. 23A illustrates a tray being connected to a top of a shelf of a mounting system, in accordance with an example embodiment.
Figure 23B:
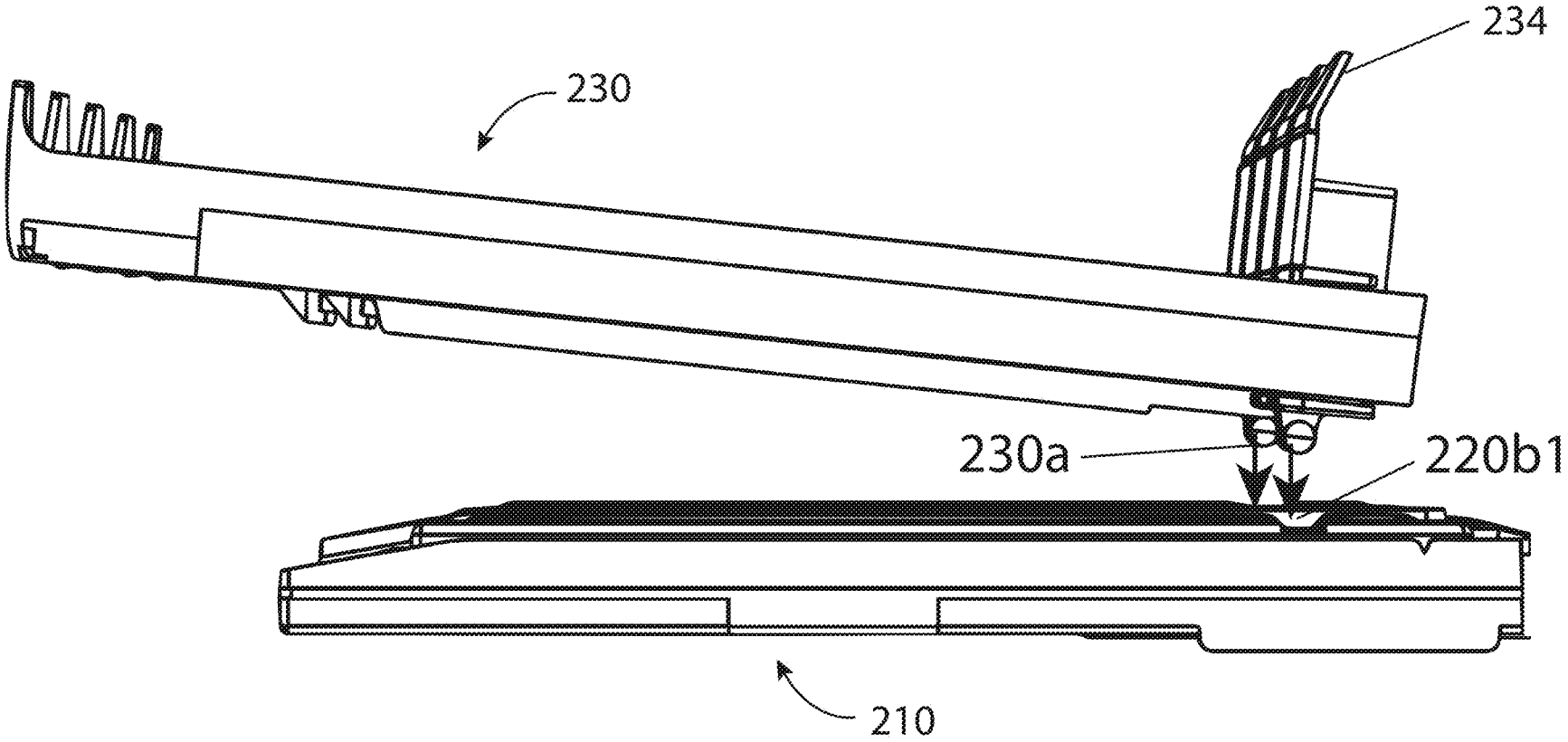
FIG. 23B illustrates a side-view of a tray being connected to a top of a shelf of a mounting system, in accordance with an example embodiment.
Figure 23C:
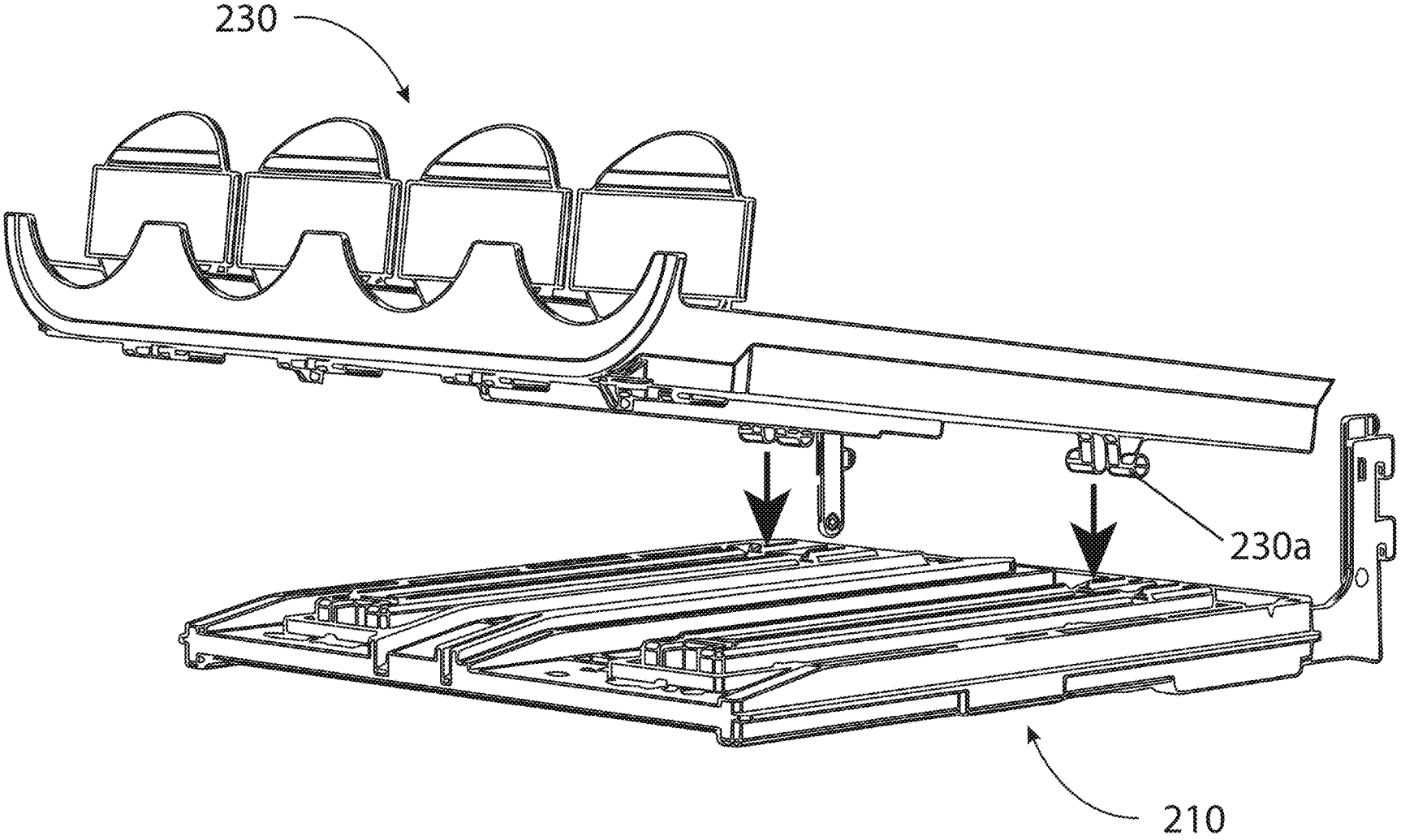
FIG. 23C illustrates a perspective-view of a tray being connected to a top of a shelf of a mounting system, in accordance with an example embodiment.

FIG. 21A illustrates a shelf 210 of a mounting system 100, in accordance with an example embodiment. The shelves 210 may include a pair of horizontally-adjustable tracks 220*a/b*, where each of the tracks 220*a/b* may move horizontally (as shown by the movement-direction 220*b*2 in FIG. 21A) along surfaces 218*a/b* of the shelf 210. Each of the tracks 220*a/b* may provide structure capable of supporting the trays 230 (as shown in FIGS. 23A, 23B and 23C). Indicia 222*b* may be present near the tracks 220*a/b* to indicate a relative position of the tracks 220*a/b* on the shelf 210. By being able to move horizontally on the shelves 210, the moveable tracks 220*a/b* may accommodate a wide variety of trays 230 that may be of variables sizes and widths.

Figure 26:
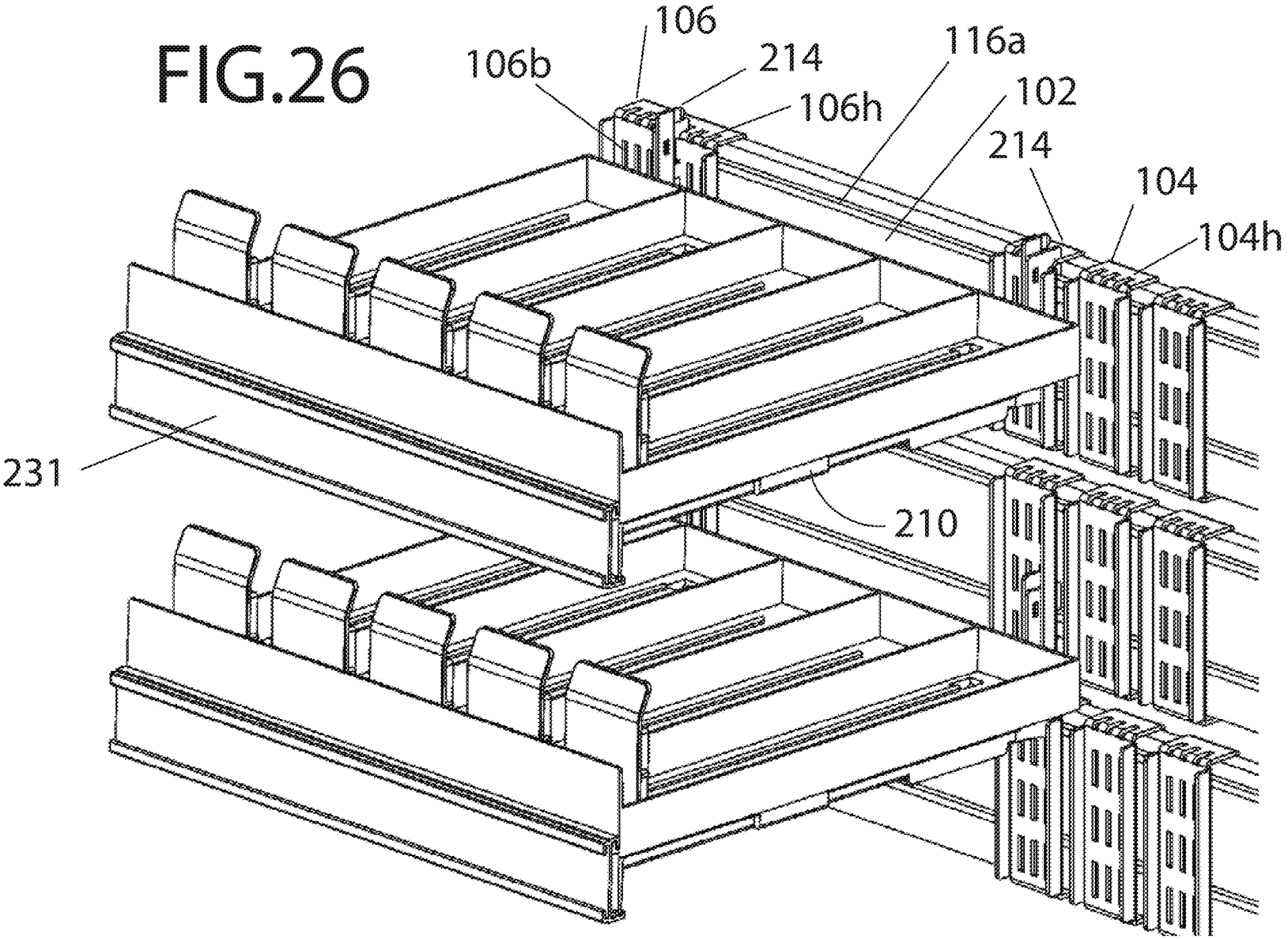
FIG. 26 illustrates a perspective-view of shelves being connected to a mounting system, in accordance with an example embodiment.

The shelf 210 may include a rear vertical bracket 212 capable of attaching the shelf 210 to the brackets 104/106 of the mounting system 100. The vertical brackets 212 may include teeth 214, where the teeth 214 may include vertical projections 216 capable of securing the shelf 210 to the brackets 104/106 during installation of the mounting system 100. The brackets 212 may include a safety stop 213 capable of locking the shelf 210 into place on the brackets 104/106, once the shelf 210 is in a desired position on the crossbars 102. The stop 213 may pivot (see pivot-movement 213*a* of the stop, in FIGS. 21A and 22C), where the stop 213 may be pressed forward (toward brackets 104/108), once it is desired to lock the shelf 210 into position on the brackets 104/106 of the crossbars 102. In an embodiment, the stop 213 may have projections 213*b* at a same elevation as the teeth 214 of the bracket 212, where the stop 213 may be spaced slightly-apart from the teeth 214, so that once the stop 213 is pressed forward (in order to lock the shelf 210 into place on the brackets 104/106, as shown in FIG. 26), the projections 213*b* of the stop 213 and the teeth 214 of the bracket 212 both are wide enough to fully fill a width of the slots 104*b/h* and 106*b/h* of the respective brackets 104/106 on the crossbar 102, in order to lock the brackets 212 of the shelf 210 into place on the crossbars 102.

Figure 21B:
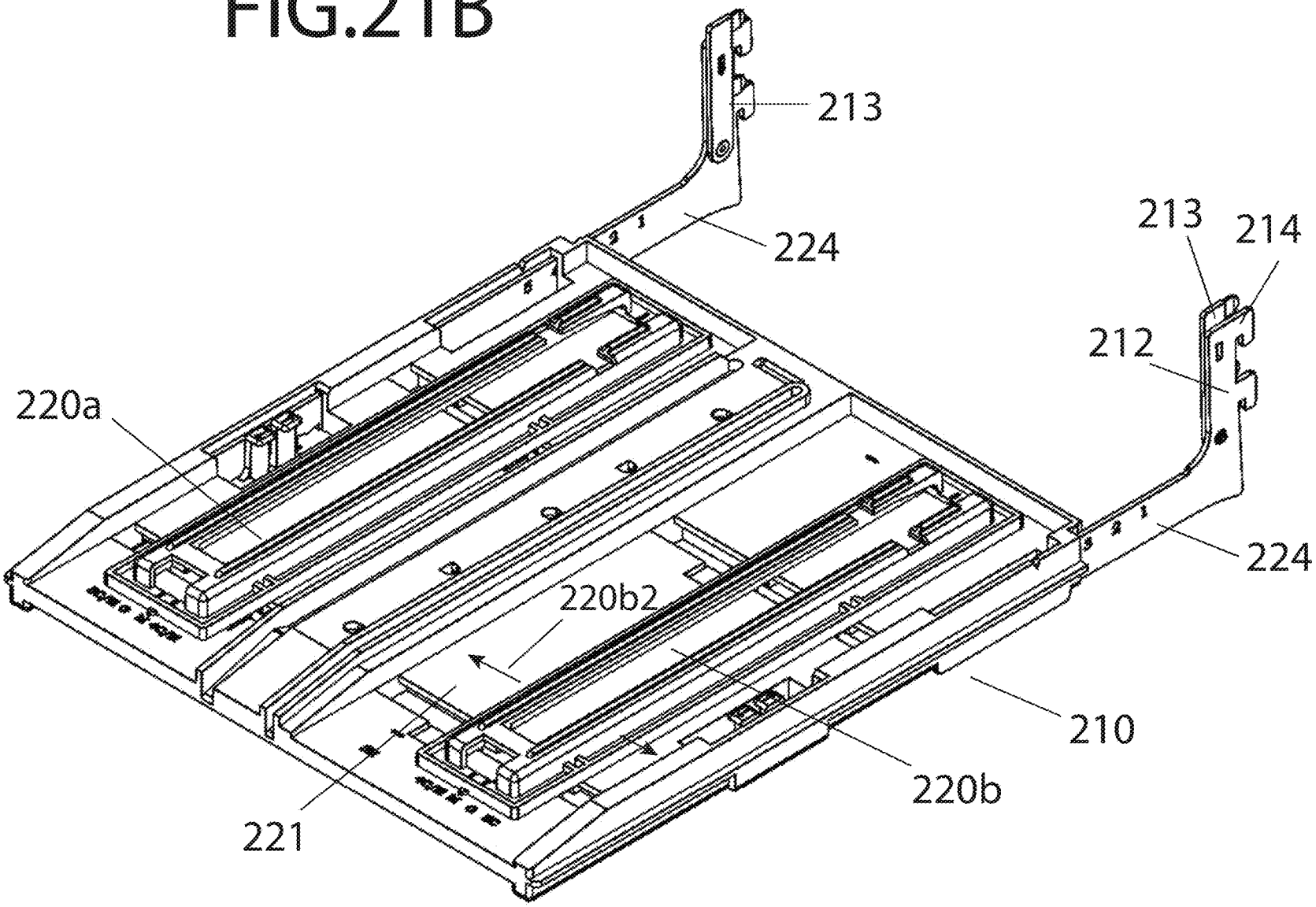
FIG. 21B illustrates a shelf of a mounting system, in accordance with an example embodiment.

FIG. 21B illustrates a shelf 210 of a mounting system 100, in accordance with an example embodiment. The shelf 210 may include a protractable blade 224, where the protractable blade 224 may be used to extend or contract the vertical bracket 212 towards or away from the shelf 210, in order to adjust an effective shelf-depth once the shelf 210 is installed on the mounting system 100. In FIG. 21B, the blade 224 is in an "extended" configuration, whereas FIG. 21A shows the blade in a "retracted" configuration.

Figure 22A:
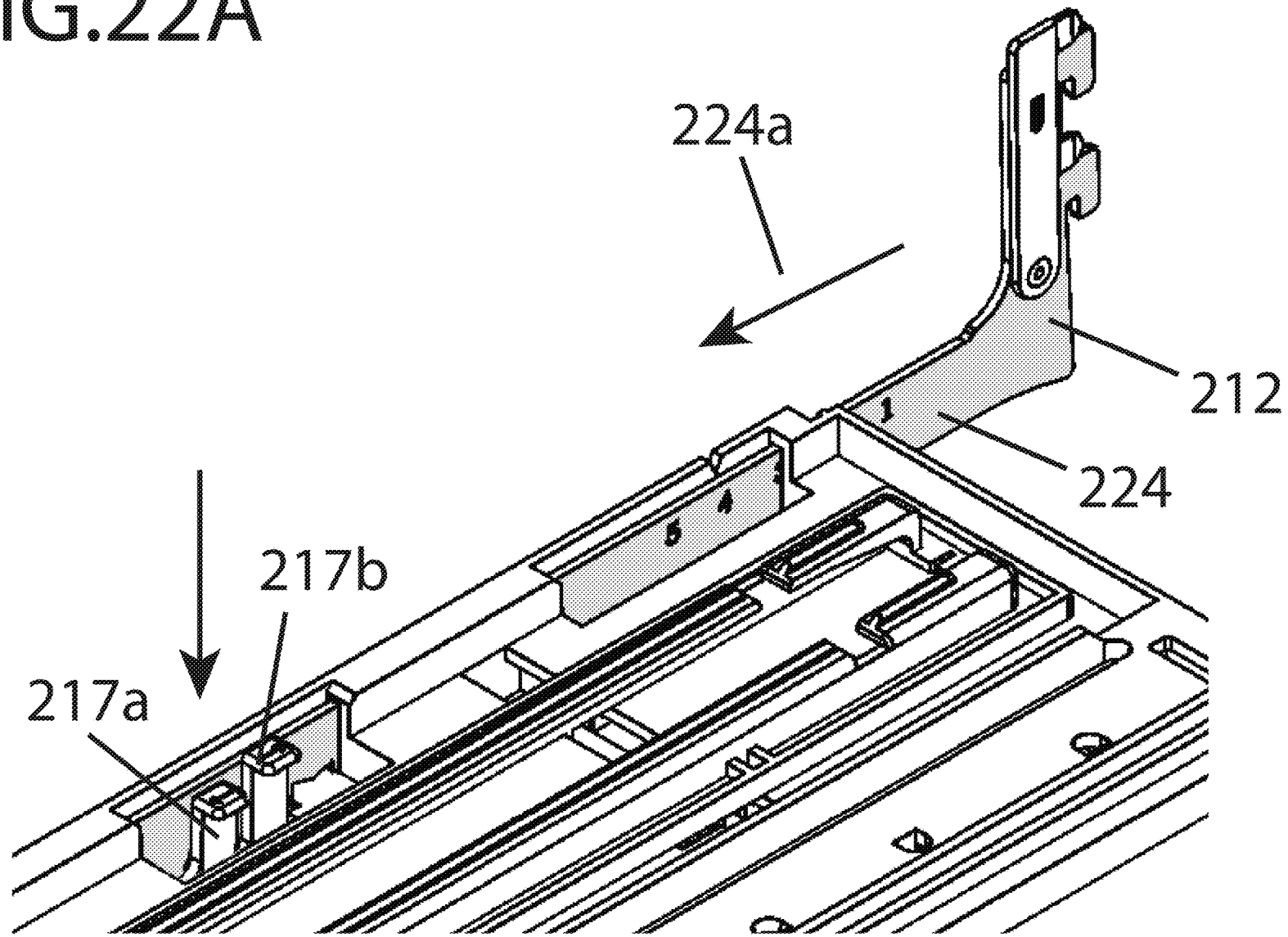
FIG. 22A illustrates a close-up view of a protractable blade being retracted into a shelf of a mounting system, in accordance with an example embodiment.

FIG. 22A illustrates a close-up view of the protractable blade 224 being retracted into the 210 shelf of a mounting system 100, in accordance with an example embodiment. A first button 217*a* on the shelf 210 may be used to release the blade 224 to allow the blade to be retracted (and thereby move the bracket 212 into a retracted movement-direction 224*a*).

Figure 22B:
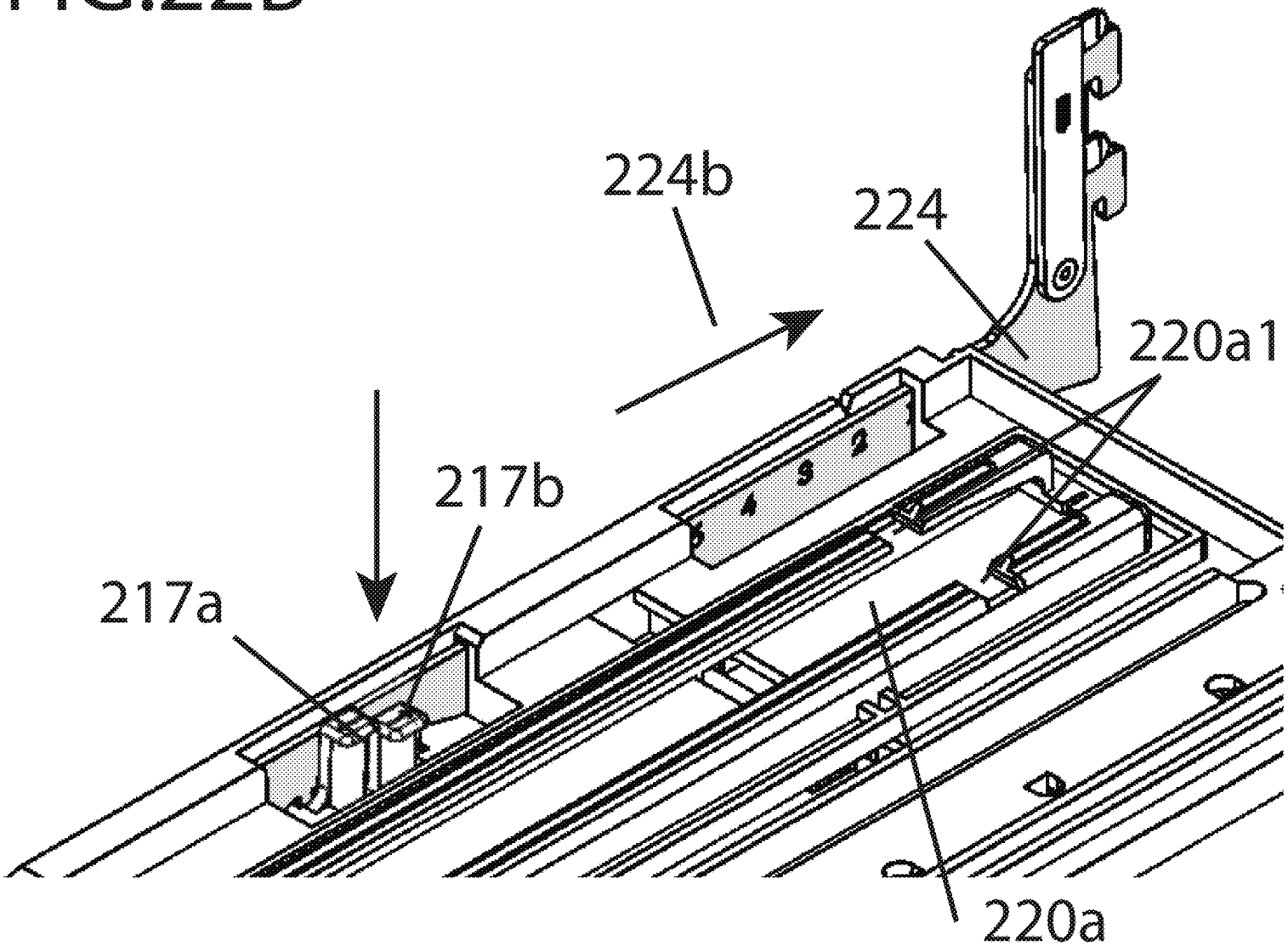
FIG. 22B illustrates a close-up view of a protractable blade being extended from a shelf of a mounting system, in accordance with an example embodiment.

FIG. 22B illustrates a close-up view of the protractable blade 224 being extended from the shelf 210 of the mounting system 100, in accordance with an example embodiment. A second button 217*b* on the shelf 210 may be used to release the blade 224 to allow the blade to be extended (and thereby move the bracket 212 into an extended movement-direction 224*b*).

Track notches 220*a*1 may be included on the respective tracks 220*a*/220*b*. Mounting stubs 230*a* (shown in FIG. 23B) may mate with the notches 22*a*1 to hold the tray 230 in place on the shelf 210.

Figure 22C:
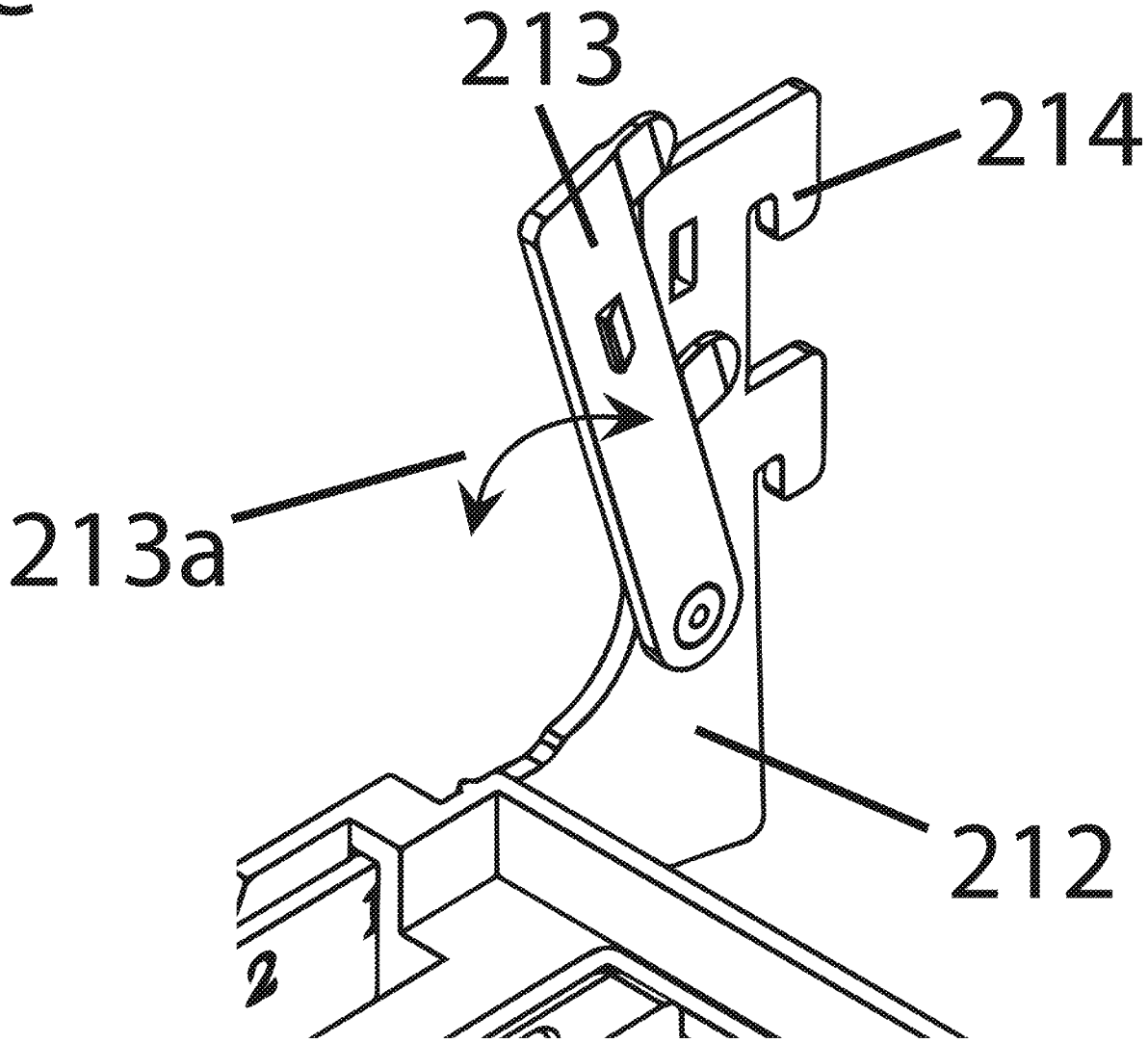
FIG. 22C illustrates a close-up view of a safety stop pivoting on a vertical bracket of a shelf of a mounting system, in accordance with an example embodiment.

FIG. 22C illustrates a close-up view of a safety stop 213 pivoting on a vertical bracket 214 of a shelf of a mounting system, in accordance with an example embodiment. This view shows, in better detail, the movement of the stop 213 that was also depicted in FIG. 21A.

FIG. 23A illustrates a tray 230 being connected to a top of a shelf 210 of a mounting system 100, in accordance with an example embodiment. The tracks 220*a/b* of the shelf 210 may be adjusted, horizontally across the upper surface of the shelf 210, in order to accommodate variable-sized trays 230 that may have different widths and different mounting stub 230*a* locations (see the mounting stubs 230*a* in FIG. 23B).

Spring loaded stops 234 may slide within tracks 235 of the tray, where dividers 236 on the tray 230 may separate rows of consumer products that may be stored and vended on the trays 230.

FIG. 23B illustrates a side-view of a tray 230 being connected to a top of a shelf 210 of a mounting system 100, in accordance with an example embodiment. The mounting stubs 230*a* of the tray 230 may mate with a respective pair of track notches 220*a*1/220*b*1 (also see FIGS. 22B and 23A), in order to firmly connect the tray 230 to the shelf 210.

FIG. 23C illustrates another perspective-view of the tray 230 being connected to the top of the shelf 210 of a mounting system 100, in accordance with an example embodiment. This view shows, in more detail, two-pronged mounting stubs 230*a* that may be used to mate with the notches 220*a*1/220*b*1 of the shelf 210.

Figure 24A:
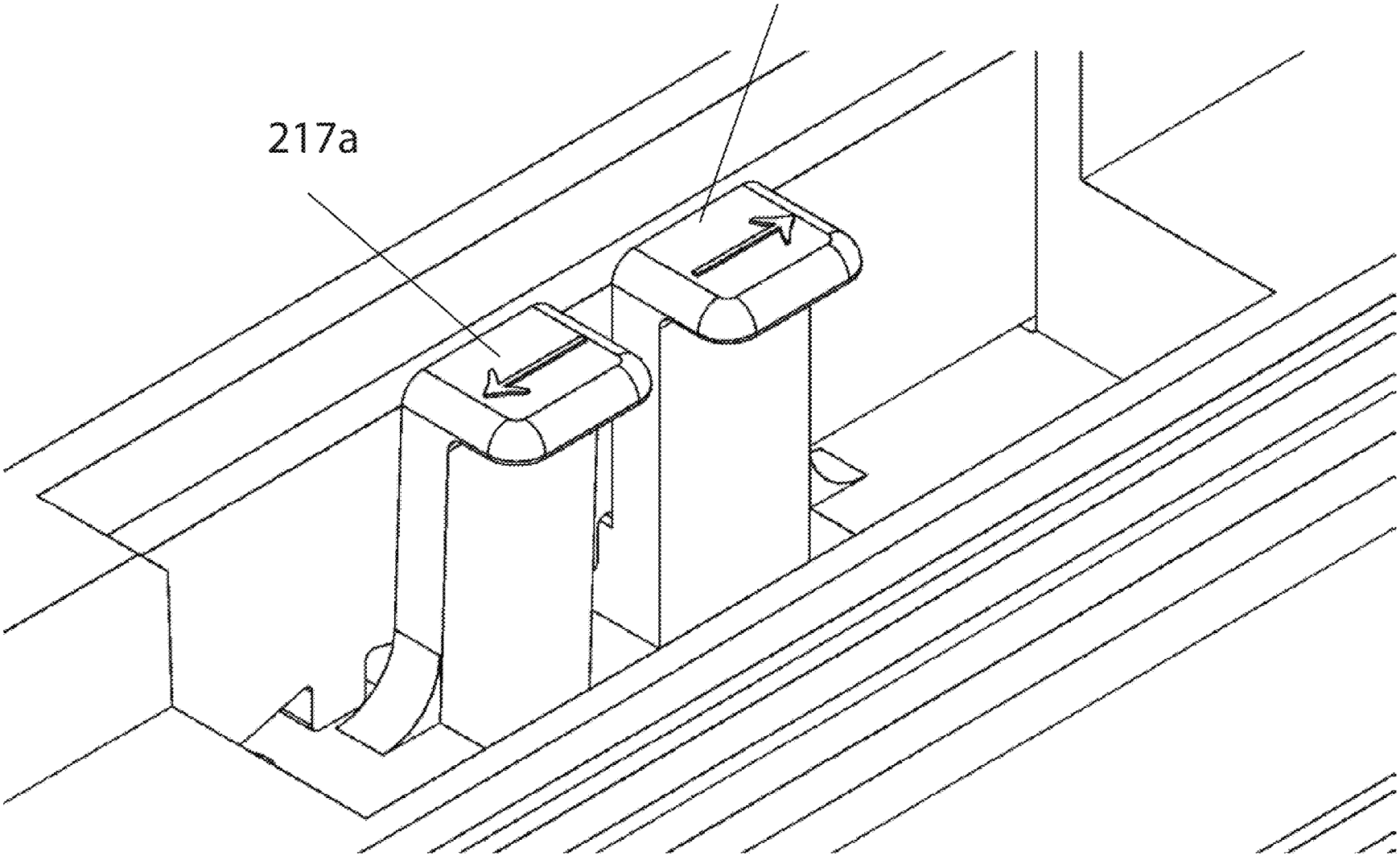
FIG. 24A illustrates a close-up view of buttons of a shelf being used to adjust a protractable blade of a shelf of a mounting system, in accordance with an example embodiment.

FIG. 24A illustrates a close-up view of buttons 217*a*/217*b* of the shelf 210, where these buttons 217*a*/217*b* may be used to adjust the protractable blade 224 (see FIG. 21A/B) of the shelf 210 of the mounting system 100, in accordance with an example embodiment. Specifically, the first button 217*a* may be used to release the blade 224 to allow the blade to be retracted, whereas the second button 217*b* may be used to release the blade 224 to allow the blade to be extended.

Figure 24B:
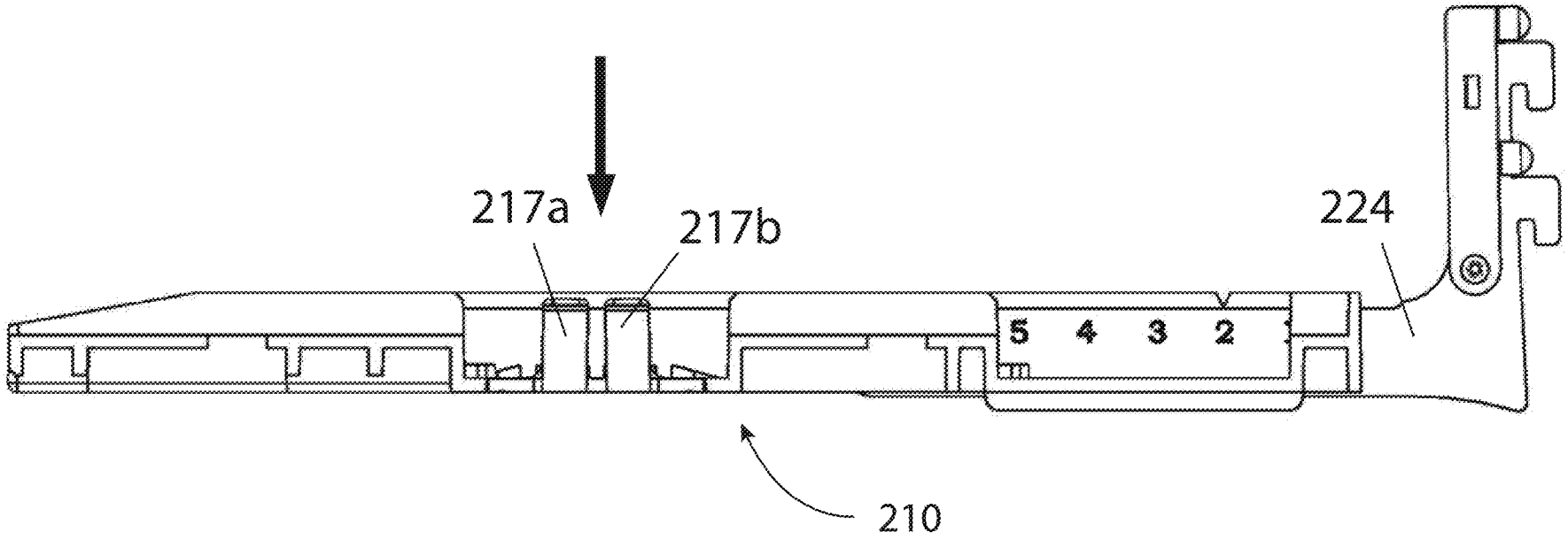
FIG. 24B illustrates a cross-sectional view of a shelf of a mounting system, in accordance with an example embodiment.

FIG. 24B illustrates a cross-sectional view of the shelf 210 of the mounting system 100, in accordance with an example embodiment. The buttons 217*a/b* of the shelf 210 may respectively be in mechanical communication with triangular-shaped stops 217*a*1/217*b*1 (see FIG. 24C), where each button 217*a/b* may be depressed to, in turn, depress the respective stop 217*a*1 or 217*b*1 in order to allow the blade 224 to be extracted or retracted.

Figure 24C:
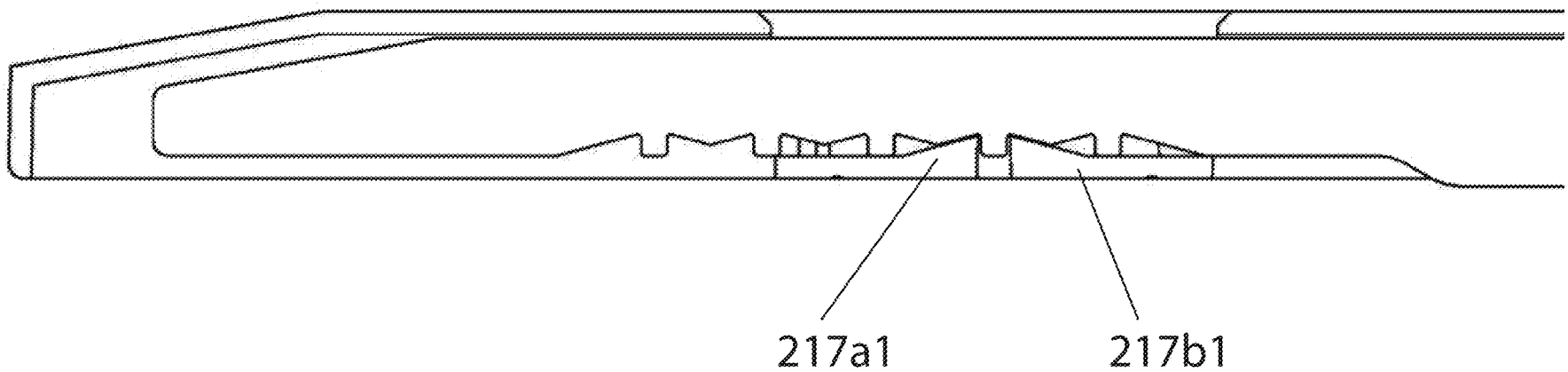
FIG. 24C illustrates a cross-sectional view of a shelf of a mounting system, in accordance with an example embodiment.

FIG. 24C illustrates a cross-sectional view of a shelf 210 of the mounting system 100, in accordance with an example embodiment. Specifically, this view shows the stops 217*a*1 and 217*b*1 that may be respectively in communication with the buttons 217*a/b* (FIG. 24B).

Figure 24D:
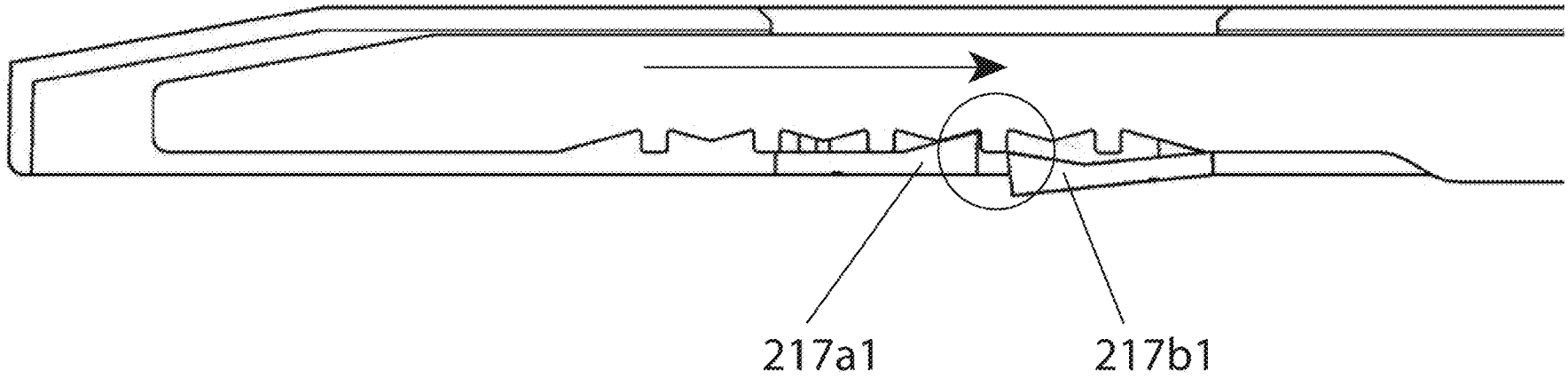
FIG. 24D illustrates a cross-sectional view of a shelf of a mounting system, in accordance with an example embodiment.

FIG. 24D illustrates a cross-sectional view of a shelf 210 of a mounting system 100, in accordance with an example embodiment. The second button 217*b* may be depressed on the shelf 210 (see FIG. 24A) in order to depress stop 217*b*1. In doing so, notches on the blade 224 may allow the blade 224 to only be extracted from the shelf 210 (as shown in FIG. 22A).

Figure 24E:
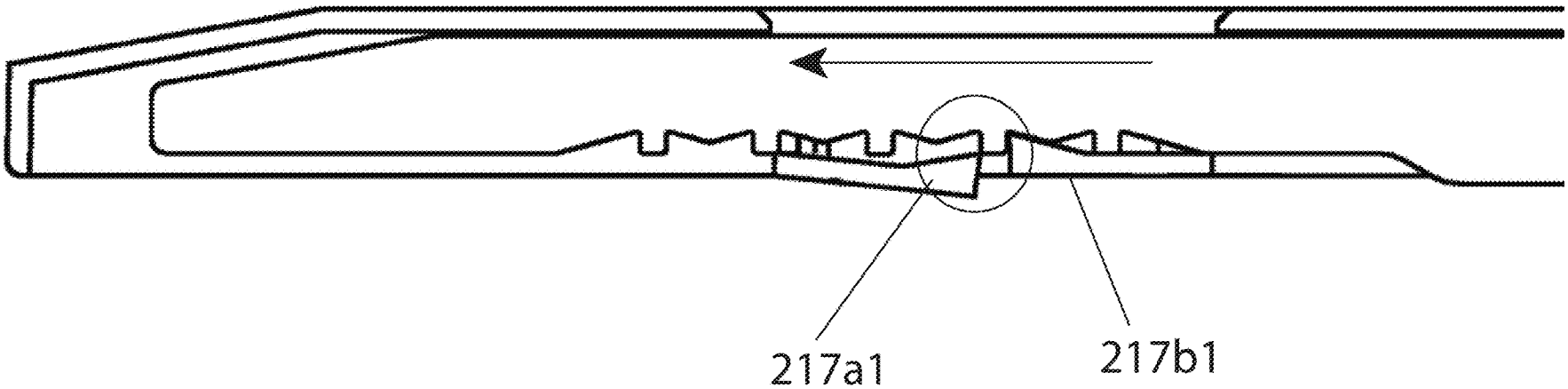
FIG. 24E illustrates a cross-sectional view of a shelf of a mounting system, in accordance with an example embodiment.

FIG. 24E illustrates a cross-sectional view of a shelf 210 of a mounting system 100, in accordance with an example embodiment. The first button 217*a* may be depressed on the shelf 210 (see FIG. 24A) in order to depress stop 217*a*1. In doing so, notches on the blade 224 may allow the blade 224 to only be retracted into the shelf 210 (as shown in FIG. 22B).

Figure 24F:
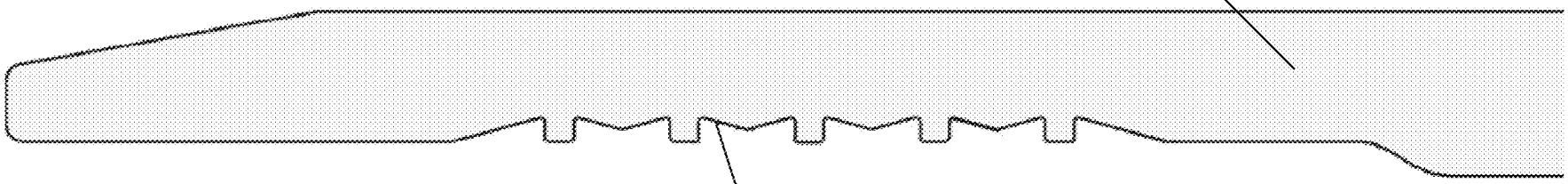
FIG. 24F illustrates notches on a blade of a shelf of a mounting system, in accordance with an example embodiment.

FIG. 24F illustrates notches 240 on the blade 224 of the shelf 210, in accordance with an example embodiment. These notches 240 communicate with the stops 217*a*1/217*b*1 in order to allow the blade 224 to be extracted of retracted to and from the shelf 210.

Figure 25:
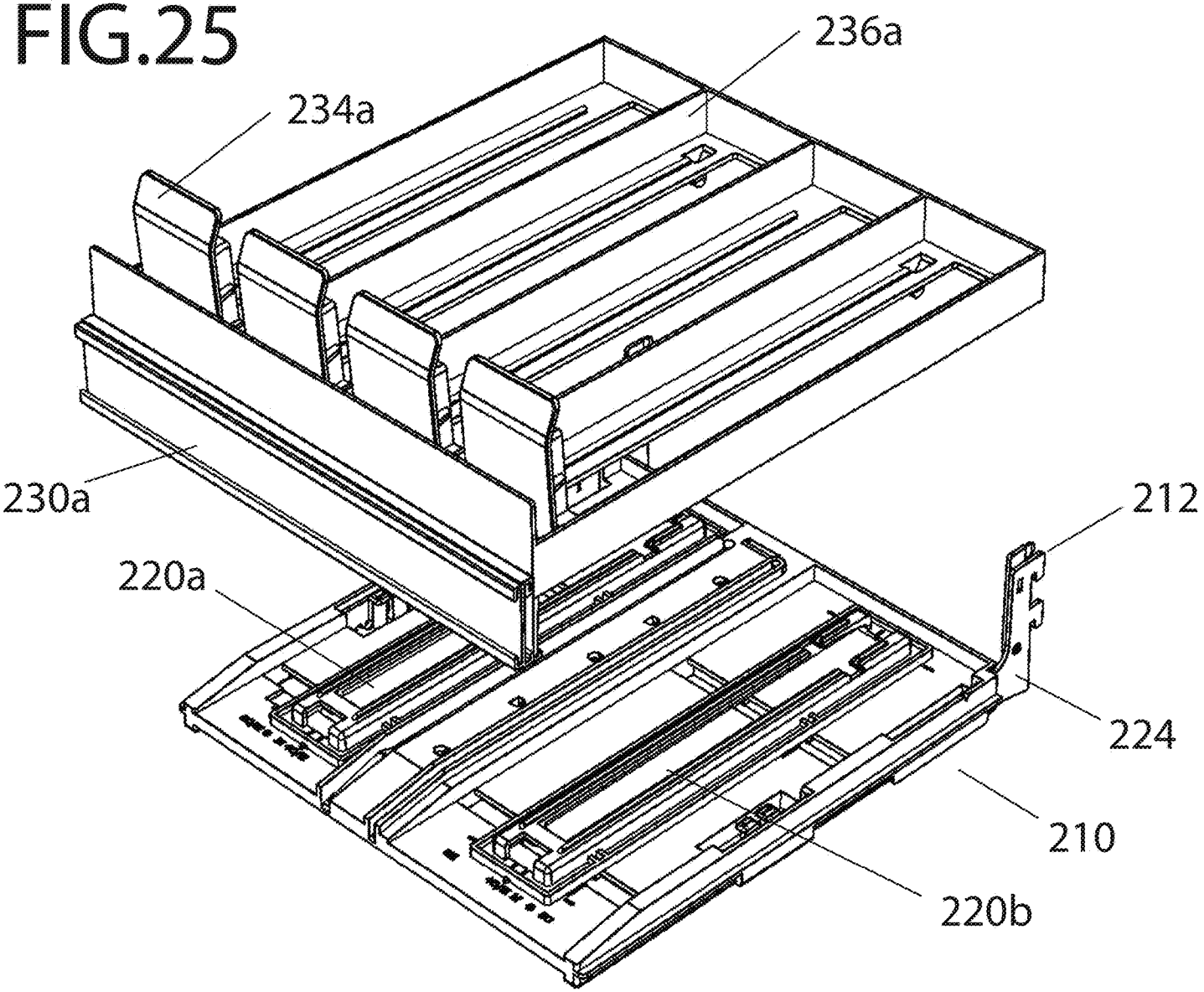
FIG. 25 illustrates a view of a tray being connected to a shelf of a mounting system, in accordance with an example embodiment.

FIG. 25 illustrates a view of a tray 230*a* being connected to a shelf 210 of a mounting system 100, in accordance with an example embodiment. In particular, this view shows the implementation of a different-styled tray 230*a* (as compared to the tray 230 of FIG. 23A), where the spring-loaded backstop 234*a* are dividers 236*a* may accommodate consumer products that may be a somewhat different shape, as compared to products that may be used with tray 230. Specifically, tray 230*a* may be used to store and vend more square/rectangular shaped products, as compared to tray 230 which may be used for more circular-shaped products.

FIG. 26 illustrates a perspective-view of trays 231 and shelves 210 being connected to a mounting system 100, in accordance with an example embodiment. A top-most tooth, of the teeth 214 of the vertical brackets 212 of the shelves 210 (also see FIG. 21A/B) may fit into upper slot 106*h* of bracket 106, and be held in the resting place 216*a* (see FIG. 10B) defined by an upper surface 116*a*1 of the ledge 116*a* and bracket 106 (and similarly, bracket 104). This may allow the bracket 212 of the shelf 210 to more effectively transfer a weight-load onto the crossbar 102, while also ensuring the shelf 210 is more stably connected to the crossbar 102. The lower tooth, of the teeth 214 of the vertical bracket 212 of the vertical brackets 212 of the shelves 210, may fit within the vertical slots 106*b* of the bracket 106 (and similarly, bracket 104), in order to further ensure the stability of the shelves 210 on the mounting system 100.

Figure 27:
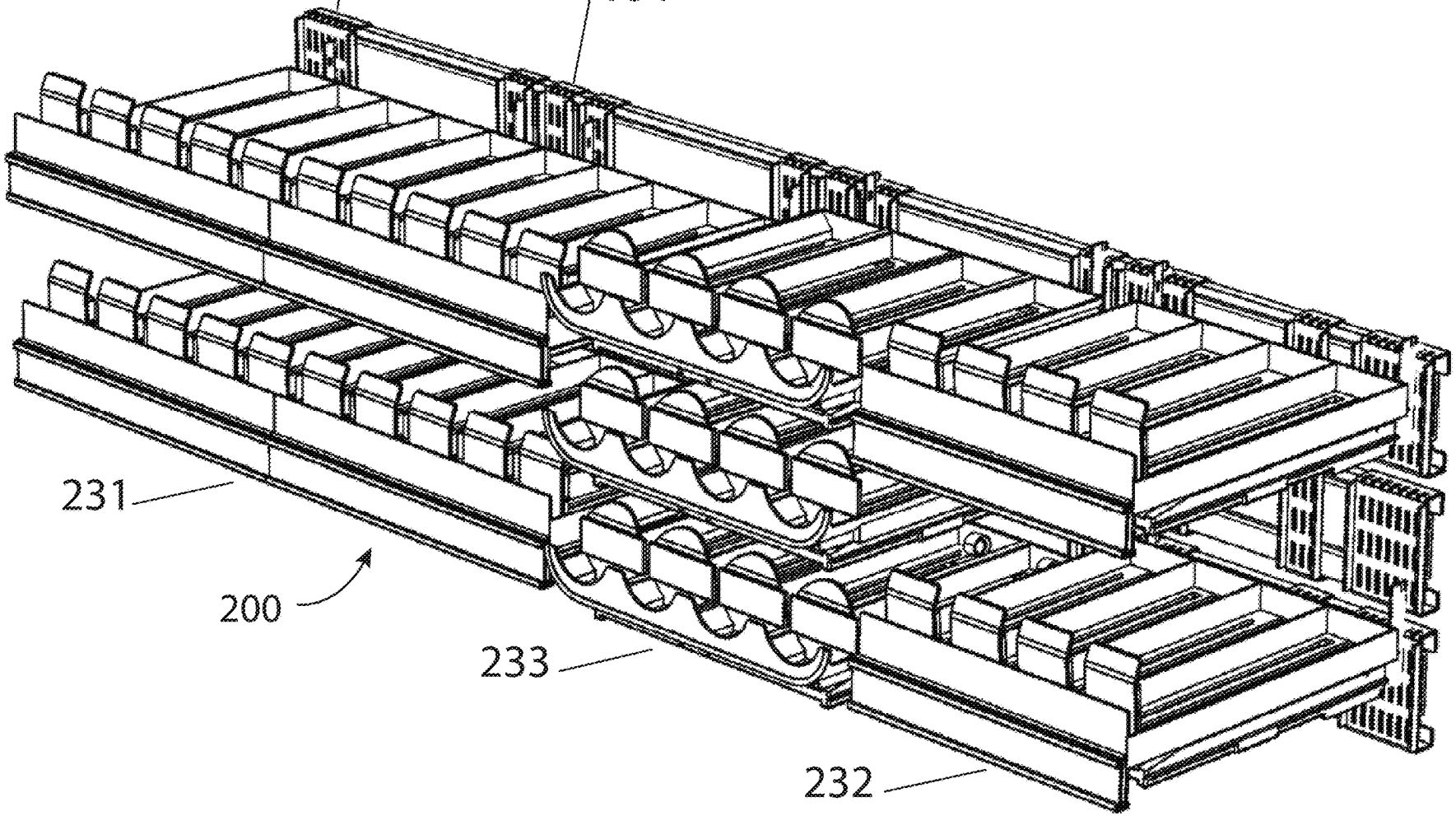
FIG. 27 illustrates a perspective-view of groups of shelves mounted on a mounting system, in accordance with an example embodiment.

FIG. 27 illustrates a perspective-view of groups of modularized shelves 200 mounted on a mounting system 100, in accordance with an example embodiment. Specifically, groups of different types of shelves 231/232/233, with varying widths, may easily be connected to the mounting system 100. Due to the variable depth of the shelves (which may be provided by the protractable blade 224, shown in at least FIG. 24B), some sections of the shelving, such as shelves 233, may be displayed more prominently. This may be provided to display specialty consumer product items, sale items, higher-grossing products, etc.

Figure 28A:
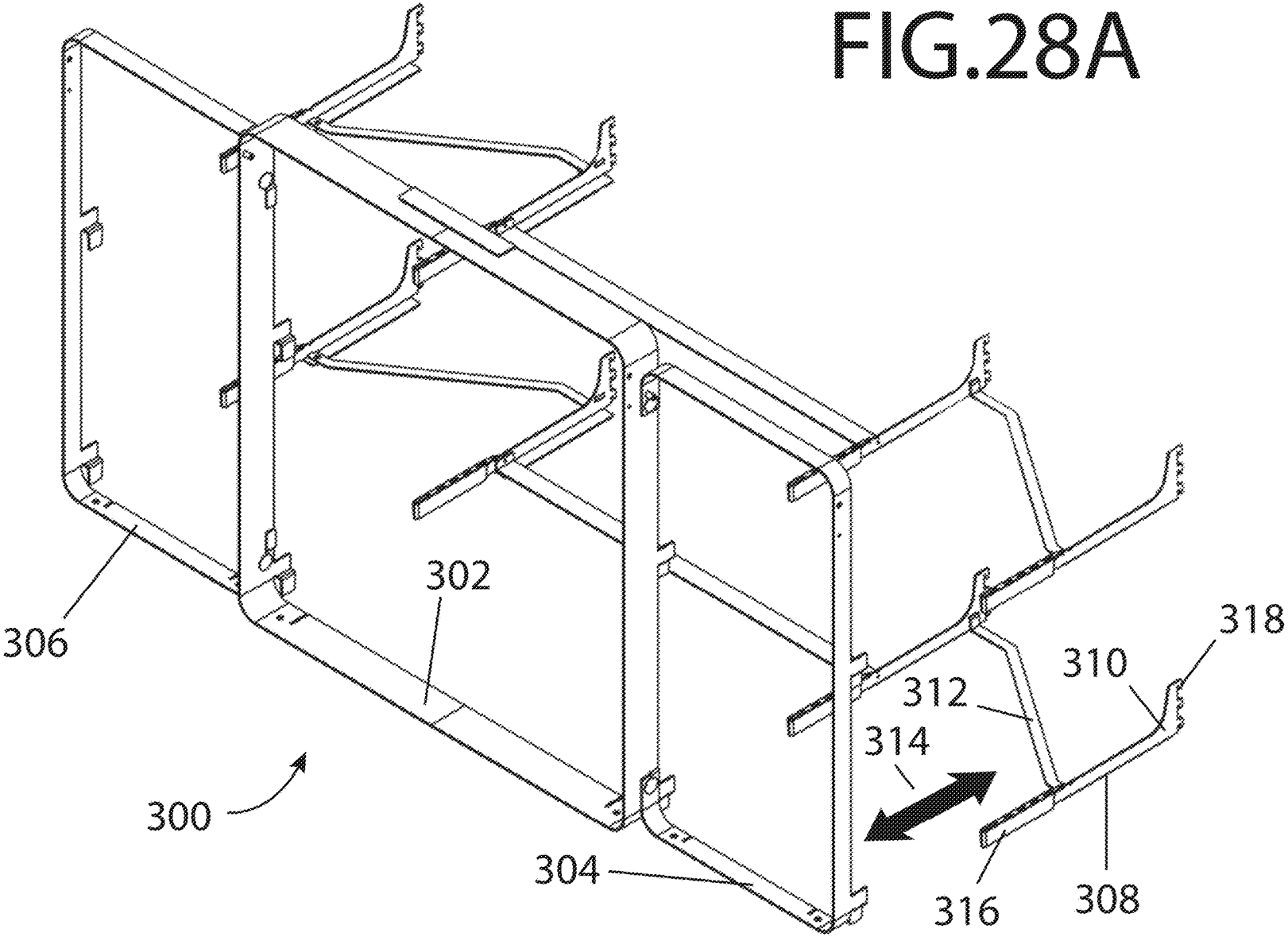
FIG. 28A illustrates a perspective-view of a graphic frame of a mounting system, in accordance with an example embodiment.
Figure 29:
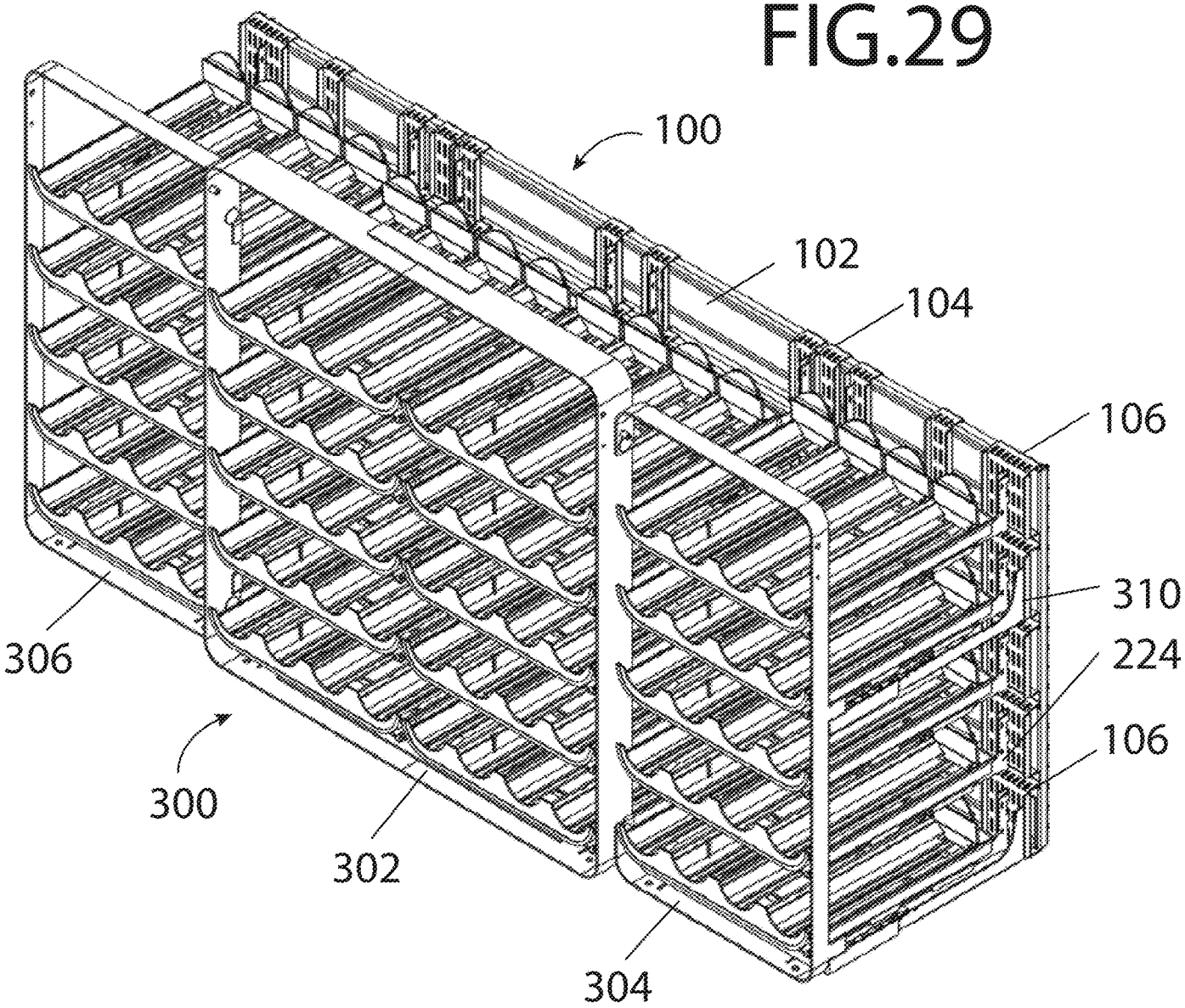
FIG. 29 illustrates a perspective-view of a graphic frame installed along with groups of shelves on a mounting system, in accordance with an example embodiment.

FIG. 28A illustrates a perspective-view of a graphic frame 300 of a mounting system 100, in accordance with an example embodiment. The frame 300 may include a central frame 302 (for instance), and side-frames 306 connected to the central frame 302. The central frame 302 may, as an example, be more prominently displayed by having the central frame 302 set further forward within the overall framework 300, as compared to the side-frames 304. The frames 302/304 may help draw visual attention to sections of shelving that may fit in the frames (as shown in FIG. 29), where each section of shelving may, for instance, contain a same tray-type, or a same type of consumer product. Supports 312 may be connected to rear blades 308 that may adjust an overall frame-depth (as shown by the movement-direction 314 of the blades 308).

The blades 308 may include a bracket 310 with an engaging structure, such as teeth 318 that may connect to the bracket 104/106 on the crossbars 102 of the mounting system 100. A support 316 on a proximal end of the blade 308 may provide stability to the overall graphic frame 300 (as shown in detail in FIG. 28B).

Figure 28B:
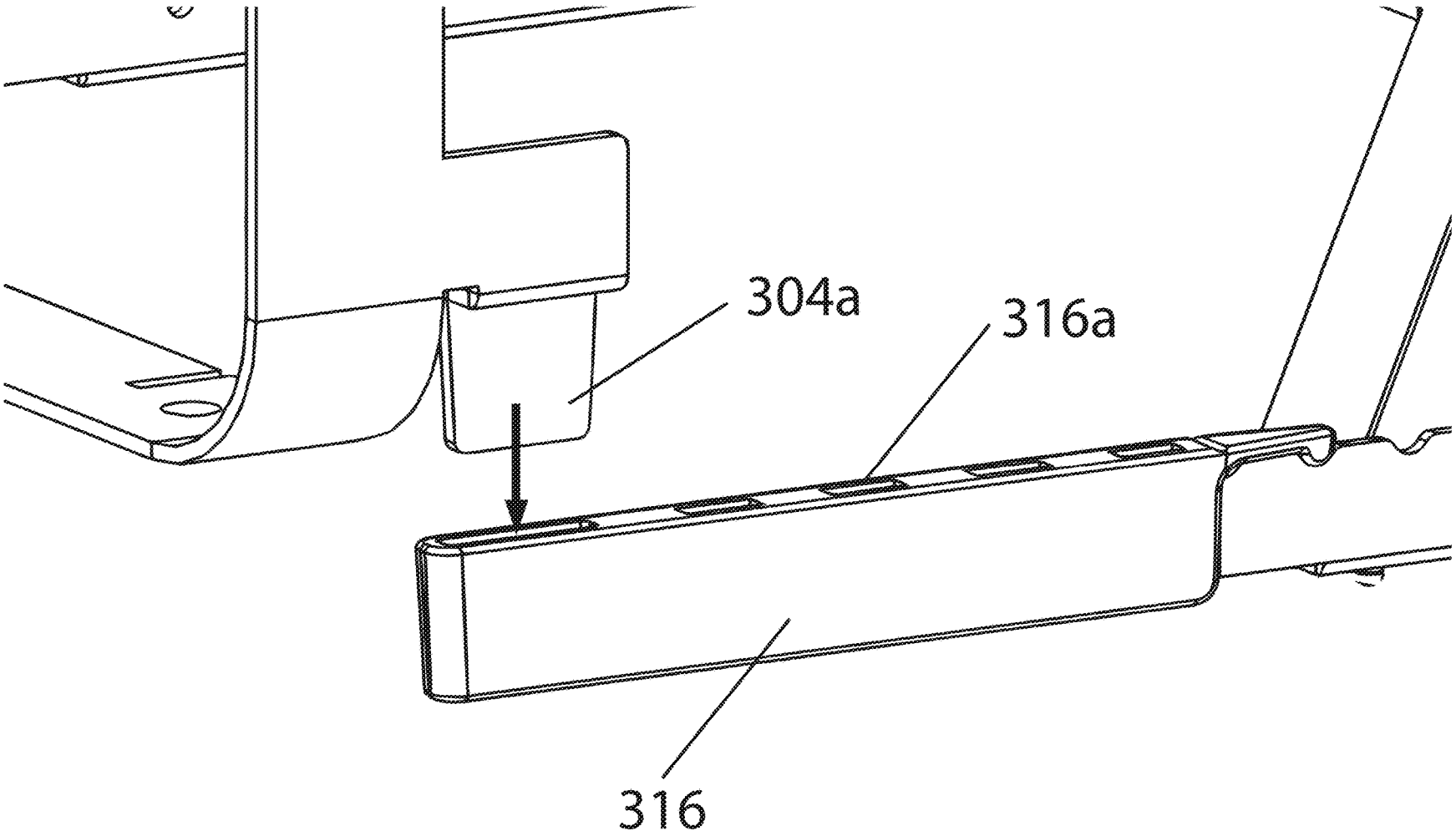
FIG. 28B illustrates a close-up view of a support of a graphic frame retaining an end of the graphic frame, in accordance with an example embodiment.

FIG. 28B illustrates a close-up view of a support 316 of a graphic frame 300 retaining an end of the graphic frame 300, in accordance with an example embodiment. Specifically, the graphic frame 300 may include mounting stubs 304*a* that may be fitted into one of a series of spaced-apart slots 316*a* in the support 316, in order to allow the overall graphic frame 300 to be more stably supported by the blades 308, where the brackets 310 of the blades 308 may connect to brackets 104/106 on the mounting system 100.

Figure 28C:
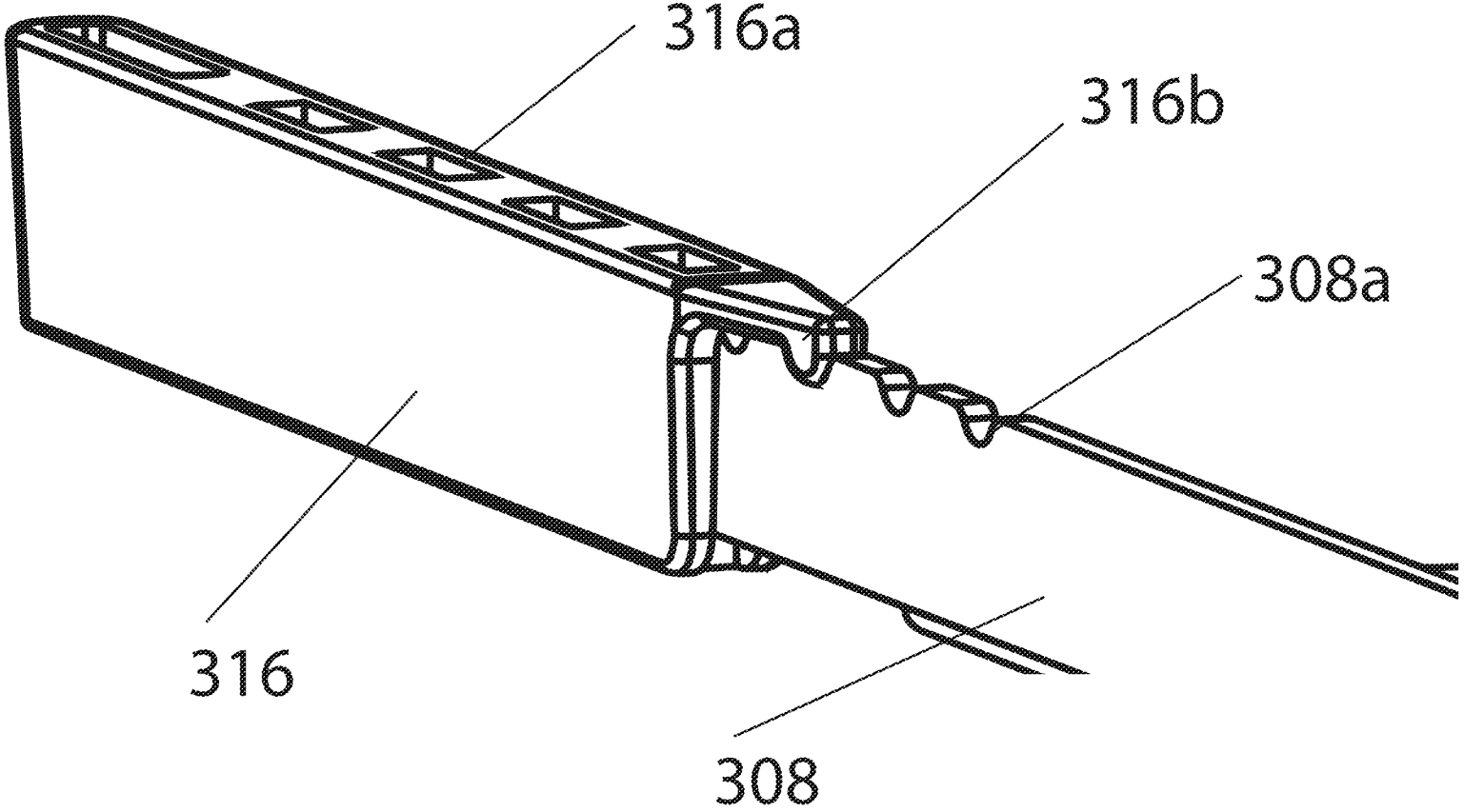
FIG. 28C illustrates a close-up view of a support of a graphic frame of a mounting system, in accordance with an example embodiment.

FIG. 28C illustrates a close-up view of a support 316 of a graphic frame of a mounting system, in accordance with an example embodiment. The support may include stops 316*b* that may fit into one of a series of notches 308*a* in the blade 308 of the graphic frame 300 in order to adjust the reach of the support 306, so that the support 316 may mate with the mounting stubs 304*a* of the frame 300 (as shown in FIG. 28B).

FIG. 29 illustrates a perspective-view of a graphic frame 300 installed along with groups of shelves on a mounting system 100, in accordance with an example embodiment. Notice that the brackets 310 of the frame 300 may connect to any of the brackets 104/106 of the mounting system 100. Because the ends of the mounting system 100 may support both shelving brackets 224 and graphic frame brackets 310, the wider brackets 106 may be included on the ends of the crossbars 102, whereas the narrower brackets 104 may be adjusted for use in desired locations toward the midsection of the crossbars 102.

As stated above, the frames 302/304 of the graphic frame 300 may delineate sections of shelving, where similar products, or similar-type shelves, may for instance be grouped within the discrete frames 302/304.

Example embodiments described herein may be applied to any retail shelving space.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A mounting system, comprising:

a first crossbar;

at least one horizontally-slideable bracket on the first crossbar; and a first support bracket and a second support bracket respectively on a first end and a second end of the first crossbar, the first support bracket and the second support bracket configured to attach the first crossbar to a first vertical upright and a second vertical upright of a consumer product display, respectively, the first support bracket and the second support bracket each including, a major body, a first engaging structure and a second engaging structure on a first end and a second end of the major body, respectively, the first engaging structure and the second engaging structure each being configured to respectively connect to a front set of teeth and a back set of teeth, the front set of teeth and the back set of teeth running along a longitudinal length of each of the first vertical upright and the second vertical upright, the front set of teeth and the back set of teeth opposing each other and facing away from each other on each of the first vertical upright and the second vertical upright, a floating plate on the major body, the floating plate including the second engaging structure and a center bracket, the floating plate being configured to cause the center bracket and the second engaging structure to slide in unison relative to the first engaging structure.

2. The mounting system of claim 1, wherein the first end and the second end of the first crossbar define a first cavity and a second cavity, respectively.

3. The mounting system of claim 2, further comprising:

a first insertable bracket and a second insertable bracket each with a major surface that are respectively insertable into the first cavity and the second cavity of the first crossbar.

4. The mounting system of claim 3, further comprising:

a third engaging structure and a fourth engaging structure respectively positioned on ends of the first insertable bracket and the second insertable bracket, the third engaging structure and the fourth engaging structure being configured to respectively connect the first insertable bracket and the second insertable bracket to the first support bracket and the second support bracket.

5. The mounting system of claim 3, wherein the major surface of each of the first insertable bracket and the second insertable bracket include ribs configured to respectively mate with ridges positioned on an inner surface of the first cavity and the second cavity of the first crossbar to lock the first insertable bracket and the second insertable bracket into the first crossbar.

6. The mounting system of claim 1, further comprising:

a modularized shelving configured to connect to the first crossbar, the modularized shelving including, at least one shelf including one or more protractable blades, the one or more protractable blades including a vertical bracket, the one or more protractable blades being configured to extend and retract the vertical bracket from a first end of the at least one shelf, the vertical bracket including a fifth engaging structure configured to connect the at least one shelf to the first crossbar.

7. The mounting system of claim 6, wherein the modularized shelving further includes at least one tray configured to be supported by the at least one shelf, the at least one shelf including horizontally adjustable tracks with notches capable of accepting mounting stubs for a varying width of the at least one tray.

8. The mounting system of claim 7, wherein the first end and the second end of the first crossbar each define, a major horizontal cavity between an upper horizontal cavity and a lower horizontal cavity, the major horizontal cavity having a greater width than the upper horizontal cavity and the lower horizontal cavity, and a fourth ridge and a fifth ridge projecting into the major horizontal cavity from an interior of a front surface of the first crossbar.

9. The mounting system of claim 1, wherein the first crossbar further includes, a front surface defining a first ridge above a second ridge, the first ridge and the second ridge having approximately a same depth, a back surface defining a raised ridge, the raised ridge being wider than the first ridge and the second ridge.

10. The mounting system of claim 1, wherein a length of the first crossbar is one of about 21.25 inches, 33.00 inches, or 44.50 inches.

11. The mounting system of claim 1, wherein the center bracket of the first support bracket and the second support bracket are each configured to engage and grip an inner surface of a track running along a center-position of the first vertical upright and the second vertical upright, respectively.

12. The mounting system of claim 11, wherein the first support bracket and the second support bracket each further include an outer surface that engages the first vertical upright and the second vertical upright, respectively, the second engaging structure and the center bracket being slideable along the outer surface.

13. The mounting system of claim 12, wherein the first support bracket and the second support bracket each further include a distal end of the center bracket extending from the outer surface, the distal end being configured to fit into a side groove of the track of the first vertical upright and the second vertical upright, respectively.

14. The mounting system of claim 12, wherein the floating plate is in a recessed area defined by the major body, the floating plate including the second engaging structure, the center bracket projecting from the floating plate, a locking plate holding the floating plate in the recessed area, the floating plate being configured to slide across the locking plate.

15. The mounting system of claim 14, wherein the first support bracket and the second support bracket each further include, a locking tab connected to the locking plate, a projection of the locking tab being configured to traverse through a portion of the locking plate to selectively lock the floating plate into one of a locked position or an unlocked position, wherein the unlocked position of the floating plate is configured to allow the second engaging structure and the center bracket to become respectively unengaged from the back set of teeth, and the inner surface of the track.

16. The mounting system of claim 1, wherein each of the first support bracket and the second support bracket includes, a recessed area defined by the major body, the floating plate being positioned within the recessed area and a locking plate holding the floating plate within the recessed area, the locking plate being configured to lock the floating plate into a locked position on the first vertical upright and the second vertical upright, respectively.

17. The mounting system of claim 1, wherein the at least one horizontally-slideable bracket has a C-shaped cross-section, the at least one horizontally-slideable bracket further including, a front surface defining a plurality of vertical slots, and an upper surface defining a plurality of horizontal slots, each of the plurality of horizontal slots also being defined by an upper portion of the front surface.

18. A mounting system, comprising:

a first crossbar, a first end and a second end of the first crossbar defining a first cavity and a second cavity, respectively;

at least one second crossbar;

a first insertable bracket and a second insertable bracket each with a major surface that are respectively insertable into the first cavity and the second cavity of the first crossbar;

at least one horizontally-slideable bracket on the first crossbar; and a first support bracket and a second support bracket respectively on the first end and the second end of the first crossbar, the first support bracket and the second support bracket configured to attach the first crossbar to a first vertical upright and a second vertical upright of a consumer product display, respectively, the first support bracket and the second support bracket each including, a major body, and a first engaging structure and a second engaging structure on a first end and a second end of the major body, respectively, the first engaging structure and the second engaging structure each being configured to respectively connect to a front set of teeth and a back set of teeth, the front set of teeth and the back set of teeth running along a longitudinal length of each of the first vertical upright and the second vertical upright, the front set of teeth and the back set of teeth opposing each other and facing away from each other on each of the first vertical upright and the second vertical upright, a first vertical connector connecting the first insertable bracket to at least one third insertable bracket;

a second vertical connector connecting the second insertable bracket to at least one fourth insertable bracket, the at least one third insertable bracket and the at least one fourth insertable bracket being insertable into ends of the at least one second crossbar to affix the at least one second crossbar to the first crossbar; and at least one third support bracket and at least one fourth support bracket on ends of the at least one second crossbar, the at least one third support bracket and the at least one fourth support bracket being configured to attach the at least one second crossbar to the first vertical upright and the second vertical upright, respectively.

19. The mounting system of claim 18, further comprising:

a first vertical corner plate connecting the first insertable bracket to the at least one third insertable bracket; and a second vertical corner plate connecting the second insertable bracket to the at least one fourth insertable bracket.

20. A mounting system, comprising:

a first crossbar;

at least one horizontally-slideable bracket on the first crossbar; and a first support bracket and a second support bracket respectively on a first end and a second end of the first crossbar, the first support bracket and the second support bracket configured to attach the first crossbar to a first vertical upright and a second vertical upright of a consumer product display, respectively, the first support bracket and the second support bracket each including, a major body, a first engaging structure and a second engaging structure on a first end and a second end of the major body, respectively, the first engaging structure and the second engaging structure each being configured to respectively connect to a front set of teeth and a back set of teeth, the front set of teeth and the back set of teeth running along a longitudinal length of each of the first vertical upright and the second vertical upright, the front set of teeth and the back set of teeth opposing each other and facing away from each other on each of the first vertical upright and the second vertical upright, a modularized shelving configured to connect to the first crossbar, the modularized shelving including, at least one shelf including one or more protractable blades, the one or more protractable blades including a vertical bracket, the one or more protractable blades being configured to extend and retract the vertical bracket from a first end of the at least one shelf, the vertical bracket including a fifth engaging structure configured to connect the at least one shelf to the first crossbar, the fifth engaging structure including, one or more teeth, the one or more teeth including a top-most tooth, the top-most tooth being configured to insert into one of a plurality of horizontal slots on an upper surface of the at least one horizontally-slideable bracket such that a distal most end of the top-most tooth contacts and becomes supported by an upper ridge on a front surface of the first crossbar.

21. A mounting system comprising:

a first crossbar;

at least one horizontally-slideable bracket on the first crossbar; and a first support bracket and a second support bracket respectively on a first end and a second end of the first crossbar, the first support bracket and the second support bracket configured to attach the first crossbar to a first vertical upright and a second vertical upright of a consumer product display, respectively, the first support bracket and the second support bracket each including, a major body, a first engaging structure and a second engaging structure on a first end and a second end of the major body, respectively, the first engaging structure and the second engaging structure each being configured to respectively connect to a front set of teeth and a back set of teeth, the front set of teeth and the back set of teeth running along a longitudinal length of each of the first vertical upright and the second vertical upright, the front set of teeth and the back set of teeth opposing each other and facing away from each other on each of the first vertical upright and the second vertical upright, at least one center bracket configured to engage and grip an inner surface of a track running along a center-position of the first vertical upright and the second vertical upright, respectively, an outer surface that engages the first vertical upright and the second vertical upright, respectively, the second engaging structure and the center bracket being slideable along the outer surface, and a first surface and a second surface that are about perpendicular to each other, the first engaging structure including the first surface and the second surface, the first surface and the second surface defining a plurality of slots configured to engage the front set of teeth of the first vertical upright and the second vertical upright, respectively, wherein each of the plurality of slots are defined by both the first surface and the second surface.

22. The mounting system of claim 21, wherein the first support bracket and the second support bracket each further include, a plurality of teeth, the second engaging structure including the plurality of teeth, wherein a distal end of the center bracket is configured to fit into a side groove of a track of the first vertical upright and the second vertical upright, respectively.

* * * * *